US009802417B2

(12) United States Patent
Kimura et al.

(10) Patent No.: US 9,802,417 B2
(45) Date of Patent: Oct. 31, 2017

(54) LIQUID CONTAINER AND LIQUID EJECTION SYSTEM

(71) Applicant: SEIKO EPSON CORPORATION, Tokyo (JP)

(72) Inventors: Naomi Kimura, Okaya (JP); Munehide Kanaya, Azumino (JP); Shoma Kudo, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/214,867

(22) Filed: Jul. 20, 2016

(65) Prior Publication Data

US 2017/0028735 A1 Feb. 2, 2017

(30) Foreign Application Priority Data

Jul. 29, 2015 (JP) ..... 2015-149347

(51) Int. Cl.
*B41J 2/175* (2006.01)
*B41J 29/02* (2006.01)
*B41J 29/13* (2006.01)

(52) U.S. Cl.
CPC ..... *B41J 2/17523* (2013.01); *B41J 2/175* (2013.01); *B41J 2/1752* (2013.01);
(Continued)

(58) Field of Classification Search
CPC .... B41J 2/175; B41J 2/17503; B41J 2/17513; B41J 2/17523; B41J 2/17556
See application file for complete search history.

(56) References Cited

U.S. PATENT DOCUMENTS 9,352,573 B1 * 5/2016 Turgeman ..... B41J 2/17506
2011/0069126 A1 * 3/2011 Feng ..... B41J 2/17513 347/87

(Continued)

FOREIGN PATENT DOCUMENTS

JP 2015-080907 A 4/2015
JP 2015080907 A * 4/2015
JP 2016000504 A * 1/2016

OTHER PUBLICATIONS

Koike et al., MachineTranslationOfJP 2015080907 A, 2015.*
Osakabe et al., MachineTranslationofJP 2016000504 A, 2016.*

*Primary Examiner* — Geoffrey Mruk
*Assistant Examiner* — Scott A Richmond
(74) *Attorney, Agent, or Firm* — Foley & Lardner LLP

(57) ABSTRACT

Leakage of liquid from a liquid container is reduced. A liquid container capable of containing liquid has: a liquid containing portion capable of containing the liquid; a liquid inlet port receiving injection of the liquid into the liquid containing portion; an atmosphere opening port communicating with the liquid containing portion and introducing atmosphere into the liquid containing portion; an atmosphere communicating portion leading to the liquid containing portion from the atmosphere opening port; a first face oriented outward; and a second face oriented outward in a direction that is different from a direction of the first face. The atmosphere communicating portion includes a plurality of atmosphere chambers, and the plurality of atmosphere chambers include a first atmosphere chamber provided in the first face, and a second atmosphere chamber provided in the second face.

16 Claims, 31 Drawing Sheets

(52) U.S. Cl.
CPC ..... *B41J 2/17509* (2013.01); *B41J 2/17513* (2013.01); *B41J 29/02* (2013.01); *B41J 29/13* (2013.01)

(56) References Cited

U.S. PATENT DOCUMENTS

2015/0109386 A1* 4/2015 Koike ..... B41J 2/17513
347/86
2015/0360476 A1* 12/2015 Osakabe ..... B41J 2/17553
347/85

* cited by examiner

LIQUID CONTAINER AND LIQUID EJECTION SYSTEM

CROSS REFERENCE TO RELATED APPLICATION

This application claims priority to Japanese Patent Application No. 2015-149347 filed on Jul. 29, 2015, the entire contents of this application are incorporated by reference herein.

BACKGROUND

1. Technical Field

The present invention relates to liquid containers, liquid ejection systems, and the like.

2. Related Art

Hitherto, inkjet printers are known as exemplary liquid ejection apparatuses. Inkjet printers can print on print mediums by discharging ink, which is exemplary liquid, from an ejection head onto print mediums such as print paper. Regarding such inkjet printers, a configuration in which ink stored in a tank, which is an exemplary liquid container, is supplied to the ejection head has been hitherto known. Regarding such a tank, a configuration in which atmosphere can be introduced into a containing portion, which is capable of containing ink, from an atmosphere communicating port via a communicating portion is known. JP-A-2015-80907 proposes a configuration capable of reducing, in this kind of a tank, leakage of ink in the containing portion to the outside of the tank from the atmosphere communicating port through the communicating portion (e.g., see JP-A-2015-80907).

The aforementioned JP-A-2015-80907 does not propose any further improvement, i.e., a configuration capable of further reducing the leakage of liquid from the liquid container.

SUMMARY

The invention can solve at least the foregoing problem, and can be achieved as the following modes or application examples.

APPLICATION EXAMPLE 1

A liquid container capable of containing a liquid, including: a liquid containing portion capable of containing the liquid; a liquid inlet port receiving injection of the liquid into the liquid containing portion; an atmosphere opening port communicating with the liquid containing portion and introducing atmosphere into the liquid containing portion; an atmosphere communicating portion leading to the liquid containing portion from the atmosphere opening port; a first face oriented outward; and a second face oriented outward in a direction different from a direction of the first face, wherein the atmosphere communicating portion includes a plurality of atmosphere chambers, and the plurality of atmosphere chambers include: a first atmosphere chamber provided in the first face; and a second atmosphere chamber provided in the second face.

In this liquid container, the first face and the second face are oriented in different directions, the first atmosphere chamber is provided in the first face, and the second atmosphere chamber is provided in the second face. Therefore, even if the liquid enters the atmosphere communicating portion from the liquid containing portion, the progress of the liquid can be readily prevented between the first atmosphere chamber and the second atmosphere chamber. Thus, leakage of the liquid in the liquid containing portion to the outside of the liquid container from the atmosphere opening port via the atmosphere communicating portion can be readily prevented.

APPLICATION EXAMPLE 2

In the above liquid container, the first face and the second face are oriented in opposite directions.

In this liquid container, since the first face and the second face are oriented in opposite directions, the progress of the liquid can be readily prevented between the first atmosphere chamber and the second atmosphere chamber. Thus, leakage of the liquid in the liquid containing portion to the outside of the liquid container from the atmosphere opening port via the atmosphere communicating portion can be readily prevented.

APPLICATION EXAMPLE 3

The above liquid container further includes: a third face oriented outward in a direction intersecting the direction of the first face, wherein the plurality of atmosphere chambers include a third atmosphere chamber provided in the third face.

In this liquid container, since the first face and the third face are oriented in directions that intersect each other, the progress of the liquid can be readily prevented between the first atmosphere chamber and the third atmosphere chamber. Thus, leakage of the liquid in the liquid containing portion to the outside of the liquid container from the atmosphere opening port via the atmosphere communicating portion can be readily prevented.

APPLICATION EXAMPLE 4

In the above liquid container, a waterproof air-permeable member is arranged in an atmosphere chamber that is closest to the atmosphere opening port in a flow path of the atmosphere communicating portion among the plurality of atmosphere chambers.

In this liquid container, since the progress of the liquid can be prevented by the waterproof air-permeable member, the liquid that has entered the atmosphere communicating portion from the liquid containing portion reaching the atmosphere opening port can be readily suppressed.

APPLICATION EXAMPLE 5

In the above liquid container, in a posture of the liquid container when in use, a connection port between the atmosphere communicating portion and the liquid containing portion is located at the same position in a vertical direction as the liquid inlet port, or is located above the liquid inlet port.

In this liquid container, the communicating port between the atmosphere communicating portion and the liquid containing portion is located at the same position in the vertical direction as the liquid inlet port, or is located above the liquid inlet port. Therefore, the liquid in the liquid containing portion does not easily reach the connection port.

APPLICATION EXAMPLE 6

In the above liquid container, in a posture of the liquid container when in use, a connection port between the atmosphere communicating portion and the liquid containing portion is located below the liquid inlet port.

With this liquid container, in the configuration in which the connection port between the atmosphere communicating portion and the liquid containing portion is located below the liquid inlet port, leakage of the liquid in the liquid containing portion to the outside of the liquid container from the atmosphere opening port via the atmosphere communicating portion can be readily prevented.

APPLICATION EXAMPLE 7

In the above liquid container, the liquid is ink that contains a sublimating color material.

APPLICATION EXAMPLE 8

A liquid ejection system includes: the above-described liquid container; a liquid ejection head to which the liquid is supplied from the liquid container; and an exterior portion that houses the liquid container and the liquid ejection head, wherein the liquid container includes a visual check portion that check a position of a liquid surface of the liquid contained in the liquid containing portion visually.

APPLICATION EXAMPLE 9

In the above liquid ejection system, the visual check portion is provided with an upper limit index portion indicating a guide of an upper limit of an amount of liquid in the liquid containing portion.

APPLICATION EXAMPLE 10

In the above liquid ejection system, the exterior portion is provided with a window portion through which the visual check portion can be visually checked.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
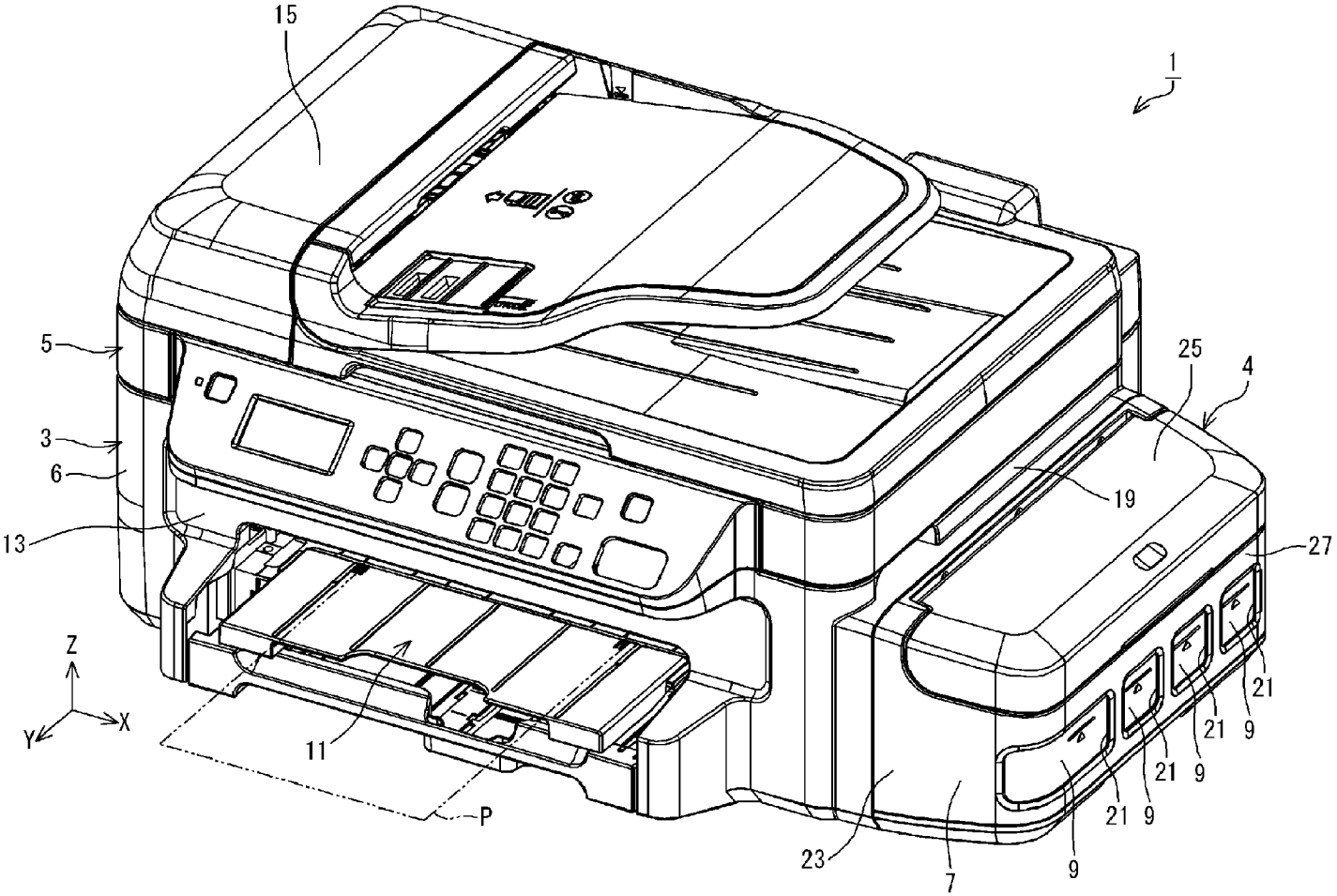
FIG. 1 is a perspective view illustrating a main configuration of a liquid ejection system according to embodiments.

Embodiments will be described with reference to the drawings, taking a liquid ejection system that includes an inkjet printer (hereinafter referred to as a printer), which is an exemplary liquid ejection apparatus, as an example. Note that the scale of components and members may be different in the drawings so that each component has a recognizable size.

As illustrated in FIG. 1, a liquid ejection system 1 according to the embodiments has a printer 3, which is an exemplary liquid ejection apparatus, an ink supply apparatus 4, which is an exemplary liquid supply apparatus, and a scanner unit 5. The printer 3 has a housing 6. The housing 6 includes an outer shell of the printer 3. The ink supply apparatus 4 has a housing 7, which is an exemplary liquid container attaching portion, and a plurality of (two or more) tanks 9. The housing 6, the housing 7, and the scanner unit 5 include an outer shell of the liquid ejection system 1. Note that a configuration in which the scanner unit 5 is omitted may also be employed as the liquid ejection system 1. The tanks 9 are exemplary liquid containers. The liquid ejection system 1 can print on a recording medium P, such as recording paper, using ink, which is exemplary liquid.

Here, in FIG. 1, X, Y, and Z axes, which are mutually orthogonal coordinate axes, are provided. The X, Y, and Z axes are also illustrated as necessary in the subsequent diagrams. In the embodiments, a state where the liquid ejection system 1 is arranged in a horizontal plane defined by the X axis and the Y axis (XY plane) corresponds to a usage state of the liquid ejection system 1. The posture of the liquid ejection system 1 when the liquid ejection system 1 is arranged in an XY plane will be referred to as a usage posture of the liquid ejection system 1. The Z axis is an axis orthogonal to the horizontal plane. In the usage state of the liquid ejection system 1, a Z-axis direction is a vertically upward direction. Also, in the usage state of the liquid ejection system 1, a -Z-axis direction is a vertically downward direction in FIG. 1. Note that, of each of the X, Y, and Z axes, the direction of the arrow indicates a plus (positive) direction, and the direction opposite to the direction of the arrow indicates a minus (negative) direction.

In the liquid ejection system 1, the printer 3 and the scanner unit 5 are stacked. In a state of the printer 3 when in use, the scanner unit 5 is located vertically above the printer 3. The scanner unit 5 is of a flat-bed type, and has an image sensor (not illustrated). The scanner unit 5 can read out, as image data, images or the like recorded on a medium such as paper, via the imaging sensor. For this reason, the scanner unit 5 functions as a device for reading out images or the like. The scanner unit 5 is configured to be able to pivot relative to the printer 3. The scanner unit 5 also has a function of a lid of the printer 3. An operator can pivot the scanner unit 5 relative to the printer 3 by lifting up the scanner unit 5 in the Z-axis direction. Thus, the scanner unit 5, which functions as a lid of the printer 3, can be opened relative to the printer 3.

The printer 3 is provided with a paper discharge portion 11. In the printer 3, a recording medium P is discharged from the paper discharge portion 11. A face of the printer 3 in which the paper discharge portion 11 is provided is a front face 13. The liquid ejection system 1 also has an upper face 15 that intersects the front face 13, and a side portion 19 that intersects the front face 13 and the upper face 15. The ink supply apparatus 4 is provided in the side portion 19. The housing 7 is provided with window portions 21. In the housing 7, the window portions 21 are provided in a side portion 27 that intersects a front face 23 and an upper face 25.

The window portions 21 are optically translucent. The aforementioned four tanks 9 are provided in positions that overlap the window portions 21. Therefore, the operator who uses the liquid ejection system 1 can visually check the four tanks 9 via the window portions 21. In the embodiments, the window portions 21 are provided as openings formed in the housing 7. The operator can visually check the four tanks 9 via the windows 21 that are openings. Note that the window portions 21 are not limited to openings, and may be included by optically translucent members, for example.

In the embodiments, at least a part of a portion of each tank 9 that faces the corresponding window portion 21 is optically translucent. Ink in the tanks 9 can be visually checked from the optically translucent portions of the tanks 9. Accordingly, the operator can visually check the amount of ink in the tanks 9 by visually checking the four tanks 9 via the window portions 21. That is to say, at least a part of a portion of each tank 9 that faces the corresponding window portion 21 can be used as a visual check portion through which the amount of ink can be visually checked.

Figure 2:
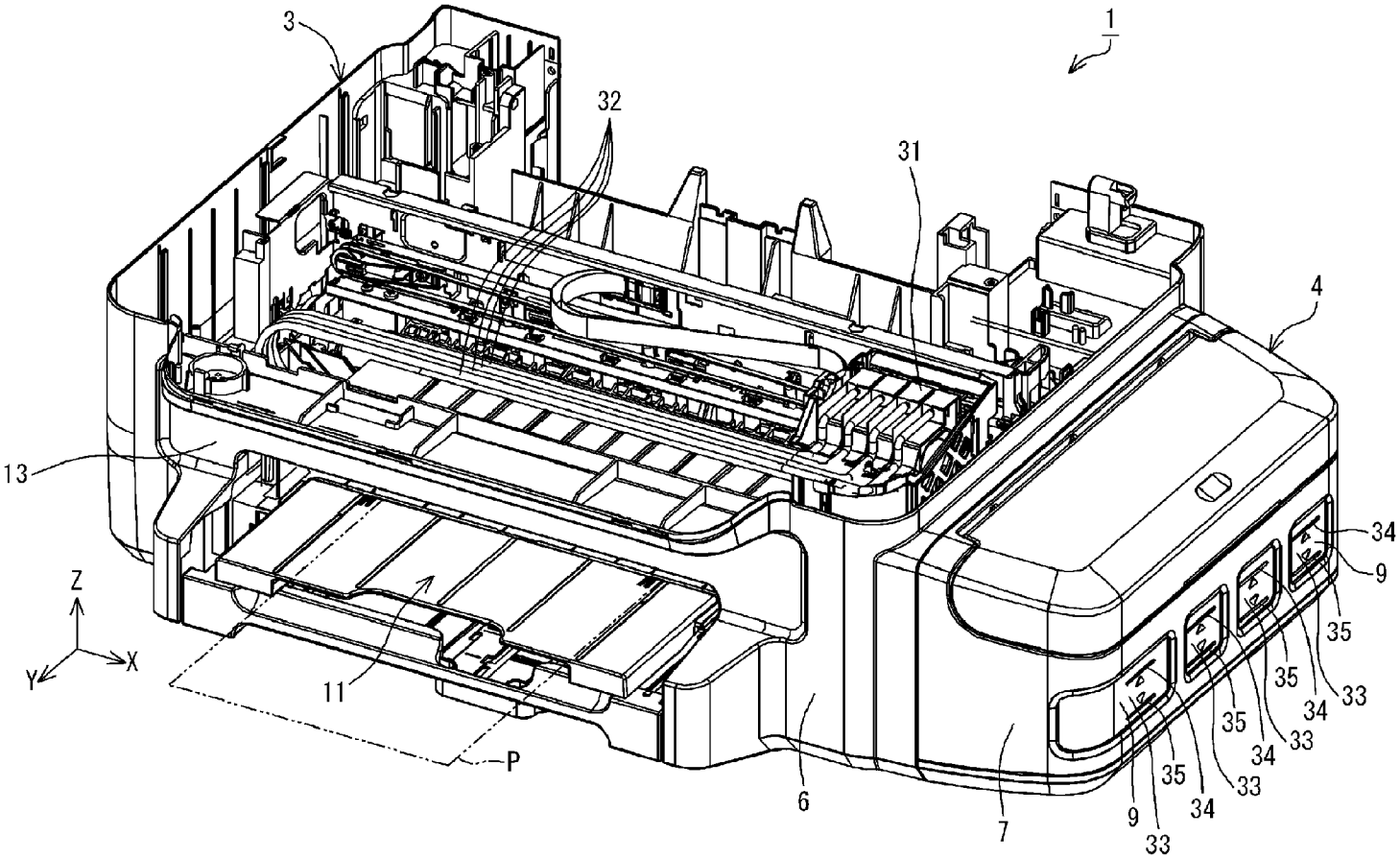
FIG. 2 is a perspective view illustrating a main configuration of the liquid ejection system according to embodiments.

As illustrated in FIG. 2, the printer 3 has a recording portion 31. In the printer 3, the recording portion 31 is housed in the housing 6. The recording portion 31 performs recording using ink, which is exemplary liquid, on a recording medium P that is conveyed in the Y-axis direction by a conveyance device (not illustrated). Note that the conveyance device (not illustrated) intermittently conveys recording mediums P, such as recording paper, in the Y-axis direction. The recording portion 31 is configured to be able to be moved back and forth along the X axis by a moving device (not illustrated). The ink supply apparatus 4 supplies ink to the recording portion 31. Note that, in the liquid ejection system 1, at least a part of the ink supply apparatus 4 is located outside of the housing 6. Note that the recording portion 31 is housed in the housing 6. Thus, the recording portion 31 can be protected by the housing 6.

Here, a direction extending along the X axis is not limited to a direction that is completely parallel with the X axis, and includes a direction that tilts due to an error, a tolerance, or the like, excluding a direction perpendicular to the X axis. Similarly, a direction extending along the Y axis is not limited to a direction that is completely parallel with the Y axis, and includes a direction that tilts due to an error, a tolerance, or the like, excluding a direction perpendicular to the Y axis. A direction extending along the Z axis is not limited to a direction that is completely parallel with the Z axis, and includes a direction that tilts due to an error, a tolerance, or the like, excluding a direction perpendicular to the Z axis. That is to say, a direction extending along any axis or plane is not limited to a direction that is completely parallel with such an axis or plane, and includes a direction that tilts due to an error, a tolerance, or the like, excluding a direction perpendicular to such an axis or plane.

The ink supply apparatus 4 has tanks 9, which are exemplary liquid containers. In this embodiment, the ink supply apparatus 4 has a plurality of (in this embodiment, four) tanks 9. The plurality of tanks 9 are located outside of the housing 6 of the printer 3. The plurality of tanks 9 are housed in the housing 7. Thus, the tanks 9 can be protected by the housing 7. The housing 7 is located outside of the housing 6.

Note that, in this embodiment, the ink supply apparatus 4 has a plurality of (four) tanks 9. However, the number of tanks 9 is not limited to four, and may be three, less than three, or more than four.

Furthermore, in this embodiment, a plurality of tanks 9 are included by separate bodies. However, the configuration of the tanks 9, which are exemplary liquid containers, are not limited thereto. The liquid containers may include a configuration in which the plurality of tanks 9 are integrated into a single liquid container. In this case, a plurality of liquid containing portions are provided in the single liquid container. The plurality of liquid containing portions are configured to be separated from one another and to be able to contain different kinds of liquid. In this case, for example, ink of different colors can be individually contained in the plurality of liquid containing portions.

As illustrated in FIG. 2, ink supply tubes 32 are connected to respective tanks 9. The ink in the tanks 9 is supplied from the ink supply apparatus 4 to the recording portion 31 via the ink supply tubes 32. The recording portion 31 is provided with a recording head (not illustrated), which is an exemplary liquid ejection head. Nozzle openings (not illustrated), which are oriented to the recording medium P side, are formed in the recording head. The ink supplied from the ink supply apparatus 4 to the recording portion 31 via the ink supply tubes 32 is supplied to the recording head. Then, the ink supplied to the recording portion 31 is discharged as ink droplets to the recording medium P from the nozzle openings of the recording head. Note that although the printer 3 and the ink supply apparatus 4 are separate components in the above-described example, the ink supply apparatus 4 may be included in the configuration of the printer 3.

Note that each tank 9 may also employ a configuration in which an upper limit mark 34, a lower limit mark 35, and the like are added to a visual check face 33, through which the amount of contained ink can be visually checked. The visual check face 33 is an exemplary visual check portion. The upper limit mark 34 is an exemplary upper limit index portion. The operator can find the amount of ink in each tank 9 using the upper limit mark 34 and the lower limit mark 35 as guides. Note that the upper limit mark 34 serves as a guide of the amount of ink that does not cause the ink to overflow from a later-described liquid inlet portion 36 when the ink is injected from the liquid inlet portion 36. The lower limit mark 35 serves as a guide of the amount of ink when prompting the operator to inject ink. A configuration in which at least one of the upper limit mark 34 and the lower limit mark 35 is provided in each tank 9 may also be employed.

The housing 7 and the housing 6 may be separate bodies, or may be an integrated body. If the housing 7 and the housing 6 are an integrated body, it can be said that the plurality of tanks 9 are housed together with the recording portion 31 and the ink supply tubes 32 within the housing 6. If the housing 7 and the housing 6 are an integrated body, the housing 6 corresponds to an exterior portion that houses the liquid container and the liquid ejection head.

A location where the tanks 9 are arranged is not limited to the side face side of the housing 6 in the X-axis direction. For example, the location where the tanks 9 are arranged may also be the front face side of the housing 6 in the Y-axis direction.

In this embodiment, the plurality of tanks 9 are included by separate bodies. However, the configuration of the tanks 9 is not limited thereto. The tanks 9 may also include a configuration in which the plurality of tanks 9 are an integrated body. In this case, a plurality of ink chambers are provided in a single tank 9. The plurality of ink chambers are configured to be separated from one another and to be able to contain different kinds of ink. In this case, for example, ink of different colors can be separately contained in the plurality of ink chambers.

In the liquid ejection system 1 having the above-described configuration, recording is performed on a recording medium P by conveying the recording medium P in the Y-axis direction and causing the recording head of the recording portion 31 to discharge ink droplets in a predetermined position while moving the recording portion 31 back and forth along the X axis.

The ink is not limited to either one of water-based ink and oil-based ink. Water-based ink may include either a configuration in which a solute such as a dye is dissolved in an aqueous solvent, or a configuration in which dispersoid such as pigment is dispersed in an aqueous dispersion medium. Oil-based ink may include either a configuration in which a solute such as a dye is dissolved in an oil-based solvent, or a configuration in which dispersoid such as pigment is dispersed in an oil-based dispersion medium.

Figure 3:
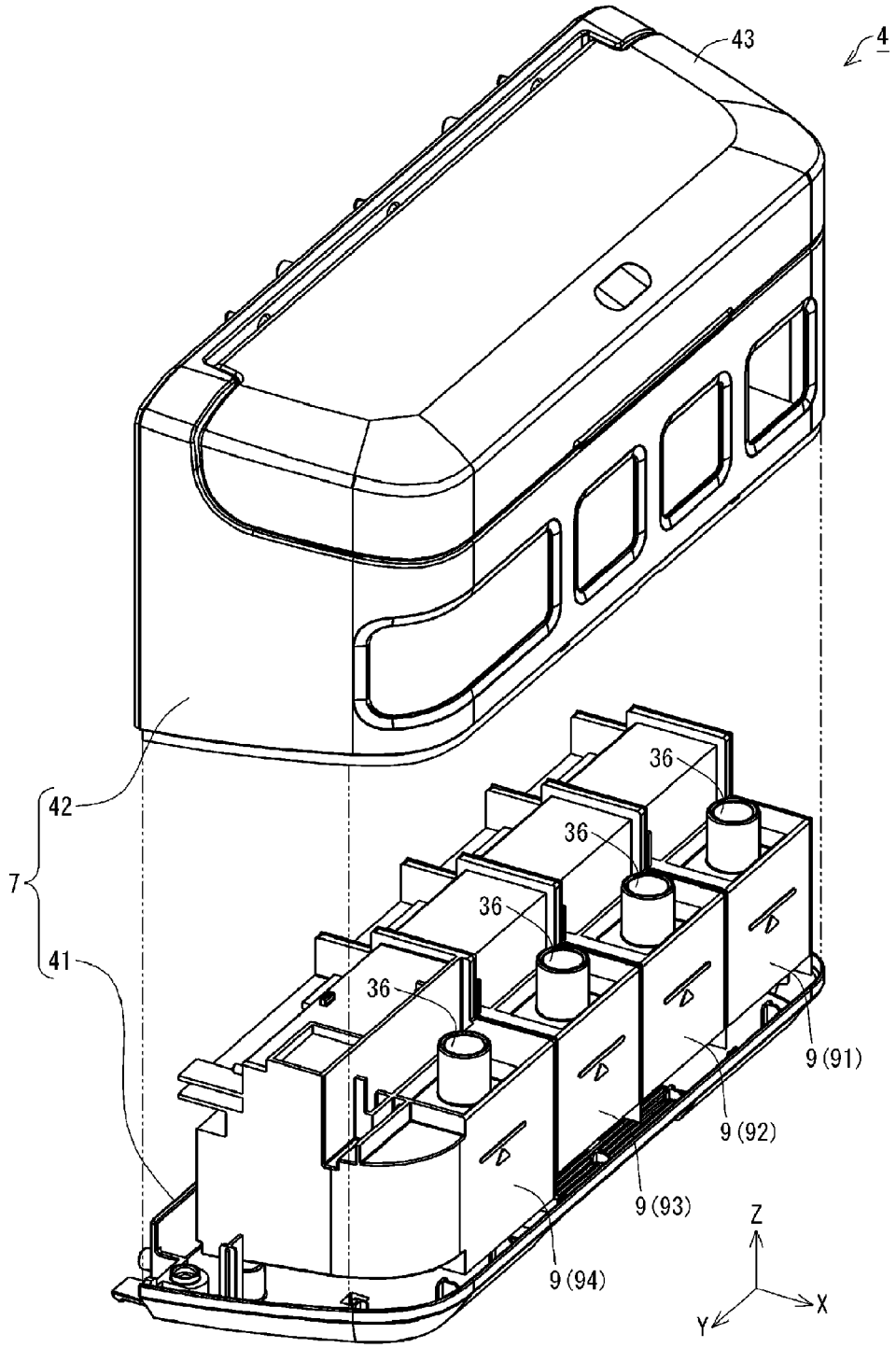
FIG. 3 is an exploded perspective view illustrating a main configuration of an ink supply apparatus according to embodiments.

In the ink supply apparatus 4, the housing 7 includes a first housing 41 and a second housing 42, as illustrated in FIG. 3. A liquid inlet portion 36 is formed in each tank 9. With each tank 9, ink can be injected into the tank 9 from the outside thereof via the corresponding liquid inlet portion 36. Note that the operator can access the liquid inlet portion 36 of each tank 9 from the outside of the housing 7.

Here, the X axis, the Y axis, and the Z axis in FIG. 3 correspond respectively to the X axis, the Y axis, and the Z axis indicated for the liquid ejection system 1 illustrated in FIG. 1. That is to say, the X axis, the Y axis, and the Z axis in FIG. 3 mean the X axis, the Y axis, and the Z axis in a state where the ink supply apparatus 4 is incorporated in the liquid ejection system 1. In the case where the X axis, the Y axis, and the Z axis are indicated in the later drawings illustrating constituent components and units of the liquid ejection system 1 as well, these axes mean the X axis, the Y axis, and the Z axis in a state where these constituent components and units are incorporated (installed) in the liquid ejection system 1. A posture of the constituent components and the units in the usage posture of the liquid ejection system 1 will be referred to as a usage posture of these constituent components and the units. As illustrated in FIG. 3, the first housing 41 is located further in the -Z-axis direction than the plurality of tanks 9. The plurality of tanks 9 are supported by the first housing 41. The second housing 42 is located further in the Z-axis direction than the first housing 41, and covers the plurality of tanks 9 from the Z-axis direction relative to the first housing 41. The plurality of tanks 9 are covered by the first housing 41 and the second housing 42.

In this embodiment, the four tanks 9 are arranged in the Y axis. In the following description, when individually identifying the four tanks 9, the four tanks 9 are denoted respectively as a tank 91, a tank 92, a tank 93, and a tank 94. The tank 91, the tank 92, the tank 93, and the tank 94 are arranged in this order in the Y-axis direction. That is to say, the tank 92 is located further in the Y-axis direction than the tank 91, the tank 93 is located further in the Y-axis direction than the tank 92, and the tank 94 is located further in the Y-axis direction than the tank 93.

Of the four tanks 9, the tank 91, the tank 92, and the tank 93 include the same shape. The tank 94 has a shape different from the shape of the other tanks 9. The volume of the tank 94 is larger than the volume of each of the other tanks 9. Except this point, the tank 94 has a configuration similar to the other tanks 9. This configuration is favorable for containing ink of a frequently used type in the tank 94, for example. This is because a larger amount of the ink of a frequently used type can be contained than the other types of ink.

Figure 4:
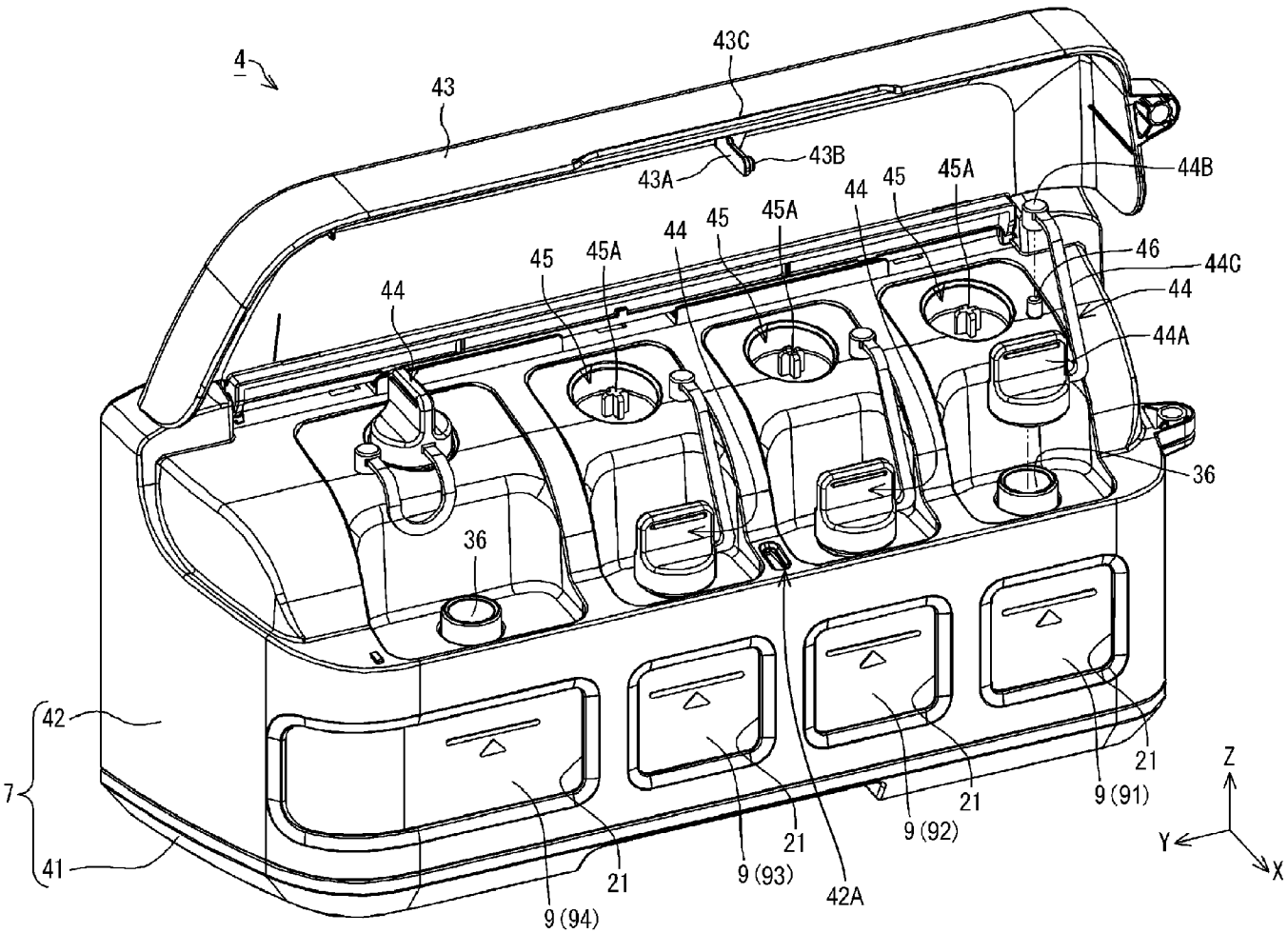
FIG. 4 is a perspective view illustrating a main configuration of the ink supply apparatus according to embodiments.

The second housing 42 has a cover 43. The cover 43 is located at an end of the second housing 42 in the Z-axis direction. As illustrated in FIG. 4, the cover 43 is configured to be able to pivot relative to the second housing 42. FIG. 4 illustrated a state where the cover 43 is open relative to the second housing 42. Upon the cover 43 being opened relative to the second housing 42, the liquid inlet portions 36 of the plurality of tanks 9 are exposed. Thus, the operator can access the liquid inlet portions 36 of the tanks 9 from the outside of the housing 7.

A locking portion 43A is provided in the cover 43. As illustrated in FIG. 4, the locking portion 43A is provided on the first housing 41 side of the cover 43. In a state where the cover 43 is closed, the locking portion 43A projects from the cover 43 toward the first housing 41 side. A protruding portion 43B is formed in the locking portion 43A. The protruding portion 43B is formed on the side opposite to the cover 43 side of the locking portion 43A. The protruding portion 43B projects in the -Y-axis direction from the locking portion 43A. In the second housing 42, a locking hole 42A is formed in a portion opposing the locking portion 43A. In the second housing 42, the locking hole 42A is formed in a portion that overlaps the locking portion 43A when the cover 43 is closed.

In a state where the cover 43 is closed, the locking portion 43A is inserted into the locking hole 42A of the second housing 42. At this time, the protruding portion 43B of the locking portion 43A engages with the locking hole 42A. Thus, a clicking sensation is obtained when the cover 43 is closed and the protruding portion 43B of the locking portion 43A engages with the locking hole 511. Also, for example, when the cover 43 is closed with strong force, the force of the cover 43 can be softened by the protruding portion 43B engaging with the locking hole 42A. Thus, it is possible to reduce impact occurring when the cover 43 abuts against the second housing 42 when the cover 43 is closed.

As illustrated in FIG. 4, a holding portion 43C is formed in the cover 43. The holding portion 43C is provided at an end of the cover 43 in the X-axis direction, which is also an end in the -Z-axis direction. The operator can pivot the cover 43 in the Z-axis direction by holding the holding portion 43C with fingers. At this time, since the holding portion 43C can be readily held with fingers, the operator can readily pivot the cover 43 by holding the holding portion 43C with fingers.

Note that the liquid inlet portions 36 are sealed by plug members 44. When injecting ink into each tank 9, the plug member 44 is removed from the liquid inlet portion 36 to open the liquid inlet portion 36, and then the ink is injected therein.

The second housing 42 further has a plurality of plug member arrangement portions 45 and a plurality of attaching portions 46. The plurality of plug member arrangement portions 45 and the plurality of attaching portions 46 are arranged on a surface of the second housing 42 in the Z-axis direction. In the second housing 42, the plurality of plug member arrangement portions 45 and the plurality of attaching portions 46 are provided on a surface opposing the cover 43. Therefore, when closing the cover 43, the plurality of plug member arrangement portions 45 and the plurality of attaching portions 46 are covered by the cover 43. The plurality of plug member arrangement portions 45 are arranged next to one another along the Y axis. The plurality of attaching portions 46 are arranged next to one another along the Y axis.

The plurality of plug member arrangement portions 45 are configured to enable plug bodies 44A of the corresponding plug members 44 to be arranged therein. That is to say, the plug member arrangement portions 45 are portions in which the plug bodies 44A of the corresponding plug members 44 removed from the liquid injecting ports 52 are to be arranged.

The plug member arrangement portions 45 are recessed portions formed in a surface of the second housing 42 in the Z-axis direction. The plug bodies 44A of the plug members 44 are received by these recessed portions. The plug member arrangement portions 45 can hold ink with the recessed portions. The plug member arrangement portions 45 each include a projection 45A. The projection 45A projects in the vertically upward direction from a surface of the second housing 42 in the Z-axis direction. The projection 45A is a portion with which the corresponding plug body 44A of the plug member 44 is attached (held) as a result of the plug body 44A being inserted therein. It is favorable that the plug member arrangement portions 45 are configured to be able to hold ink. For example, as in this embodiment, the plug member arrangement portions 45 may be recessed portions, or may be porous members arranged in a surface of the second housing 42 in the Z-axis direction.

The plurality of attaching portions 46 are portions to which attached portions 44B of the corresponding plug members 44 can be attached. The plurality of attaching portions 46 are each a column-shaped projection that projects in the Z-axis direction from the surface of the second housing 42 in the Z-axis direction. In each plug member 44, the plug body 44A and the attached portion 44B are connected to each other via a connection portion 44C. Therefore, the plug bodies 44A can be readily prevented from falling down or being lost when removing the plug bodies 44A from the liquid inlet portions 36.

Various embodiments of the tanks 9 and the ink supply apparatus 4 will now be described. Note that, in the following description, the tanks 9 and the ink supply apparatus 4 will be identified for each embodiment, and therefore, the signs of the tanks 9 and the ink supply apparatus 4 will be followed by different alphabet characters in each embodiment. As mentioned above, regarding the four tanks 9, the tank 94 and the other tanks 9 include similar configurations except that the volume is different. Embodiments of the tanks 9 will be described below, taking the tank 91 as an example. Various embodiments of the tanks 9 in the following description are also applicable to the tank 94. Therefore, detailed descriptions of the embodiments of the tank 94 will be omitted.

Embodiment 1

Figure 5:
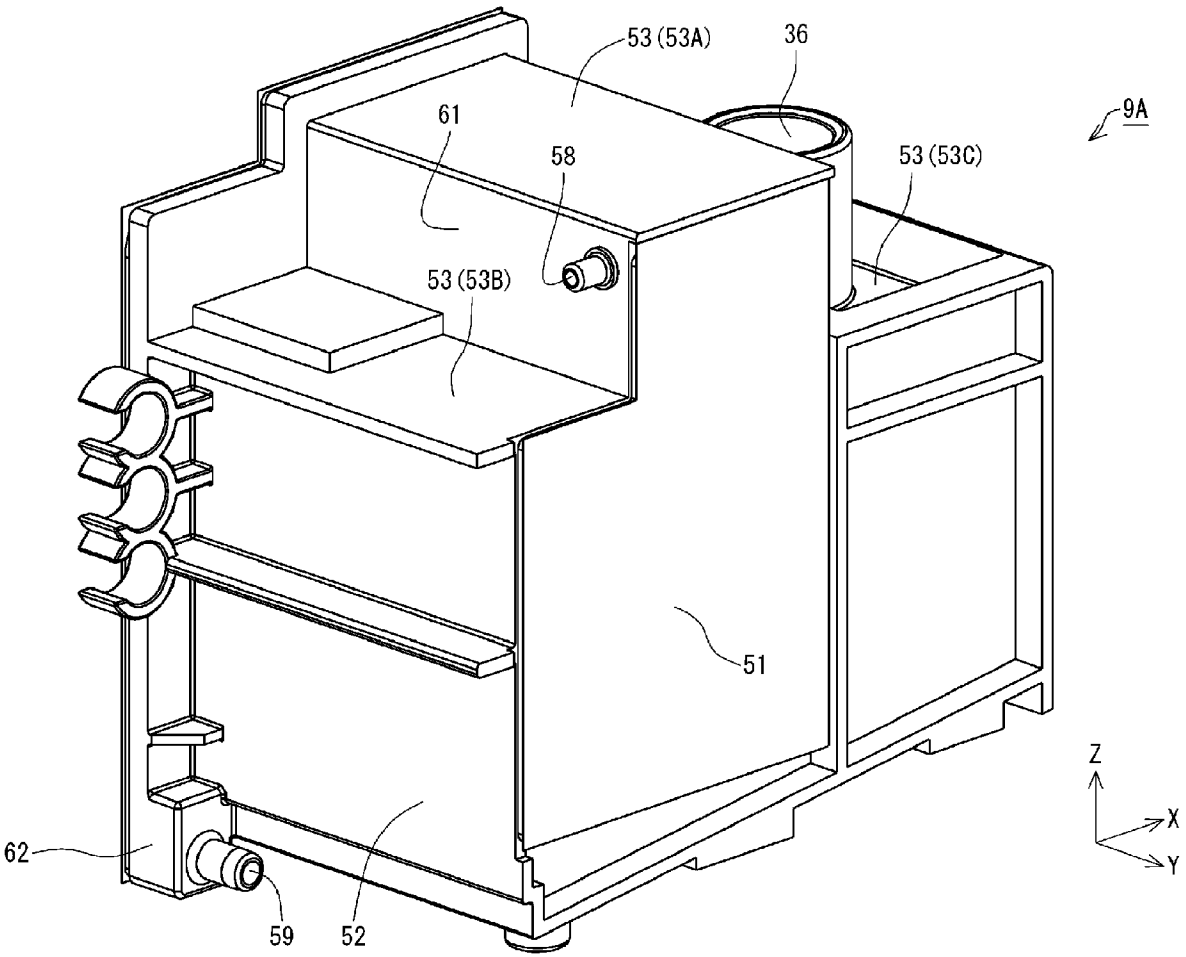
FIG. 5 is a perspective view illustrating a tank according to Embodiment 1.
Figure 6:
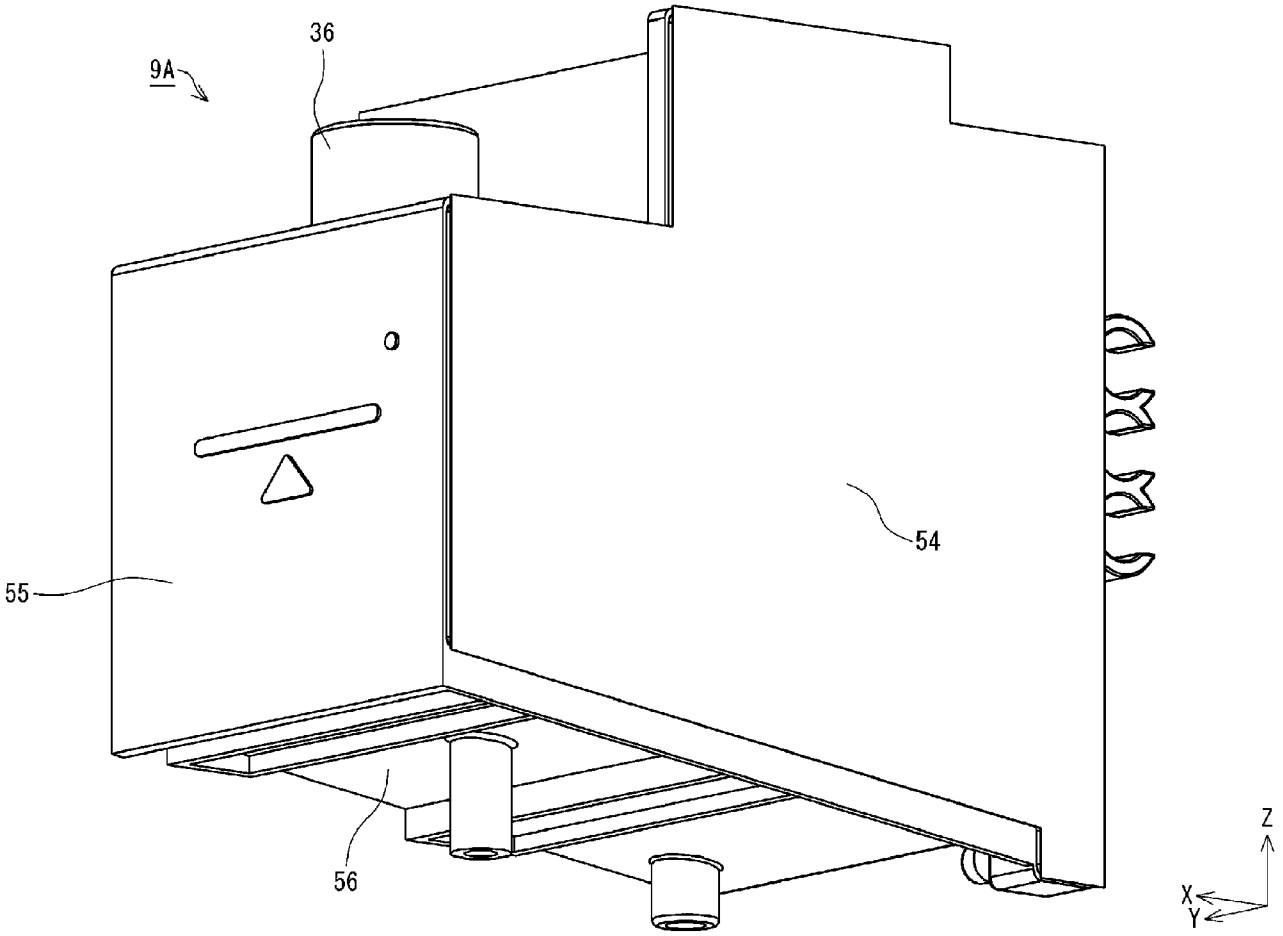
FIG. 6 is a perspective view illustrating the tank according to Embodiment 1.

A tank 9A in Embodiment 1 will be described. As illustrated in FIG. 5, the tank 9A has a front face 51, a side face 52, and an upper face 53. The front face 51, the side face 52, and the upper face 53 are faces oriented outward of the tank 9A. As illustrated in FIG. 6, the tank 9A has a back face 54, a side face 55, and a lower face 56. The back face 54, the side face 55, and the lower face 56 are faces oriented outward of the tank 9A.

As illustrated in FIG. 5, among the faces oriented outward of the tank 9A, the front face 51 is oriented in the Y-axis direction. In this embodiment, the front face 51 extends along an XZ plane. The side face 52 is oriented in the -X-axis direction. In this embodiment, the side face 52 extends along a YZ plane. The side face 52 intersects the front face 51. The upper face 53 is oriented in the Z-axis direction. In this embodiment, the upper face 53 has steps. In this embodiment, among the faces of the tank 9A that are oriented in the Z-axis direction, the face that intersects the front face 51 is the upper face 53. The upper face 53 extends along an XY plane. Note that a part of the upper face 53 also intersects the side face 52.

Note that the face extending along an XZ plane is not limited to a face extending completely parallel with an XZ plane, and also includes a face that tilts due to an error, a tolerance, or the like, excluding faces perpendicular to the XZ plane. Similarly, the face extending along a YZ plane is not limited to a face extending completely parallel with a YZ plane, and also includes a face that tilts due to an error, a tolerance, or the like, excluding faces perpendicular to the YZ plane. The face extending along an XY plane is not limited to a face extending completely parallel with an XY plane, and also includes a face that tilts due to an error, a tolerance, or the like, excluding faces perpendicular to the XY plane. The front face 51, the side face 52, the upper face 53, the back face 54, the side face 55, and the lower face 56 are not limited to flat faces, and may include recesses and projections, steps, or the like.

"Two faces intersecting each other" indicates that the two faces are in a positional relationship in which these faces are not parallel with each other. In addition to the case where two faces are in direct contact with each other, the case of a relationship in which extension of one face intersects extension of the other face in a positional relationship in which two faces are not in direct contact with each other and are separate from each other, is also considered to be "two faces intersecting each other". An angle formed by two intersecting faces may be a right angle, an obtuse angle, or an acute angle.

The upper face 53 has steps at two locations. The steps in the upper face 53 each refer to a height difference along the Z axis in the upper face 53. In the following description, when identifying, by each step, the upper face 53 including the steps at the two locations, the upper face 53 will be denoted as an upper face 53A, an upper face 53B, and an upper face 53C. The upper face 53A is located between the two steps, and is located further in the Z-axis direction than the upper face 53B and the upper 53C. When the tank 9A is viewed in a plan view in the -Z-axis direction, the upper face 53A is located between the upper face 53B and the upper face 53C.

The upper face 53B is located in the -X-axis direction relative to the upper face 53A. The upper face 53B is located further in the -X-axis direction than the upper face 53A and the upper face 53C. In other words, the upper face 53B is located further on the side face 52 side than the upper face 53A and the upper face 53C. The upper face 53C is located in the X-axis direction relative to the upper face 53A. The upper face 53C is located further in the X-axis direction than the upper face 53A and the upper face 53B. In other words, the upper face 53C is located further on the side face 55 (FIG. 6) side than the upper face 53A and the upper face 53B.

In the tank 9A, the liquid inlet portion 36 is provided in the upper face 53C. The liquid inlet portion 36 projects in the Z-axis direction from the upper face 53C. The tank 9A is also provided with an atmosphere opening portion 58 and a liquid supply portion 59. The atmosphere opening portion 58 is provided in a step face 61. The atmosphere opening portion 58 projects in the -X-axis direction from the step face 61. The step face 61 is a face that serves as a step for connecting the upper face 53A to the upper face 53B, and is oriented in the -X-axis direction. In this embodiment, the step face 61 extends along a YZ plane. The step face 61 intersects the upper face 53A, the upper face 53B, the front face 51, and the back face 54 (FIG. 6).

The liquid supply portion 59 is provided in a portion 62 that projects in the -X-axis direction from the side face 52. The liquid supply portion 59 projects in the Y-axis direction from the portion 62 that projects from the side face 52. Ink contained in the tank 9A is supplied to the ink supply tube 32 (FIG. 2) via the liquid supply portion 59.

As illustrated in FIG. 6, among the faces oriented outward of the tank 9A, the back face 54 is oriented in the -Y-axis direction . In this embodiment, the back face 54 extends along an XZ plane. The side face 55 is oriented in the X-axis direction. In this embodiment, the side face 55 extends along a YZ plane. The side face 55 intersects the front face 54. Note that, in the tank 9A, the side face 55 is set as the visual check face 33. The lower face 56 is oriented in the -Z-axis direction. In this embodiment, the lower face 56 inclines relative to an XY plane. In this embodiment, the lower face 56 inclines in a direction toward the Z-axis direction while extending in the X-axis direction. The lower face 56 intersects the back face 54.

In the tank 9A, the front face 51 (FIG. 5) and the back face 54 (FIG. 6) are oriented in opposite directions. The side face 52 also intersects the back face 54. The side face 55 also intersects the front face 51. The upper face 53 also intersects the back face 54. The lower face 56 also intersects the front face 51. Note that, in the tank 9A, the back face 54 is an exemplary first face, and the front face 51 is an exemplary second face. In the tank 9A, the front face 51 and the back face 54 are oriented outward of the tank 9A in different directions.

Figure 7:
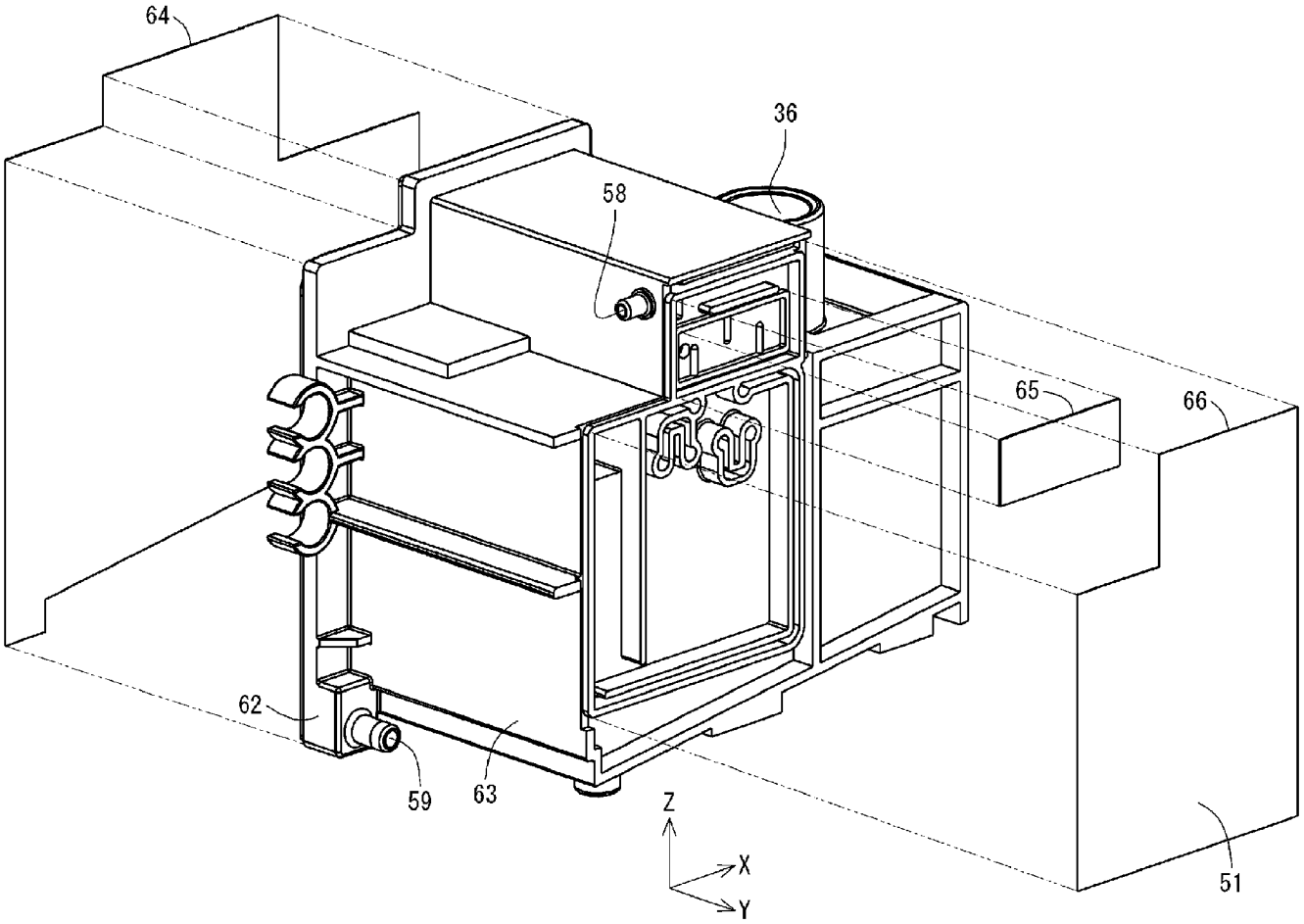
FIG. 7 is an exploded perspective view illustrating the tank according to Embodiment 1.

As illustrated in FIG. 7, the tank 9A has a case 63, which is an exemplary tank body, a sheet member 64, a waterproof air-permeable film 65, and a sheet member 66. The case 63 is made of synthetic resin such as nylon or polypropylene, for example. The sheet member 64 and the sheet member 66 are made of synthetic resin (e.g., nylon, polypropylene etc.) formed in a film shape, and are flexible. The waterproof air-permeable film 65 has a high waterproof property with respect to liquid, i.e., is made of a material having low liquid permeability and high air permeability, and is formed in a film shape. The waterproof air-permeable film 65 is an exemplary waterproof air-permeable member. Note that, in this embodiment, a face of the sheet member 66 that is oriented in the Y-axis direction corresponds to the front face 51 of the tank 9A.

Figure 8:
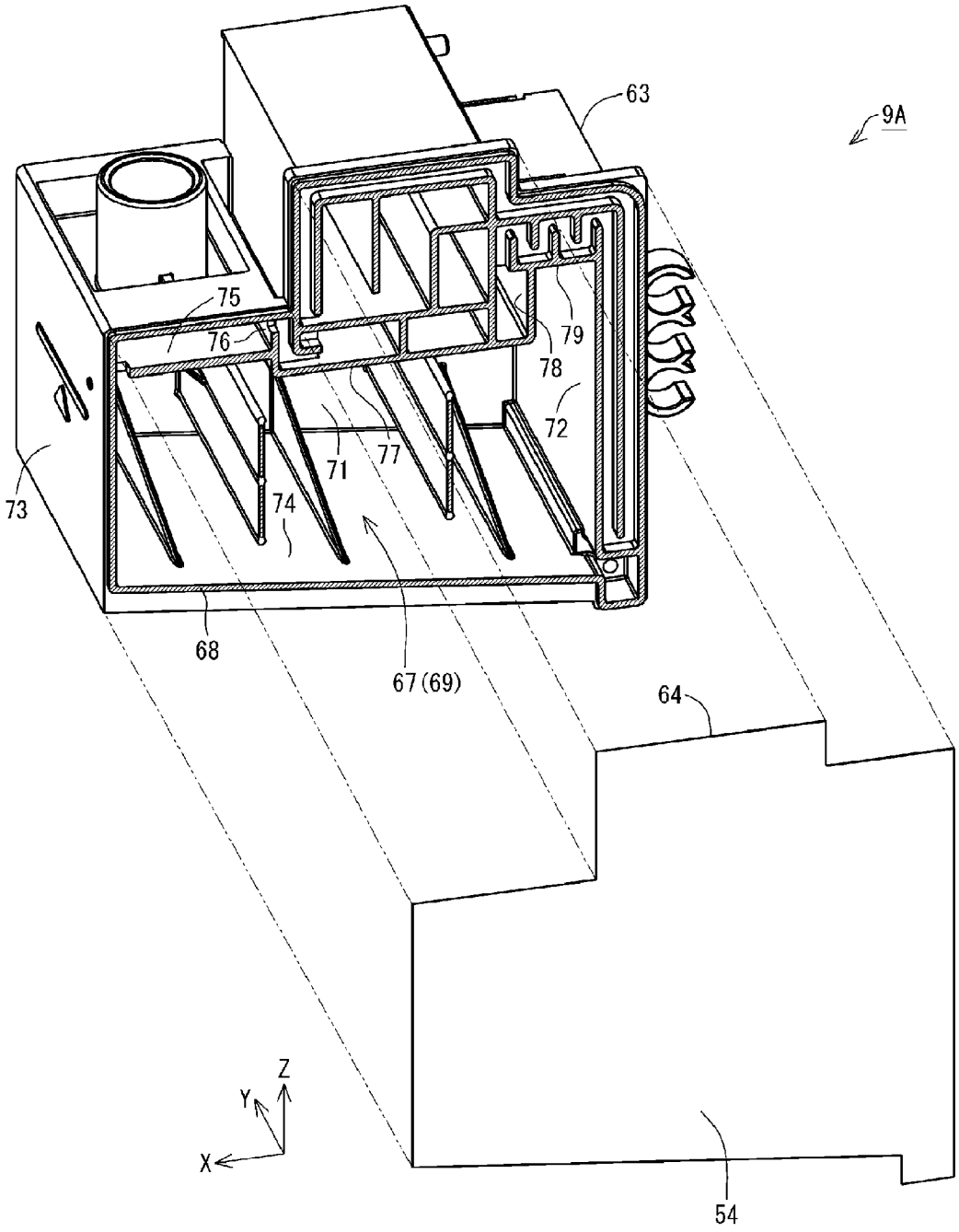
FIG. 8 is an exploded perspective view illustrating the tank according to Embodiment 1.

As illustrated in FIG. 8, a recessed portion 67 is formed in the case 63. The case 63 is provided with a joint portion 68. In FIG. 8, the joint portion 68 is hatched for the purpose of clearly illustrating the configuration of the joint portion 68. The sheet member 64 is joined to the joint portion 68. In this embodiment, the case 63 and the sheet member 64 are joined to each other by adhesion. Upon the case 63 being joined to the sheet member 64, the recessed portion 67 is blocked by the sheet member 64. The space surrounded by the recessed portion 67 and the sheet member 64 is called a liquid containing portion 69. Ink is contained in the liquid containing portion 69. Note that, in this embodiment, a face of the sheet member 64 that is oriented in the -Y-axis direction corresponds to the back face 54 of the tank 9A. Therefore, in the tank 9A, the back face 54 is provided with the liquid containing portion 69.

The case 63 has a wall 71, a wall 72, a wall 73, a wall 74, a wall 75, a wall 76, a wall 77, a wall 78, and a wall 79. The wall 71 extends along an XZ plane. Eight walls, namely the walls 72 to 79 intersect the wall 71. Eight walls, namely the walls 72 to 79 project in the -Y-axis direction from the wall 71. When the wall 71 is viewed in a plan view in the Y-axis direction, eight walls, namely the walls 72 to 79 surround the wall 71. The wall 71 and the eight walls that are the walls 72 to 79 constitute the recessed portion 67 that has the wall 71 as a bottom. Note that the walls 71 to 79 are not limited to flat walls, and may include recesses and projections, steps, or the like.

The wall 72 and the wall 73 are provided in positions that oppose each other with a gap therebetween along the X axis, and extend along a YZ plane. The wall 73 is located further in the X-axis direction than the wall 72. The wall 74 is located in the -Z-axis direction relative to the wall 72 and the wall 73, and intersects the walls 72 and 73. When the wall 71 is viewed in a plan view in the Y-axis direction, the walls 75 to 79 are located further in the Z-axis direction than the wall 74. The wall 75 is located in the X-axis direction than the walls 76 to 79, and intersects the wall 73. The wall 79 is located in the X-axis direction than the walls 75 to 78, and intersects the wall 72. The wall 76 is located in the -X-axis direction relative to the wall 75, and extends along a YZ plane. The wall 77 is located in the -X-axis direction relative to the wall 76, and extends along an XY plane. The wall 78 is located in the -X-axis direction relative to the wall 77, and extends along a YZ plane. The wall 79 is located in the -X-axis direction relative to the wall 78, and extends along an XY plane.

Figure 9:
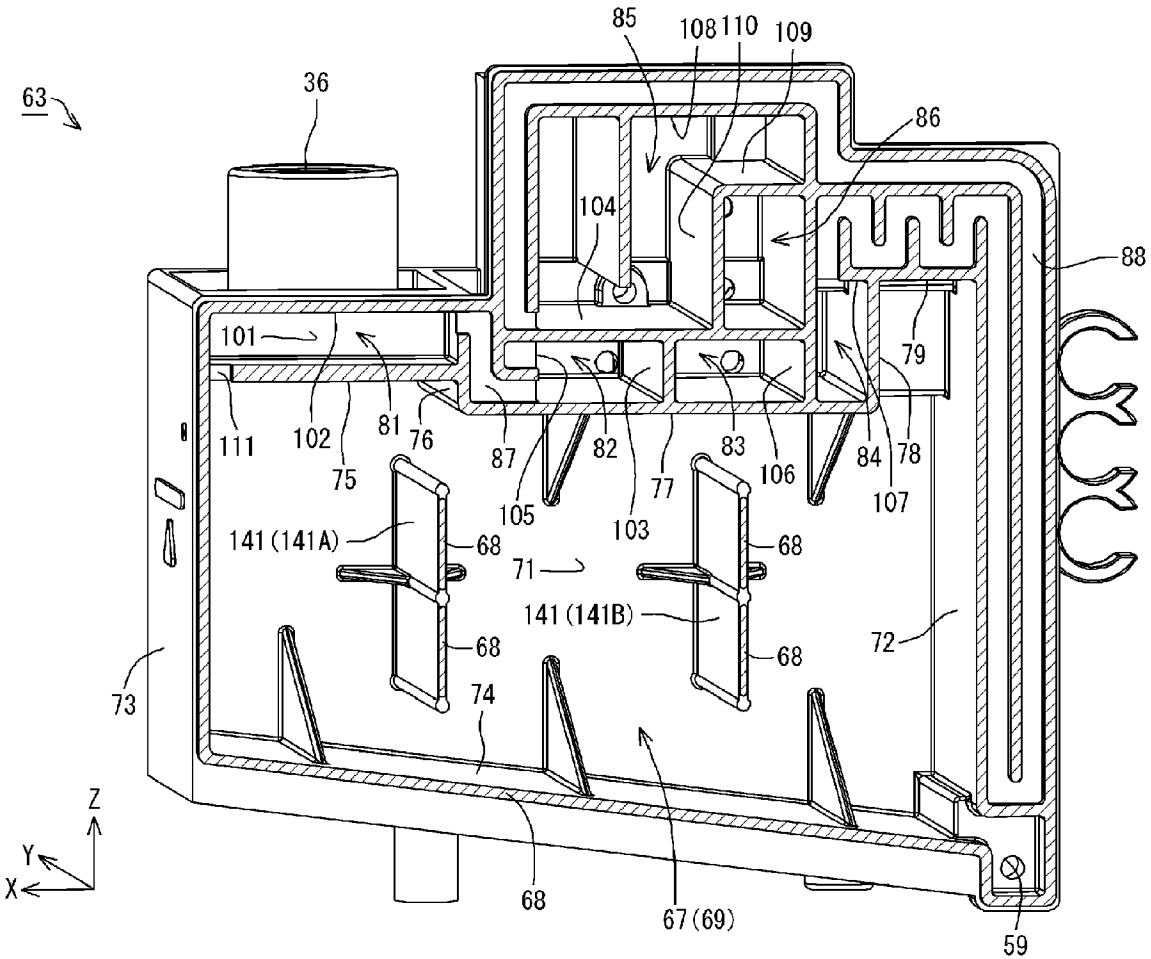
FIG. 9 is a perspective view illustrating a case according to Embodiment 1.

As illustrated in FIG. 9, in the case 63, a recessed portion 81, a recessed portion 82, a recessed portion 83, a recessed portion 84, a recessed portion 85, a recessed portion 86, a groove portion 87, and a groove portion 88 are formed. The recessed portion 81 is located in the Z-axis direction relative to the recessed portion 67. The recessed portion 81 is located in the Z-axis direction relative to the wall 75. The recessed portion 81 is partitioned by the wall 73, the wall 75, the wall 76, the wall 101, and the wall 102. The wall 101 extends along an XZ plane, and is located further in the -Y-axis direction than the wall 71. The wall 102 extends along an XY plane, and is located further in the Z-axis direction than the wall 75. The wall 73, the wall 75, the wall 76, and the wall 102 project in the -Y-axis direction from the wall 101. When the wall 101 is viewed in a plan view in the Y-axis direction, the wall 73, the wall 75, the wall 76, and the wall 102 surround the wall 101. Thus, the recessed portion 81 that has the wall 101 as a bottom is configured.

The recessed portion 82 is located in the Z-axis direction relative to the recessed portion 67. The recessed portion 82 is located in the Z-axis direction relative to the wall 77. The recessed portion 82 is partitioned by the wall 71, the wall 77, the wall 103, the wall 104, and the wall 105. Note that the wall 71 of the recessed portion 67 and the wall 71 of the recessed portion 82 are the same wall. That is to say, in this embodiment, the recessed portion 67 and the recessed portion 82 share the wall 71. The recessed portion 67 and the recessed portion 82 also share the wall 76 and the wall 77. The wall 103 extends along a YZ plane, and is located further in the -X-axis direction than the wall 76. The wall 104 extends along an XY plane, and is located further in the Z-axis direction than the wall 77. The wall 105 extends along a YZ plane, and is located further in the -X-axis direction than the wall 76 and further in the X-axis direction than the wall 103. The wall 77, the wall 103, the wall 104, and the wall 105 project in the -Y-axis direction from the wall 71. When the wall 71 is viewed in a plan view in the Y-axis direction, the wall 77, the wall 103, the wall 104, and the wall 105 surround a part of the wall 71. Thus, the recessed portion 82 that has the wall 71 as a bottom is configured.

The recessed portion 82 is located in the Z-axis direction relative to the recessed portion 67, and is located in the -X-axis direction relative to the recessed portion 82. The recessed portion 83 is located in the Z-axis direction relative to the wall 77. The recessed portion 83 is partitioned by the wall 71, the wall 77, the wall 103, the wall 104, and the wall 106. Note that the recessed portion 67 and the recessed portion 83 also share the wall 71 and the wall 77. The recessed portion 82 and the recessed portion 83 share the wall 103 and the wall 104. The wall 106 extends along a YZ plane, and is located further in the -X-axis direction than the wall 103. The wall 77, the wall 103, the wall 104, and the wall 106 project in the -Y-axis direction from the wall 71. When the wall 71 is viewed in a plan view in the Y-axis direction, the wall 77, the wall 103, the wall 104, and the wall 106 surround a part of the wall 71. Thus, the recessed portion 83 that has the wall 71 as a bottom is configured.

The recessed portion 84 is located in the Z-axis direction relative to the recessed portion 67, and is located in the -X-axis direction relative to the recessed portion 83. The recessed portion 84 is located in the Z-axis direction relative to the wall 77. The recessed portion 84 is partitioned by the wall 71, the wall 77, the wall 78, the wall 106, and the wall 107. Note that the recessed portion 67 and the recessed portion 84 share the wall 71, the wall 77, and the wall 78. The recessed portion 83 and the recessed portion 84 share the wall 106. The wall 107 extends along an XY plane, and is located further in the Z-axis direction than the wall 77. The wall 77, the wall 78, the wall 106, and the wall 107 project in the -Y-axis direction from the wall 71. When the wall 71 is viewed in a plan view in the Y-axis direction, the wall 77, the wall 78, the wall 106, and the wall 107 surround a part of the wall 71. Thus, the recessed portion 84 that has the wall 71 as a bottom is configured.

The recessed portion 85 is located in the Z-axis direction relative to the recessed portion 82. The recessed portion 85 is located in the Z-axis direction relative to the wall 104. The recessed portion 85 is partitioned by the wall 71, the wall 104, the wall 105, the wall 106, the wall 108, the wall 109, and the wall 110. Note that the recessed portion 82 and the recessed portion 85 share the walls 104 and 105. The recessed portion 83 and the recessed portion 85 share the wall 106. The wall 108 extends along an XY plane, and is located further in the Z-axis direction than the wall 104. The wall 109 extends along an XY plane, and is located further in the Z-axis direction than the wall 104 and further in the -Z-axis direction relative to the wall 108. The wall 110 extends along a YZ plane, and is located further in the -X-axis direction than the wall 105 and further in the X-axis direction than the wall 106. The wall 104, the wall 105, the wall 106, the wall 108, the wall 109, and the wall 110 project in the -Y-axis direction from the wall 71. When the wall 71 is viewed in a plan view in the Y-axis direction, the wall 104, the wall 105, the wall 106, the wall 108, the wall 109, and the wall 110 surround a part of the wall 71. Thus, the recessed portion 85 that has the wall 71 as a bottom is configured.

The recessed portion 86 is located in the Z-axis direction relative to the recessed portion 83. The recessed portion 86 is located in the Z-axis direction relative to the wall 104. The recessed portion 86 is partitioned by the wall 71, the wall 104, the wall 106, the wall 109, and the wall 110. Note that the recessed portion 85 and the recessed portion 86 also share the wall 104, the wall 106, the wall 109, and the wall 110. The recessed portion 86 can also be regarded as being partitioned from the recessed portion 85 by the wall 109 and the wall 110. When the wall 71 is viewed in a plan view in the Y-axis direction, the wall 104, the wall 106, the wall 109, and the wall 110 surround a part of the wall 71. Thus, the recessed portion 86 that has the wall 71 as a bottom is configured.

The groove portion 87 is formed between the wall 76 and the wall 105 when the wall 71 is viewed in a plan view in the Y-axis direction. The groove portion 87 is formed between the recessed portion 81 and the recessed portion 82. The recessed portion 81 and the recessed portion 82 are connected to each other via the groove portion 87. The groove portion 88 extends from a starting point that is a position on the wall 104 in the Z-axis direction in a location where the wall 104 and the wall 105 intersect each other, is routed in the clockwise direction around the outside of the recessed portion 85 when the wall 71 is viewed in a plan view in the -Y-axis direction, turns and meanders while passing through a position on the wall 72 in the -X-axis direction, and reaches the recessed portion 84. Note that the recessed portion 67 and the recessed portion 81 are connected to each other via a cutout portion 111 formed in the wall 75.

The recessed portion 67, the recessed portions 81 to 86, the groove portion 87 and the groove portion 88, and the cutout portion 111 are formed in a direction of being recessed from the -Y-axis direction to the Y-axis direction.

The recessed portion 67, the recessed portions 81 to 86, the groove portion 87 and the groove portion 88, and the cutout portion 111 are surrounded by the joint portion 68 when the wall 71 is viewed in a plan view in the Y-axis direction. Note that, as mentioned above, in the tank 9A, a face of the sheet member 64 (FIG. 8) that is oriented in the -Y-axis direction corresponds to the back face 54 of the tank 9A. Therefore, in the tank 9A, the recessed portion 67, the recessed portions 81 to 86, the groove portion 87 and the groove portion 88, and the cutout portion 111 are provided in the back face 54.

Note that the sheet member 64 (FIG. 8) has a size and a shape that allow the sheet member 64 to cover the joint portion 68 which surrounds the recessed portion 67, the recessed portions 81 to 86, the groove portion 87 and the groove portion 88, and the cutout portion 111 when the tank 9A is viewed in a plan view in the Y-axis direction. Therefore, upon joining the sheet member 64 to the joint portion 68 of the case 63, the recessed portion 67, the recessed portions 81 to 86, the groove portion 87 and the groove portion 88, and the cutout portion 111 are blocked by the sheet member 64. Thus, the recessed portion 67 and the recessed portions 81 to 86 are made as chambers that are partitioned from one another.

Note that a face of the wall 72 of the case 63 illustrated in FIG. 9 in the -X-axis direction, i.e., a face of the wall 72 on the side opposite to the recessed portion 67 side corresponds to the side face 52 of the tank 9A illustrated in FIG. 5. A face of the wall 73 illustrated in FIG. 9 in the X-axis direction, i.e., a face of the wall 73 on the side opposite to the recessed portion 67 side corresponds to the side face 55 illustrated in FIG. 6. A face of the wall 74 illustrated in FIG. 9 in the -Z-axis direction, i.e., a face of the wall 74 on the side opposite to the recessed portion 67 side corresponds to the lower face 56 illustrated in FIG. 6. A face of the wall 75 illustrated in FIG. 9 in the Z-axis direction, i.e., a face of the wall 75 on the side opposite to the recessed portion 67 side corresponds to the upper face 53C illustrated in FIG. 5. A face of the wall 108 illustrated in FIG. 9 in the Z-axis direction, i.e., a face of the wall 108 on the side opposite to the recessed portion 85 side corresponds to the upper face 53A illustrated in FIG. 5. A face of the wall 79 illustrated in FIG. 9 in the Z-axis direction, i.e., a face of the wall 79 on the side opposite to the recessed portion 67 side corresponds to the upper face 53B illustrated in FIG. 5.

Figure 10:
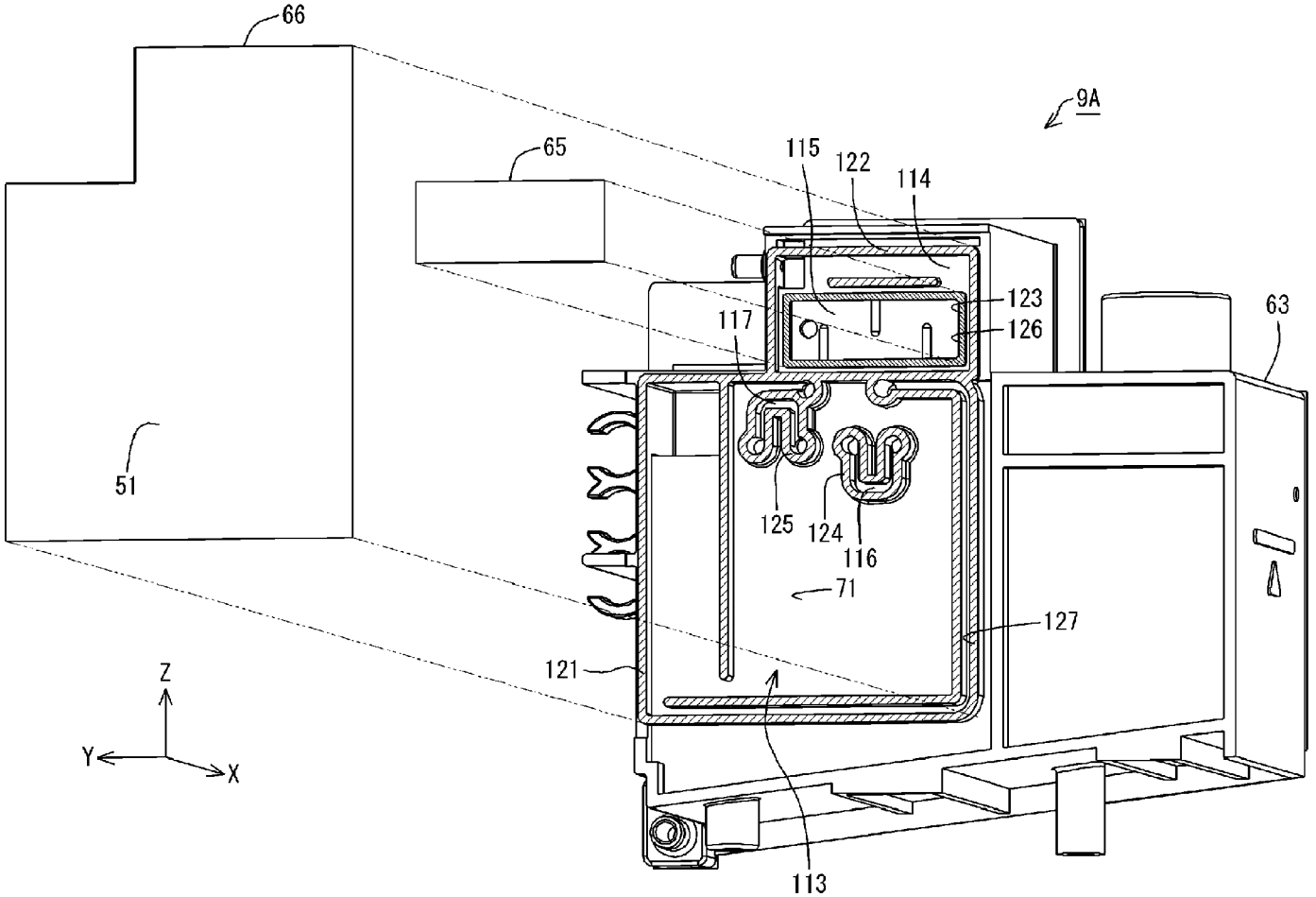
FIG. 10 is an exploded perspective view illustrating the tank according to Embodiment 1.

In the case 63, a recessed portion 113, a recessed portion 114, a recessed portion 115, a recessed portion 116, and a recessed portion 117 are formed, as illustrated in FIG. 10. Furthermore, the case 63 has a partition wall 121, a partition wall 122, a partition wall 123, a partition wall 124, and a partition wall 125. The recessed portions 113 to 117 are located on the side opposite to the recessed portion 67 (FIG. 9) side with the wall 71 therebetween. That is to say, the recessed portions 113 to 117 are located in the Y-axis direction relative to the recessed portion 67 (FIG. 9) with the wall 71 therebetween. Note that the wall 71 of the recessed portion 67 and the wall 71 of the recessed portions 113 to 117 are the same wall. That is to say, in this embodiment, the recessed portion 67 and the recessed portions 113 to 117 share the wall 71.

The recessed portion 113 is partitioned by the wall 71 and the partition wall 121. The partition wall 121 is provided in a face of the wall 71 that is oriented in the Y-axis direction. The partition wall 121 projects in the Y-axis direction from the wall 71. When the wall 71 is viewed in a plan view in the -Y-axis direction, the region surrounded by the partition wall 121 is the region of the recessed portion 113. The recessed portion 113 that has the wall 71 as a bottom is included by the wall 71 and the partition wall 121 that surrounds the wall 71.

The recessed portion 114 is located in the Z-axis direction relative to the recessed portion 113. The recessed portion 114 is partitioned by the wall 71 and the partition wall 122. The partition wall 122 is provided in a face of the wall 71 that is oriented in the Y-axis direction. The partition wall 122 projects in the Y-axis direction from the wall 71. When the wall 71 is viewed in a plan view in the -Y-axis direction, the region surrounded by the partition wall 122 is the region of the recessed portion 114. The recessed portion 114 that has the wall 71 as a bottom is included by the wall 71 and the partition wall 122 that surrounds the wall 71. Note that, in this embodiment, a part of the partition wall 121 and a part of the partition wall 122 overlap each other. Therefore, it may also be assumed that the recessed portion 113 and the recessed portion 114 share a part of the partition wall 121 and a part of the partition wall 122.

The recessed portion 115 is formed within the recessed portion 114. The recessed portion 115 is provided within the recessed portion 114, independently of the recessed portion 114. That is to say, the recessed portion 115 is provided in an island-like shape within the recessed portion 114. The recessed portion 115 is partitioned by the wall 71 and the partition wall 123. The partition wall 123 is provided in a face of the wall 71 that is oriented in the Y-axis direction. The partition wall 123 projects in the Y-axis direction from the wall 71. The amount of projection of the partition wall 123 from the wall 71 is smaller than the amount of projection of the partition wall 122 from the wall 71. When the wall 71 is viewed in a plan view in the -Y-axis direction, the region surrounded by the partition wall 123 is the region of the recessed portion 115. The recessed portion 115 that has the wall 71 as a bottom is included by the wall 71 and the partition wall 123 that surrounds the wall 71.

The recessed portion 116 and the recessed portion 117 are formed within the recessed portion 113. The recessed portion 116 and the recessed portion 117 are provided within the recessed portion 113, independently of the recessed portion 113. That is to say, the recessed portion 116 and the recessed portion 117 are provided in an island-like shape in the recessed portion 113. The recessed portion 116 is partitioned by the wall 71 and the partition wall 124. The recessed portion 117 is partitioned by the wall 71 and the partition wall 125.

The partition wall 124 and the partition wall 125 are provided in a face of the wall 71 that is oriented in the Y-axis direction. The partition wall 124 and the partition wall 125 project in the Y-axis direction from the wall 71. When the wall 71 is viewed in a plan view in the -Y-axis direction, the region surrounded by the partition wall 124 is the region of the recessed portion 116. Similarly, the region surrounded by the partition wall 125 is the region of the recessed portion 117. The recessed portion 116 that has the wall 71 as a bottom is included by the wall 71 and the partition wall 124 which surrounds the wall 71, and the recessed portion 117 that has the wall 71 as a bottom is included by the wall 71 and the partition wall 125 which surrounds the wall 71.

An end of the partition wall 123 in the Y-axis direction which partitions the recessed portion 115 is set as a joint portion 126. In FIG. 10, the joint portion 126 is hatched for the purpose of clearly illustrating the configuration of the joint portion 126. The waterproof air-permeable film 65 is joined to the joint portion 126. The waterproof air-permeable film 65 has a size and a shape that allow the waterproof air-permeable film 65 to cover the recessed portion 115 and the joint portion 126 when the wall 71 is viewed in a plan view in the -Y-axis direction. Therefore, upon joining the waterproof air-permeable film 65 to the joint portion 126, the recessed portion 115 is blocked by the waterproof air-permeable film 65. Thus, the recessed portion 115 becomes a chamber partitioned from the recessed portion 114 by the waterproof air-permeable film 65.

Ends of the partition wall 121, the partition wall 122, the partition wall 124, and the partition wall 125 in the Y-axis direction are set as the joint portion 127. In FIG. 10, the joint portion 127 is hatched for the purpose of clearly illustrating the configuration of the joint portion 127. The sheet member 66 is joined to the joint portion 127. In this embodiment, the case 63 and the sheet member 66 are joined to each other by adhesion. The sheet member 66 has a size and a shape that allow the sheet member 66 to cover the recessed portion 113, the recessed portion 114, and the joint portion 127 when the wall 71 is viewed in a plan view in the -Y-axis direction. Therefore, upon the sheet member 66 being joined to the case 63, the recessed portion 113, the recessed portion 114, the recessed portion 116, and the recessed portion 117 are blocked by the sheet member 66. Thus, the recessed portion 113, the recessed portion 114, the recessed portion 116, and the recessed portion 117 are made as chambers that are partitioned from one another. Note that since the amount of projection of the partition wall 123 from the wall 71 is smaller than the amount of projection of the partition wall 122 from the wall 71, a gap is provided in the Z-axis direction between the waterproof air-permeable film 65 and the sheet member 66.

Note that, in the tank 9A, a face of the sheet member 66 that is oriented in the Y-axis direction corresponds to the front face 51 of the tank 9A, as mentioned above. Therefore, in the tank 9A, the recessed portion 113, the recessed portion 114, the recessed portion 116, and the recessed portion 117 are provided in the front face 51. Note that the atmosphere opening portion 58 (FIG. 7) is in communication with the inside of the recessed portion 114. As illustrated in FIG. 9, the liquid supply portion 59 is in communication with the inside of the recessed portion 67.

Figure 11:
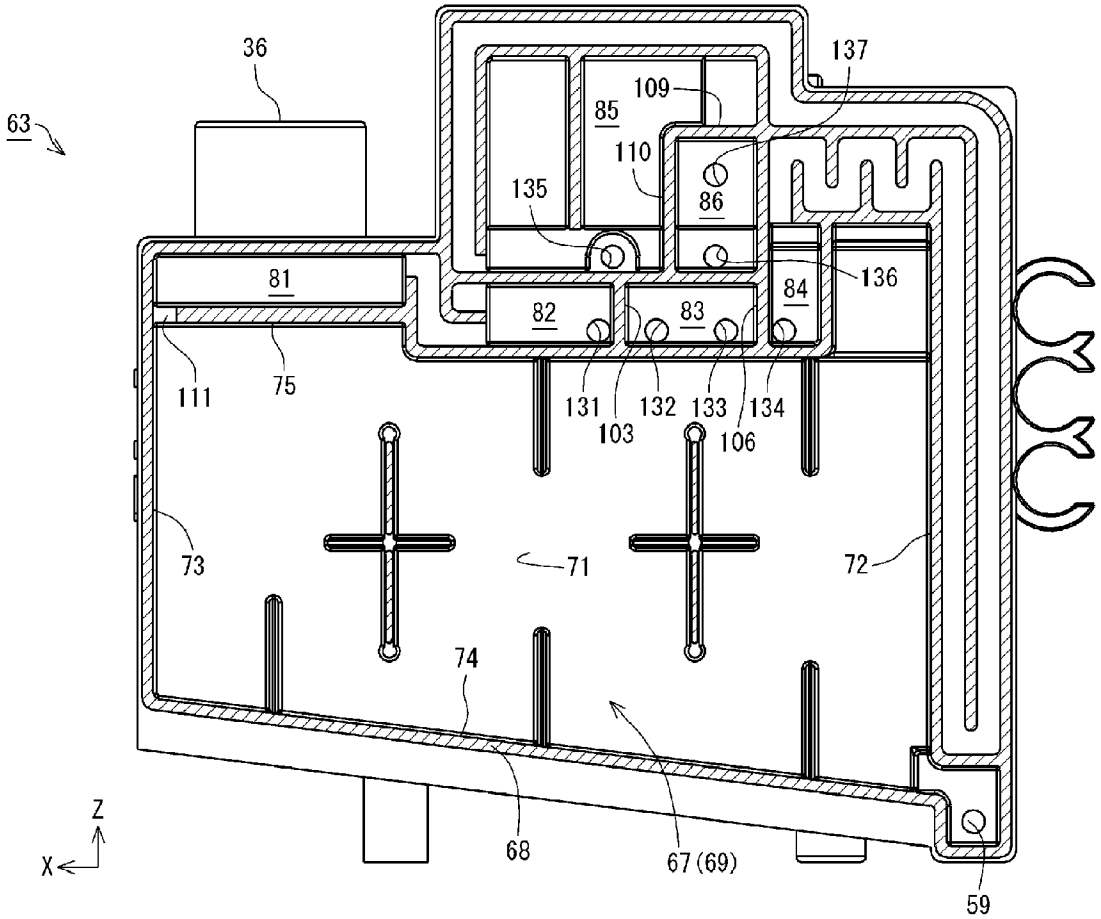
FIG. 11 is a diagram of the case according to Embodiment 1 as viewed from the back face side of the tank.

As illustrated in FIG. 11, the case 63 is provided with a communicating portion 131 in the wall 71 within the recessed portion 82. Also, the communicating portion 132 and the communicating portion 133 are provided in the wall 71 within the recessed portion 83. A communicating portion 134 is provided in the wall 71 within the recessed portion 84. A communicating portion 135 is provided in the wall 71 within the recessed portion 85. A communicating portion 136 and a communicating portion 137 are provided in the wall 71 within the recessed portion 86. In this embodiment, the communicating portions 131 to 137 are provided as through holes formed in the wall 71.

Figure 12:
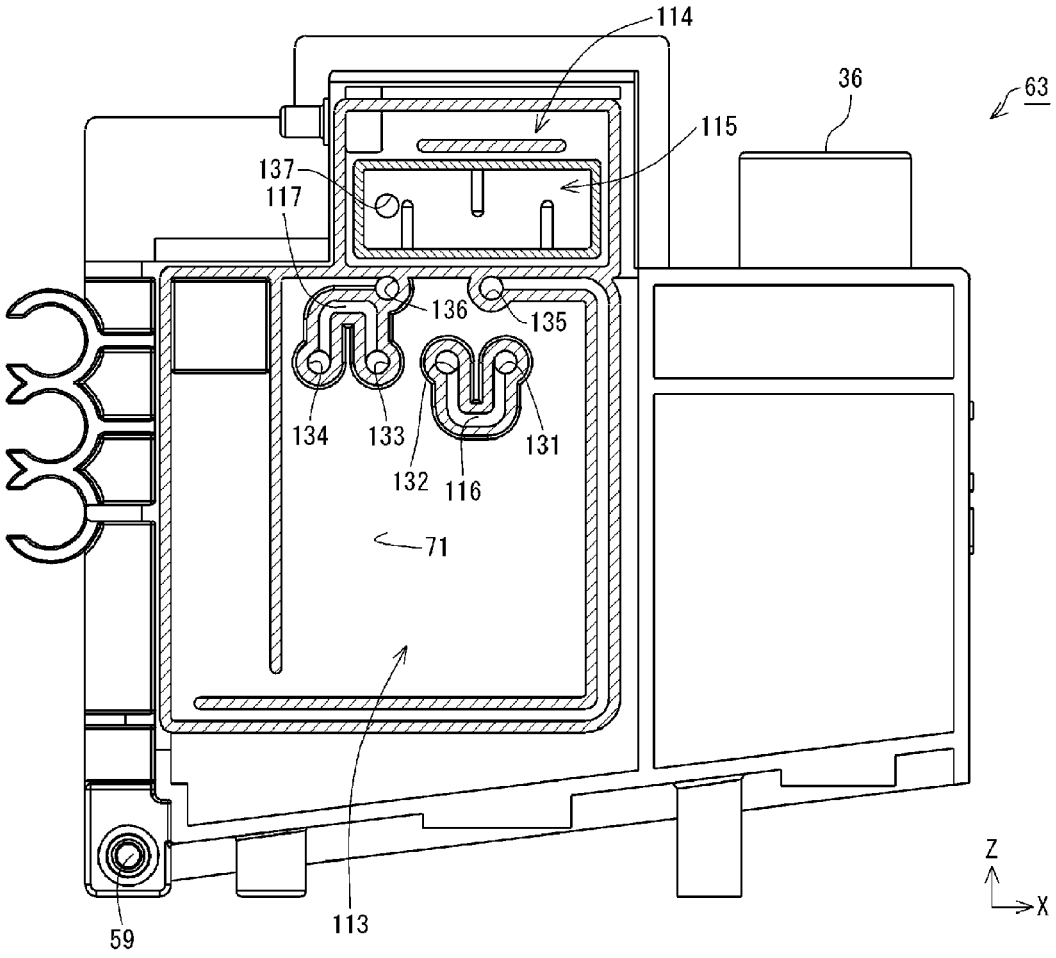
FIG. 12 is a diagram of the case according to Embodiment 1 as viewed from the front face side of the tank.

As illustrated in FIG. 12, the communicating portion 131 and the communicating portion 132 are in communication with the inside of the recessed portion 116. Therefore, the recessed portion 116 is in communication with the communicating portion 131 and the communicating portion 132. Accordingly, the recessed portion 82 and the recessed portion 83 are partitioned by the wall 103 as illustrated in FIG. 11, but are connected to each other through the communicating portion 131, the recessed portion 116 (FIG. 12), and the communicating portion 132. That is to say, the recessed portion 82 and the recessed portion 83 are in communication with each other via the recessed portion 116.

As illustrated in FIG. 12, the communicating portion 133 and the communicating portion 134 are in communication with the inside of the recessed portion 117. Therefore, the recessed portion 117 is in communication with the communicating portion 133 and the communicating portion 134. Accordingly, the recessed portion 83 and the recessed portion 84 are partitioned by the wall 106 as illustrated in FIG. 11, but are connected to with each other through the communicating portion 133, the recessed portion 117 (FIG. 12), and the communicating portion 134. That is to say, the recessed portion 83 and the recessed portion 84 are in communication with each other via the recessed portion 117.

As illustrated in FIG. 12, the communicating portion 135 and the communicating portion 136 are in communication with the inside of the recessed portion 113. Therefore, the recessed portion 113 is in communication with the communicating portion 135 and the communicating portion 136. Accordingly, the recessed portion 85 and the recessed portion 86 are partitioned by the wall 110 and the wall 109 as illustrated in FIG. 11, but are connected to each other through the communicating portion 135, the recessed portion 113 (FIG. 12), and the communicating portion 136. That is to say, the recessed portion 85 and the recessed portion 86 are in communication with each other via the recessed portion 113. Also, as illustrated in FIG. 12, the communicating portion 137 is in communication with the inside of the recessed portion 115. Therefore, the recessed portion 115 is in communication with the inside of the communicating portion 86 (FIG. 11) via the communicating portion 137.

Figure 13:
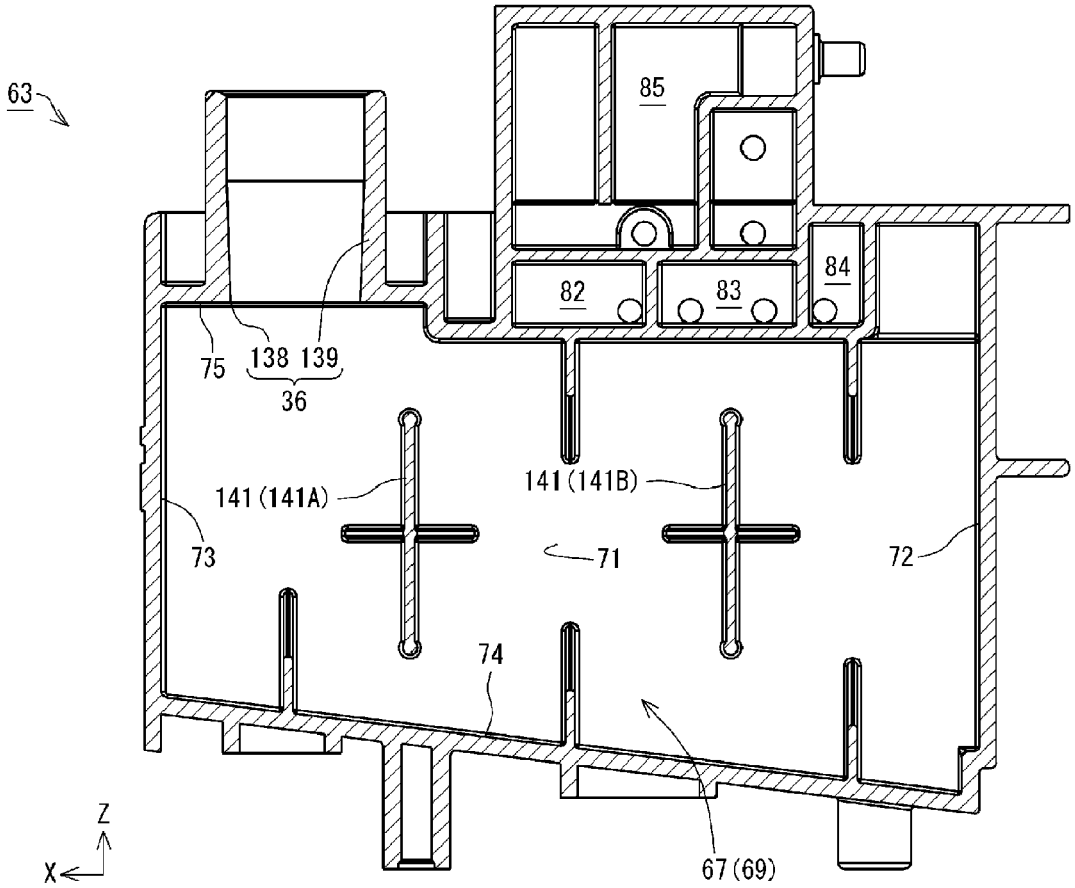
FIG. 13 is a cross-sectional view illustrating the tank according to Embodiment 1.

Here, the liquid inlet portion 36 is in communication with the inside of the recessed portion 67, as illustrated in FIG. 13, which is a cross-sectional view of the case 63. Note that FIG. 13 illustrated a cross-section of the case 63 taken along an XZ plane that passes through the liquid inlet portion 36. The liquid inlet portion 36 has a liquid inlet port 138 and a side wall 139. The liquid inlet port 138 is an opening of a through hole provided in the wall 75, and is open toward the recessed portion 67 side. The liquid inlet port 138 is also an intersecting portion at which the liquid inlet portion 36 and the recessed portion 67 (liquid containing portion 69) intersect each other.

The recessed portion 67 is in communication with the outside of the recessed portion 67 via the liquid inlet port 138 that is a through hole. The side wall 139 is provided in the wall 75 in the Z-axis direction, surrounds the periphery of the liquid inlet port 138, and forms an ink injection path. The side wall 139 projects in the Z-axis direction from the wall 75. Note that the liquid inlet portion 36 may employ a configuration in which the side wall 139 projects inward of the recessed portion 67. In the configuration in which the side wall 139 projects inward of the recessed portion 67 as well, the intersecting portion where the liquid inlet portion 36 and the recessed portion 67 intersect each other is defined as the liquid inlet port 138.

Here, the cutout portion 111 is formed in the wall 75, as illustrated in FIG. 11. An opening of the cutout portion 111 that is open toward the recessed portion 67 corresponds to a later-described connecting port between a later-described atmosphere communicating portion and the liquid containing portion 69. As illustrated in FIG. 13, the liquid inlet port 138 is also formed in the wall 75, and is open toward the recessed portion 67 side of the wall 75. Thus, in this embodiment, the cutout portion 111 and the liquid inlet port 138 are formed in the wall 75. Accordingly, in this embodiment, the opening (connecting port) of the cutout portion 111 that is open toward the recessed portion 67 and the liquid inlet port 138 are located in the same position in the vertical direction.

Figure 14:
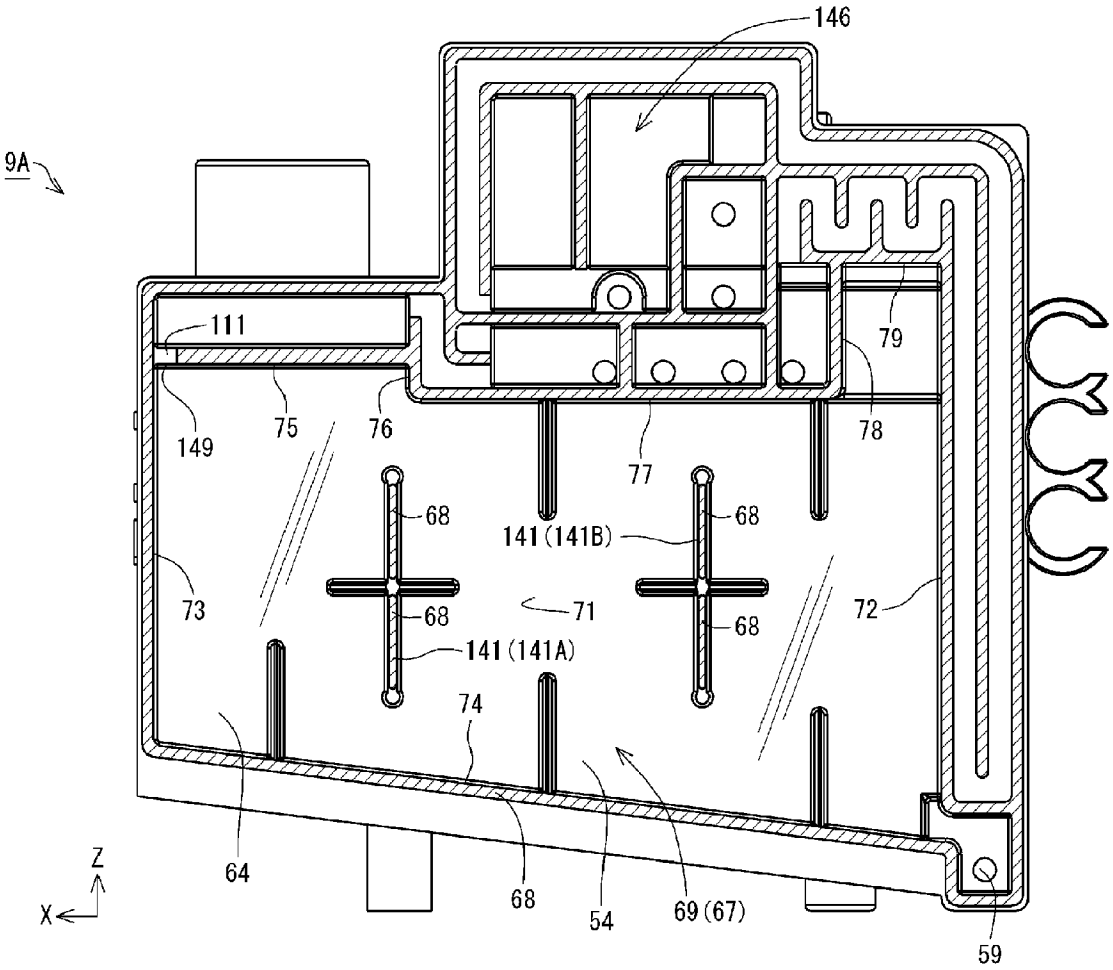
FIG. 14 is a diagram of the tank according to Embodiment 1 as viewed from the back face side.

Upon the sheet member 64 being joined to the case 63 having the above-described configuration, the liquid containing portion 69 and a part of an atmosphere communicating portion 146 are configured in the back face 54 of the tank 9A, as illustrated in FIG. 14. The liquid containing portion 69 is a region surrounded by the recessed portion 67 of the case 63 and the sheet member 64. A part of the atmosphere communicating portion 146 configured in the back face 54 of the tank 9A is a region surrounded by the recessed portions 81 to 86, the groove portion 87 and the groove portion 88, and the cutout portion 111 that are illustrated in FIG. 9, as well as the sheet member 64 (FIG. 8).

Here, as illustrated in FIG. 14, a plurality of support portions 141 are provided in the liquid containing portion 69. In this embodiment, two support portions 141 are provided. In the following description, when individually identifying the two support portions 141, the two support portions 141 are denoted respectively as a support portion 141A and a support portion 141 B. The two support portions 141 are arranged in a line along the X axis. Of the two support portions 141, the support portion 141A is located further in the -X-axis direction than the wall 73. Of the two support portions 141, the support portion 141B is located further in the -X-axis direction than the support portion 141A.

The two support portions 141 are provided in the wall 71. As illustrated in FIG. 9, the two support portions 141 project in the -Y-axis direction from the wall 71. The two support portions 141 are separate from the wall 72, the wall 73, the wall 74 the wall 75, the wall 76, the wall 77, the wall 78, and the wall 79. The two support portions 141 each include an appearance of a plate shape extending along a YZ plane. The amount of projection of the two support portions 141 from the wall 71 is set to be equal to the amount of projection of the walls 72 to 79 from the wall 71. The joint portions 68 are provided at ends of the two support portions 141 on the side opposite to the wall 71 side, i.e., ends thereof in the -Y-axis direction. That is to say, in the tank 9A illustrated in FIG. 14, the sheet member 64 is also joined to the joint portion 68 of the two support portions 141.

In this embodiment, an interval between the wall 73 and the support portion 141A along the X axis, an interval between the support portion 141A and the support portion 141B along the X axis, and an interval between the wall 72 and the support portion 141B along the X axis are set to be equal to one another. With this configuration, deformation of the sheet member 64 can be equally restricted between the wall 73 and the support portion 141A, between the support portion 141A and the support portion 141B, and between the wall 72 and the support portion 141B. Note that, in the configuration in which a single support portion 141 is provided, an interval between the wall 73 and the support portion 141 and an interval between the wall 72 and the support portion 141 are set to be equal to each other. Thus, deformation of the sheet member 64 can be equally restricted between the wall 73 and the support portion 141 and between the wall 72 and the support portion 141.

Figure 15:
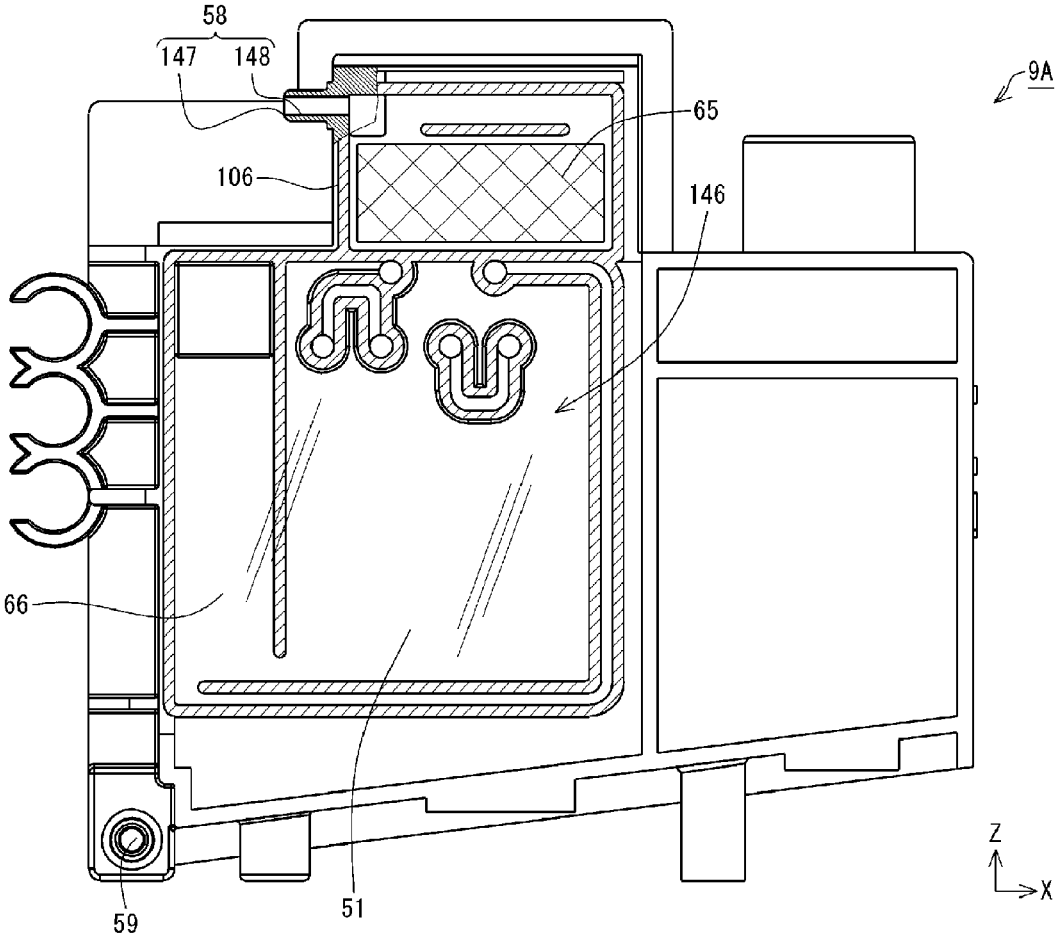
FIG. 15 is a diagram of the tank according to Embodiment 1 as viewed from the front face side.

Upon the waterproof air-permeable film 65 (FIG. 10) and the sheet member 66 being joined to the case 63, a part of the atmosphere communicating portion 146 is configured in the front face 51 of the tank 9A, as illustrated in FIG. 15. The part of the atmosphere communicating portion 146 configured in the front face 51 of the tank 9A is a region surrounded by the recessed portion 113, the recessed portion 114, the recessed portion 116, and the recessed portion 117, and the sheet member 66 (FIG. 10). The part of the atmosphere communicating portion 146 configured in the front face 51 of the tank 9A also includes a region surrounded by the recessed portion 115 (FIG. 10) and the waterproof air-permeable film 65.

The atmosphere communicating portion 146 also includes the atmosphere opening portion 58. As illustrated in FIG. 15, the atmosphere opening portion 58 includes an atmosphere opening port 147 and an introduction path 148. The atmosphere opening port 147 is formed in the atmosphere opening portion 58 as appropriate as an opening that is open outward of the tank 9A. The introduction path 148 constitutes a flow path of the atmosphere that is introduced into the tank 9A from the atmosphere opening port 147 that is open outward of the tank 9A.

The introduction path 148 projects in the -X-axis direction from the wall 106. The introduction path 148 includes a portion formed due to the thickness of the wall 106 and a portion projecting in the -X-axis direction from the wall 106. Therefore, the flow path length of the introduction path 148 is equal to a length obtained by adding the length of the portion projecting in the -X-axis direction from the wall 106 and the thickness dimension of the wall 106. Note that a configuration in which a portion of the introduction path 148 that projects in the -X-axis direction is omitted may also be employed. In the tank 9A in which the portion of the introduction path 148 that projects in the -X-axis direction is omitted, the flow path length of the introduction path 148 is equal to the thickness dimension of the wall 106.

As a result, in the tank 9A, the atmosphere communicating portion 146 that extends from the atmosphere opening port 147 (FIG. 15) to a connection port 149 between the cutout portion 111 and the liquid containing portion 69 formed in the wall 75 illustrated in FIG. 14 is configured. Thus, the tank 9A is configured to be able to introduce the atmosphere into the liquid containing portion 69 from the atmosphere communicating portion 146. That is to say, the atmosphere communicating portion 146 is in communication with the liquid containing portion 69. Accordingly, in the tank 9A, a flow path that extends from the atmosphere opening port 147 and is continuous with the liquid supply portion 59 via the liquid containing portion 69 is configured. A part of this flow path includes the atmosphere communicating portion 146.

Figure 16:
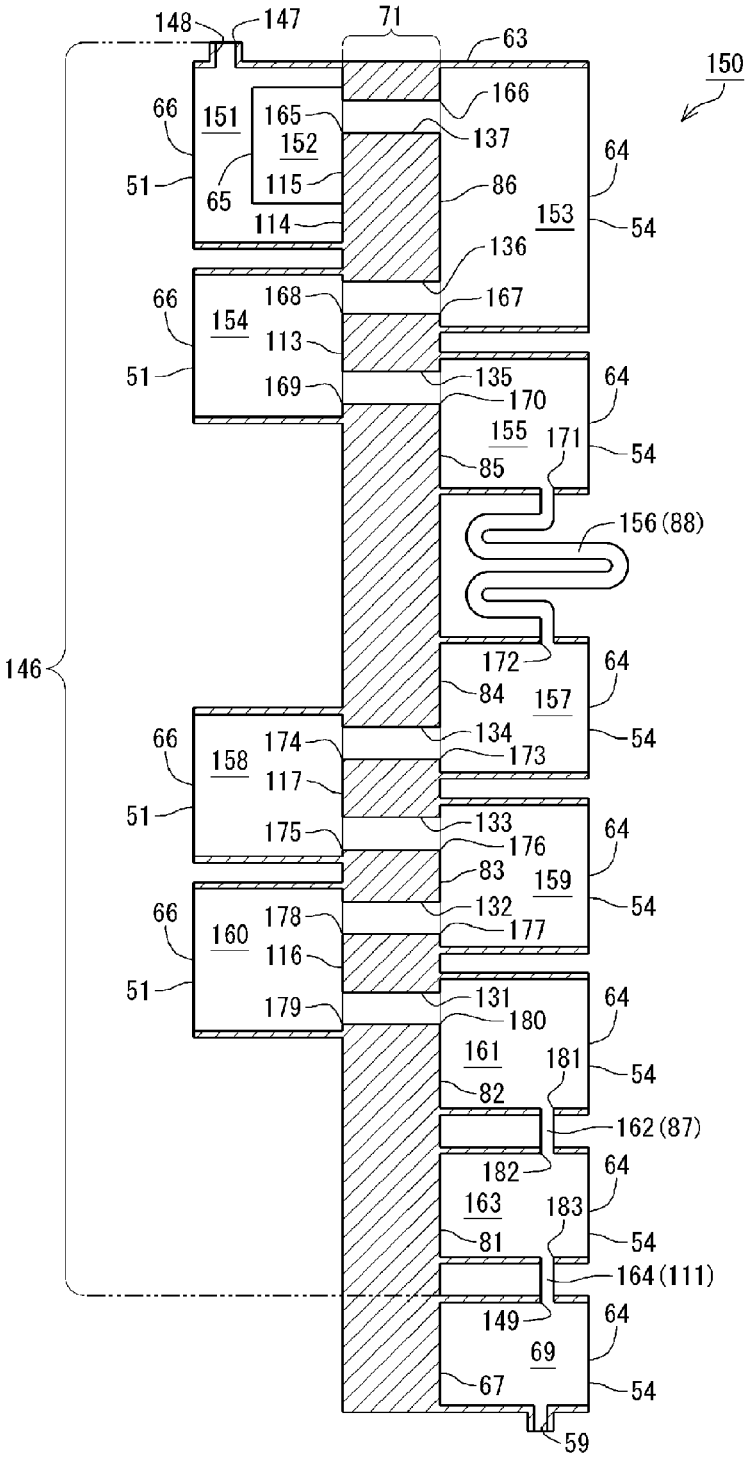
FIG. 16 is a diagram schematically illustrating a flow path of the tank according to Embodiment 1.

The flow path extending from the atmosphere opening port 147 to the liquid supply port 59 will now be described with reference to a schematic drawing. Here, the flow path extending from the atmosphere opening port 147 to the liquid supply portion 59 will be schematically described for the purpose of facilitating the understanding. Note that the direction extending from the atmosphere opening port 147 toward the liquid supply port 59 will be considered to be the direction in which a fluid flows. This direction will serve as a basis regarding "upstream" and "downstream". As illustrated in FIG. 16, a flow path 150 extending from the atmosphere opening port 147 to the liquid supply port 59 includes an atmosphere chamber 151, an atmosphere chamber 152, an atmosphere chamber 153, an atmosphere chamber 154, an atmosphere chamber 155, a communicating path 156, an atmosphere chamber 157, a communicating path 158, an atmosphere chamber 159, a communicating path 160, an atmosphere chamber 161, a communicating path 162, a buffer chamber 163, and a communicating path 164.

The atmosphere chamber 151 is provided on the downstream side of the introduction path 148. The atmosphere chamber 151 is a region surrounded by the recessed portion 114 of the case 63 and the sheet member 66. The atmosphere chamber 152 is provided on the downstream side of the atmosphere chamber 151. The atmosphere chamber 152 is a region surrounded by the recessed portion 115 and the waterproof air-permeable film 65. The atmosphere chamber 152 is located within the atmosphere chamber 151. The atmosphere can move between the atmosphere chamber 151 and the atmosphere chamber 152 via the waterproof air-permeable film 65. The atmosphere chamber 153 is provided on the downstream side of the atmosphere chamber 152. The atmosphere chamber 153 is a region surrounded by the recessed portion 86 of the case 63 and the sheet member 64. The atmosphere chamber 152 and the atmosphere chamber 153 are in communication with each other via the communicating portion 137 that passes through the wall 71 of the case 63. Note that an opening of the communicating portion 137 on the atmosphere chamber 152 side is denoted as a communicating port 165. The communicating port 165 corresponds to a connection port between the atmosphere chamber 152 and the communicating portion 137. An opening of the communicating portion 137 on the atmosphere chamber 153 side is denoted as a communicating port 166. The communicating port 166 corresponds to a connection port between the atmosphere chamber 153 and the communicating portion 137.

The atmosphere chamber 154 is provided on the downstream side of the atmosphere chamber 153. The atmosphere chamber 154 is a region surrounded by the recessed portion 113 of the case 63 and the sheet member 66. The atmosphere chamber 153 and the atmosphere chamber 154 are in communication with each other via the communicating portion 136 that passes through the wall 71 of the case 63. An opening of the communicating portion 136 on the atmosphere chamber 153 side is denoted as a communicating port 167. The communicating port 167 corresponds to a connection port between the atmosphere chamber 153 and the communicating portion 136. An opening of the communicating portion 136 on the atmosphere chamber 154 side is denoted as a communicating port 168. The communicating port 168 corresponds to a connection port between the atmosphere chamber 154 and the communicating portion 136.

The atmosphere chamber 155 is provided on the downstream side of the atmosphere chamber 154. The atmosphere chamber 155 is a region surrounded by the recessed portion 85 of the case 63 and the sheet member 64. The atmosphere chamber 154 and the atmosphere chamber 155 are in communication with each other via the communicating portion 135 that passes through the wall 71 of the case 63. An opening of the communicating portion 135 on the atmosphere chamber 154 side is denoted as a communicating port 169. The communicating port 169 corresponds to a connection port between the atmosphere chamber 154 and the communicating portion 135. An opening of the communicating portion 135 on the atmosphere chamber 155 side is denoted as a communicating port 170. The communicating port 170 corresponds to a connection port between the atmosphere chamber 155 and the communicating portion 135.

The communicating path 156 is provided on the downstream side of the atmosphere chamber 155. The communicating path 156 is a region surrounded by the groove portion 88 of the case 63 and the sheet member 64. The atmosphere chamber 155 and the communicating path 156 are connected to each other via a communicating port 171. That is to say, the communicating port 171 corresponds to a connection port between the atmosphere chamber 155 and the communicating path 156.

The atmosphere chamber 157 is provided on the downstream side of the communicating path 156. The atmosphere chamber 157 is a region surrounded by the recessed portion 84 of the case 63 and the sheet member 64. The communicating path 156 and the atmosphere chamber 157 are connected to each other via a communicating port 172. That is to say, the communicating port 172 corresponds to a connection port between the communicating path 156 and the atmosphere chamber 157.

The communicating path 158 is provided on the downstream side of the atmosphere chamber 157. The communicating path 158 is a region surrounded by the recessed portion 117 of the case 63 and the sheet member 66. The atmosphere chamber 157 and the communicating path 158 are in communication with each other via the communicating portion 134 that passes through the wall 71 of the case 63. An opening of the communicating portion 134 on the atmosphere chamber 157 side is denoted as a communicating port 173. The communicating port 173 corresponds to a connection port between the atmosphere chamber 157 and the communicating portion 134. An opening of the communicating portion 134 on the communicating path 158 side is denoted as a communicating port 174. The communicating port 174 corresponds to a connection port between the communicating path 158 and the communicating portion 134.

The atmosphere chamber 159 is provided on the downstream side of the communicating path 158. The atmosphere chamber 159 is a region surrounded by the recessed portion 83 of the case 63 and the sheet member 64. The communicating path 158 and the atmosphere chamber 159 are in communication with each other via the communicating portion 133 that passes through the wall 71 of the case 63. An opening of the communicating portion 133 on the communicating path 158 side is denoted as a communicating port 175. The communicating port 175 corresponds to a connection port between the communicating path 158 and the communicating portion 133. An opening of the communicating portion 133 on the atmosphere chamber 159 side is denoted as a communicating port 176. The communicating port 176 corresponds to a connection port between the atmosphere chamber 159 and the communicating portion 133.

The communicating path 160 is provided on the downstream side of the atmosphere chamber 159. The communicating path 160 is a region surrounded by the recessed portion 116 of the case 63 and the sheet member 66. The atmosphere chamber 159 and the communicating path 160 are in communication with each other via the communicating portion 132 that passes through the wall 71 of the case 63. An opening of the communicating portion 132 on the atmosphere chamber 159 side is denoted as a communicating port 177. The communicating port 177 corresponds to a connection port between the atmosphere chamber 159 and the communicating portion 132. An opening of the communicating portion 132 on the communicating path 160 side is denoted as a communicating port 178. The communicating port 178 corresponds to a connection port between the communicating path 160 and the communicating portion 132.

The atmosphere chamber 161 is provided on the downstream side of the communicating path 160. The atmosphere chamber 161 is a region surrounded by the recessed portion 82 of the case 63 and the sheet member 64. The communicating path 160 and the atmosphere chamber 161 are in communication with each other via the communicating portion 131 that passes through the wall 71 of the case 63. An opening of the communicating portion 131 on the communicating path 160 side is denoted as a communicating port 179. The communicating port 179 corresponds to a connection port between the communicating path 160 and the communicating portion 131. An opening of the communicating portion 131 on the atmosphere chamber 161 side is denoted as a communicating port 180. The communicating port 180 corresponds to a connection port between the atmosphere chamber 161 and the communicating portion 131.

The communicating path 162 is provided on the downstream side of the atmosphere chamber 161. The communication path 162 is a region surrounded by the groove portion 87 of the case 63 and the sheet member 64. The atmosphere chamber 161 and the communicating path 162 are connected to each other via a communicating port 181. That is to say, the communicating port 181 corresponds to a connection port between the atmosphere chamber 161 and the communicating path 162.

The buffer chamber 163 is provided on the downstream side of the communicating path 162. The buffer chamber 163 is a region surrounded by the recessed portion 81 of the case 63 and the sheet member 64. The communication path 162 and the buffer chamber 163 are connected to each other via a communicating port 182. That is to say, the communicating port 182 corresponds to a connection port between the communicating path 162 and the buffer chamber 163.

The communicating path 164 is provided on the downstream side of the buffer chamber 163. The communicating path 162 is a region surrounded by the cutout portion 111 of the case 63 and the sheet member 64. The buffer chamber 163 and the communicating path 164 are connected to each other via a communicating port 183. That is to say, the communicating port 183 corresponds to a connection port between the buffer chamber 163 and the communicating portion 164.

The liquid containing portion 69 is provided on the downstream side of the communicating path 164. The liquid containing portion 69 is a region surrounded by the recessed portion 67 of the case 63 and the sheet member 64. The communicating path 164 and the liquid containing portion 69 are connected to each other via the connection port 149. The connection port 149 is a connection port between the communicating path 164 and the liquid containing portion 69, and is also a connection port between the atmosphere communicating portion 146 and the liquid containing portion 69. The liquid supply portion 59 is provided on the downstream side of the liquid containing portion 69. In this embodiment, the flow path 150 extending from the atmosphere opening port 147 to the liquid supply portion 59 has the above configuration.

When the ink in the liquid containing portion 69 is supplied to the recording portion 31 (FIG. 2) via the liquid supply portion 59, the amount of the ink in the liquid containing portion 69 decreases. If the amount of the ink in the liquid containing portion 69 decreases, the air pressure in the liquid containing portion 69 is likely to be lower than the atmospheric pressure. In this embodiment, the atmosphere communicating portion 146 extending from the atmosphere opening port 147 to the communicating path 164 is in communication with the liquid containing portion 69. Therefore, if the amount of the ink in the liquid containing portion 69 decreases and the air pressure in the liquid containing portion 69 becomes lower than the atmospheric pressure, the atmosphere may be introduced into the liquid containing portion 69 via the atmosphere communicating portion 146. As a result, the air pressure in the liquid containing portion 69 is likely to be maintained at the atmospheric pressure.

At this time, the atmosphere introduced in the liquid containing portion 69 flows into the atmosphere chamber 151 from the atmosphere opening port 147 via the introduction path 148. The atmosphere that has flowed into the atmosphere chamber 151 flows into the atmosphere chamber 152 through the waterproof air-permeable film 65. The atmosphere that has flowed into the atmosphere chamber 152 flows into the atmosphere chamber 153 from the communicating port 165 through the communicating port 166 of the communicating portion 137. The atmosphere that has flowed into the atmosphere chamber 153 flows into the atmosphere chamber 154 from the communicating port 167 through the communicating port 168 of the communicating portion 136.

The atmosphere that has flowed into the atmosphere chamber 154 flows into the atmosphere chamber 155 from the communicating port 169 through the communicating port 170 of the communicating portion 135. The atmosphere that has flowed into the atmosphere chamber 155 flows into the atmosphere chamber 157 from the communicating port 171 through the communicating port 172 of the communicating path 156. The atmosphere that has flowed into the atmosphere chamber 157 flows into the communicating path 158 from the communicating port 173 through the communicating port 174 of the communicating portion 134.

The atmosphere that has flowed into the communicating path 158 flows into the atmosphere chamber 159 from the communicating port 175 through the communicating port 176 of the communicating portion 133. The atmosphere that has flowed into the atmosphere chamber 159 flows into the communicating path 160 from the communicating port 177 through the communicating port 178 of the communicating portion 132. The atmosphere that has flowed into the communicating path 160 flows into the atmosphere chamber 161 from the communicating port 179 through the communicating port 180 of the communicating portion 131.

The atmosphere that has flowed into the atmosphere chamber 161 flows into the buffer chamber 163 from the communicating port 181 through the communicating port 182 of the communicating path 162. The atmosphere that has flowed into the buffer chamber 163 flows into the liquid containing portion 69 from the communicating port 183 through the connection port 149 of the communicating path 164.

In the tank 9A, the front face 51 and the back face 54 are oriented in different directions. The front face 51 of the tank 9A is provided with the atmosphere chamber 151, the atmosphere chamber 152, the atmosphere chamber 154, the communicating path 158, and the communicating path 160. The back face 54 is provided with the atmosphere chamber 153, the atmosphere chamber 155, the communicating path 156, the atmosphere chamber 157, the atmosphere chamber 159, the atmosphere chamber 161, the communicating path 162, the buffer chamber 163, and the communicating path 164. That is to say, the tank 9A is provided with the atmosphere communicating portion 146 over different faces of the tank 9A. Therefore, even if ink enters the atmosphere communicating portion 146 from the liquid containing portion 69, further progress of the ink can be readily prevented by the atmosphere communicating portion 146 provided over different faces of the tank 9A. This configuration makes it easy to prevent the ink in the liquid containing portion 69 from leaking out of the tank 9A from the atmosphere opening port 147 via the atmosphere communicating portion 146.

Note that, in the tank 9A, one of the front face 51 and the back face 54 corresponds to the first face, and the other one of the front face 51 and the back face 54 corresponds to the second face. The atmosphere chamber 151, the atmosphere chamber 152, the atmosphere 154, the communicating path 158, and the communicating path 160 provided in the front face 51 correspond to one of a first atmosphere chamber and a second atmosphere chamber. The atmosphere chamber 153, the atmosphere chamber 155, the communicating path 156, the atmosphere chamber 157, the atmosphere chamber 159, the atmosphere chamber 161, the communicating path 162, the buffer chamber 163, and the communicating path 164 that are provided in the back face 54, correspond to the other one of the first atmosphere chamber and the second atmosphere chamber.

In the tank 9A, the atmosphere communicating portion 146 is provided over different faces, namely the front face 51 and the back face 54. However, the combination of the faces in which the atmosphere communicating portion 146 is provided is not limited to the combination of the front face 51 and the back face 54. As a combination of the faces in which the atmosphere communicating portion 146 is provided, any two of the side face 52, the upper face 53, the side face 55, and the lower face 56 can be selected.

As a combination of the faces in which the atmosphere communicating portion 146 is provided, a combination of the front face 51 and one of the side face 52, the upper face 53, the side face 55, and the lower face 56 may also be employed. In this case, the front face 51 corresponds to the first face, and the one of the side face 52, the upper face 53, the side face 55, and the lower face 56 corresponds to the second face.

Furthermore, as a combination of the faces in which the atmosphere communicating portion 146 is provided, a combination of the back face 54 and one of the side face 52, the upper face 53, the side face 55, and the lower face 56 may also be employed. In this case, the back face 54 corresponds to the first face, and the one of the side face 52, the upper face 53, the side face 55, and the lower face 56 corresponds to the second face.

In the tank 9A, the waterproof air-permeable film 65 is arranged onto the atmosphere chamber 151 that is closest to the atmosphere opening port 147 in the flow path of the atmosphere communicating portion 146. With this configuration, it is easy to block, at the atmosphere chamber 152, the progress of the ink that has entered the atmosphere communicating portion 146 from the liquid containing portion 69. Therefore, the ink that has entered the atmosphere communicating portion 146 from the liquid containing portion 69 can be easily prevented from reaching the atmosphere opening port 147.

In the tank 9A, the connection port 149 (FIG. 14) and the liquid inlet port 138 (FIG. 13) are located in the same position in the vertical direction. When an operator injects ink from the liquid inlet portion 36, the liquid surface of the ink in the liquid containing portion 69 does not easily become higher in the Z-axis direction than the liquid inlet port 138. Possible reasons of this include the position of the liquid inlet port 138 being located vertically above the upper limit mark 34 (FIG. 2), or the liquid surface of the ink in the liquid inlet portion 36 being able to be easily checked upon the liquid surface of the ink exceeding the liquid inlet port 138 in the vertically upward direction. Therefore, with a configuration in which the connection port 149 (FIG. 14) and the liquid inlet port 138 (FIG. 13) are located in the same position in the vertical direction, the ink in the liquid containing portion 69 does not easily reach the connection port 149. As a result, the ink can be readily prevented from entering the atmosphere communicating portion 146 from the liquid containing portion 69, and therefore, the ink in the liquid containing portion 69 can be readily prevented from leaking out of the tank 9A from the atmosphere opening port 147 via the atmosphere communicating portion 146. Note that, with a configuration in which the connection port 149 (FIG. 14) is located vertically above the liquid inlet port 138 (FIG. 13), the above effect can be enhanced.

The tank 9A is provided with the support portions 141 (FIG. 14) that project to the sheet member 64 side from the wall 71 of the case 63 in the liquid containing portion 69. Therefore, for example, the sheet member 64 can be supported by the support portion 141 when the sheet member 64 is pressed toward the wall 71 of the case 63, i.e., to the inside of the liquid containing portion 69. This configuration facilitates restriction of bending of the sheet member 64. As a result, for example, it is possible to reduce shrinkage of the internal volume of the liquid containing portion 69 when the sheet member 64 is pressed toward the inside of the liquid containing portion 69. Therefore, for example, when the sheet member 64 is pressed to the inside of the liquid containing portion 69, a flow of the ink in the liquid containing portion 69 into the atmosphere communicating portion 146 from the connection port 149 can be easily avoided.

Since the tank 9A is provided with the plurality of support portions 141 in the liquid containing portion 69, it is possible to further reduce shrinkage of the internal volume of the liquid containing portion 69 when the sheet member 64 is pressed to the inside of the liquid containing portion 69. Therefore, for example, when the sheet member 64 is pressed to the inside of the liquid containing portion 69, a flow of the ink in the liquid containing portion 69 into the atmosphere communicating portion 146 from the connection port 149 can be easily avoided.

In the tank 9A, the sheet member 64 is joined to the joint portion 68 provided in the support portion 141. Therefore, a position shift of the sheet member 64 can be readily suppressed. For example, when the air pressure in the liquid containing portion 69 becomes higher than the atmospheric pressure, an increase in the internal volume of the liquid containing portion 69 can be reduced.

Embodiment 2

Figure 17:
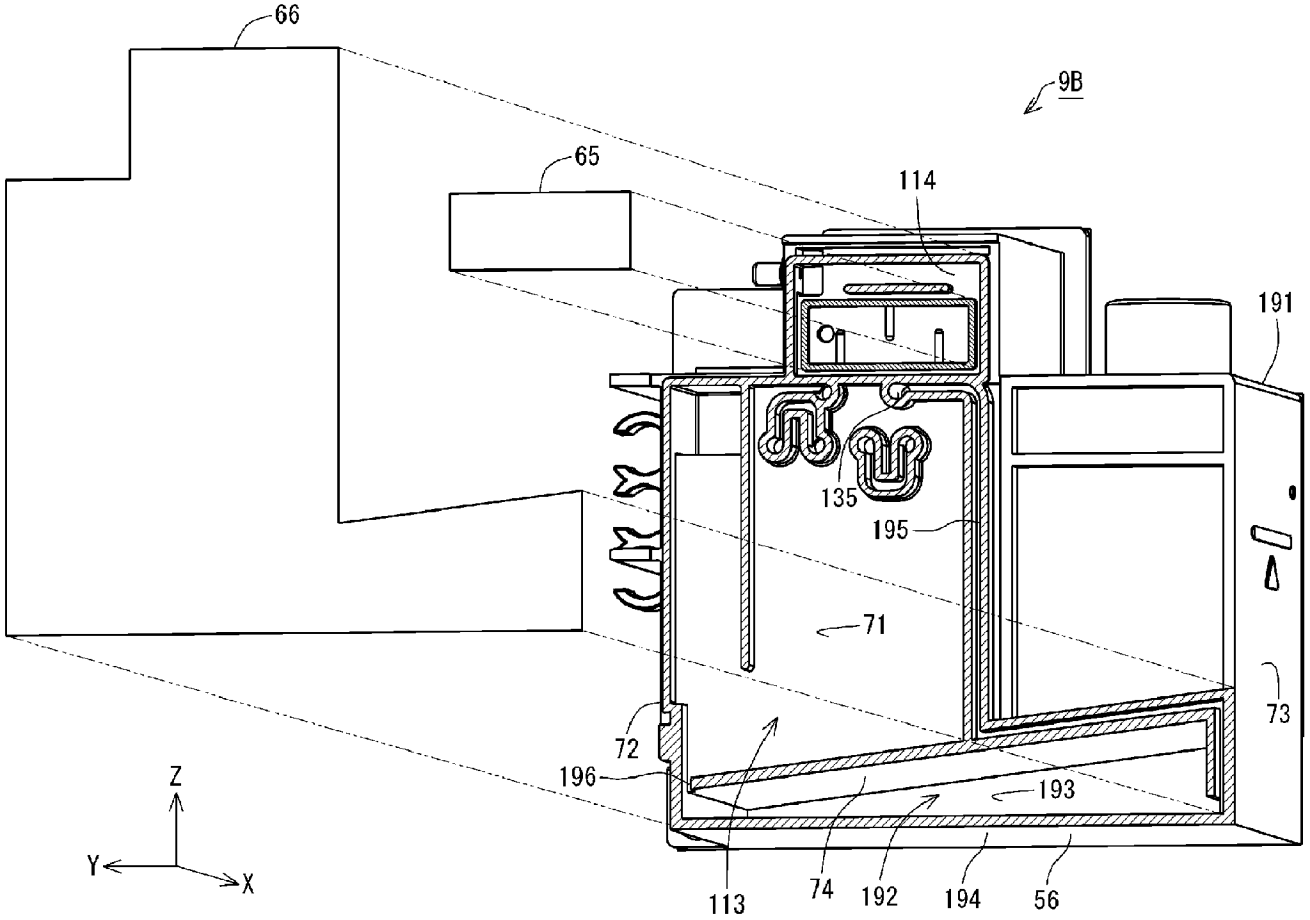
FIG. 17 is an exploded perspective view illustrating a tank according to Embodiment 2.

As illustrated in FIG. 17, a tank 9B according to Embodiment 2 has a case 191. The tank 9B according to Embodiment 2 has a configuration similar to the tank 9A according to Embodiment 1, except that the case 63 according to Embodiment 1 is replaced with a case 191, and the shape of the sheet member 66 is different. Therefore, in the following description, components similar to those in Embodiment 1 will be assigned the same signs as those in Embodiment 1, and detailed descriptions thereof will be omitted.

A recessed portion 192 is formed in the case 191. The case 191 has a wall 193 and a wall 194. The wall 193 extends along an XZ plane. The wall 193 is located further in the -Y-axis direction than the wall 71. The wall 194 extends along an XY plane. The wall 194 is located further in the -Z-axis direction than the wall 74. In the case 191, the wall 72 and the wall 73 protrude further in the -Z-axis direction than the wall 74, and are connected to a wall 194. The wall 72, the wall 74, the wall 73, and the wall 194 project in the Y-axis direction from the wall 193. The wall 72, the wall 74, the wall 73, and the wall 194 surround the wall 193. With this configuration, the recessed portion 192 that has the wall 193 as a bottom is configured. Note that, in the tank 9B, a face of the wall 194 in the -Z-axis direction, i.e., a face of the wall 194 on the side opposite to the recessed portion 192 side is set as the lower face 56.

The recessed portion 192 is located further in the -Z-axis direction than the recessed portion 113. The recessed portion 192 is formed in the direction of being recessed in the -Y-axis direction. The recessed portion 192 is connected to the communicating portion 135 via a groove portion 195. The recessed portion 192 is also connected to the recessed portion 113 via a cutout portion 196. That is to say, in the case 191, the communicating portion 135 is connected to the recessed portion 113 via the groove portion 195, the recessed portion 192, and the cutout portion 196. The case 191 is different from the case 63 according to Embodiment 1 on this point. Except this, the case 191 has a configuration similar to the case 63 according to Embodiment 1.

In Embodiment 2, the sheet member 66 has a size and a shape that allow the sheet member 66 to cover the recessed portion 113, the recessed portion 114, and the recessed portion 192. Except this, the sheet member 66 according to Embodiment 2 has a configuration similar to the sheet member 66 according to Embodiment 1.

Figure 18:
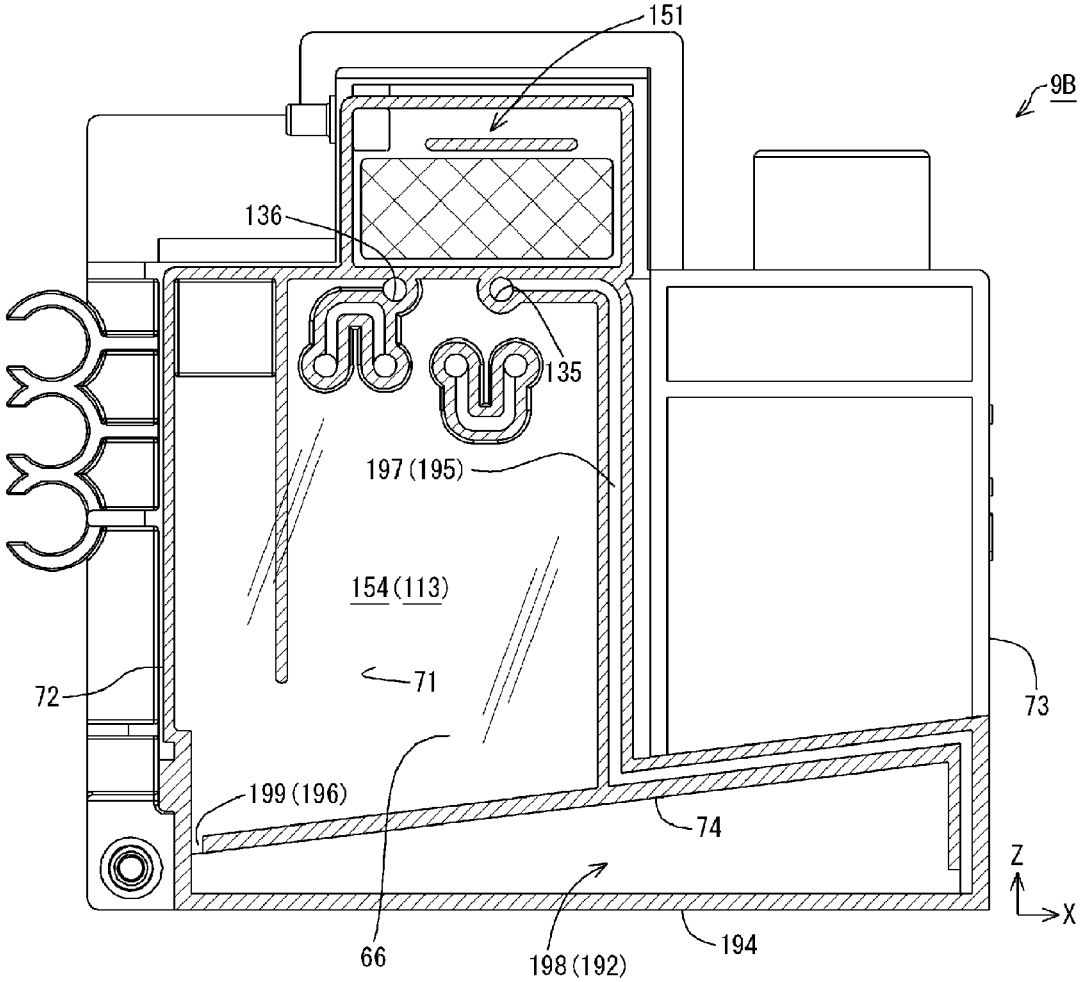
FIG. 18 is a diagram of the tank according to Embodiment 2 as viewed from the front face side.

Upon the sheet member 66 being joined to the case 191, a communicating path 197, an atmosphere chamber 198, and a communicating path 199 are configured as illustrated in FIG. 18. The communicating path 197 is a region surrounded by the groove portion 195 and the sheet member 66. The atmosphere chamber 198 is a region surrounded by the recessed portion 192 and the sheet member 66. The communicating path 199 is a region surrounded by the cutout portion 196 and the sheet member 66. Thus, the communicating portion 135 leads to the atmosphere chamber 198 via the communicating path 197. The atmosphere chamber 198 leads to the atmosphere chamber 154 via the communicating path 199.

Figure 19:
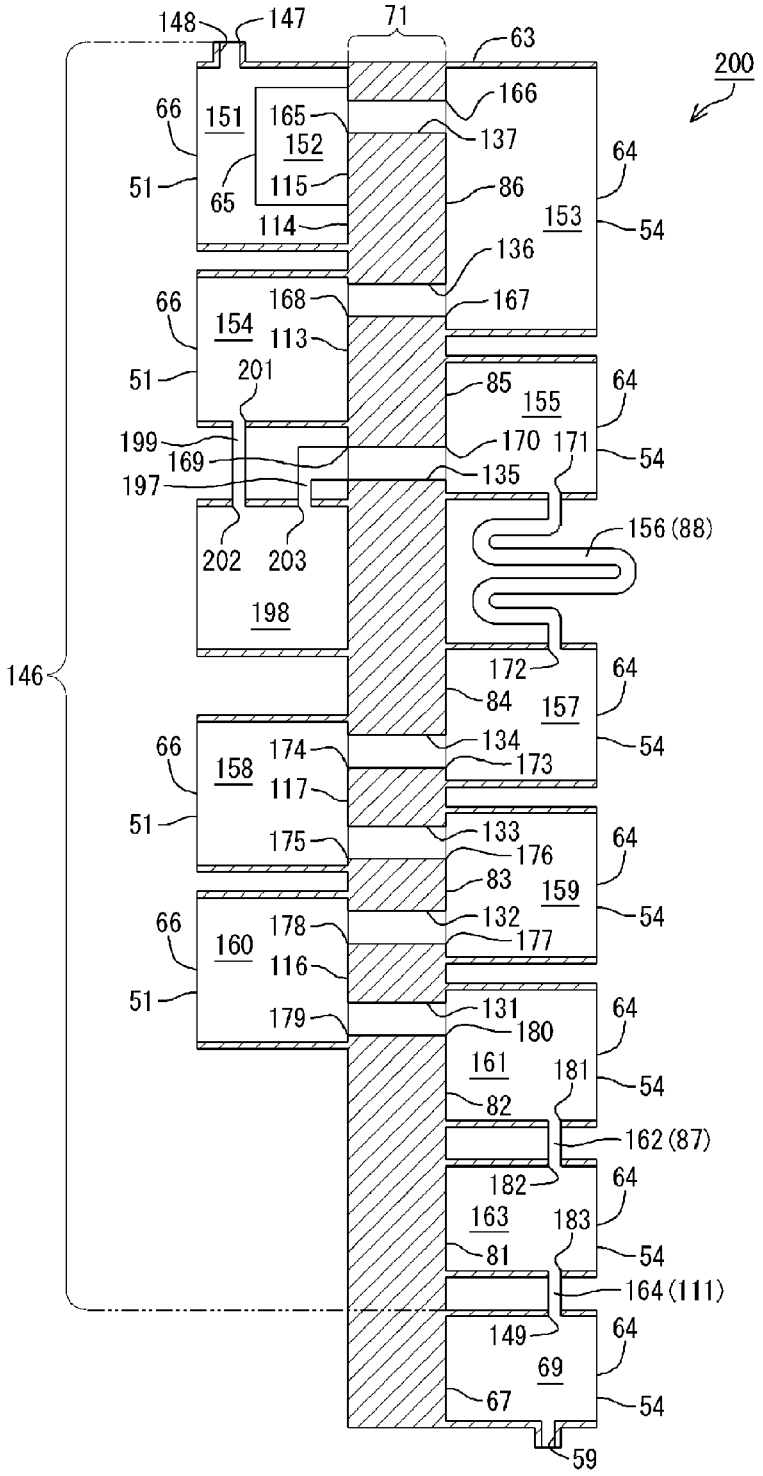
FIG. 19 is a diagram schematically illustrating a flow path of the tank according to Embodiment 2.

With the above configuration, the atmosphere communicating portion 146 in the tank 9B has a configuration in which the communicating path 197, the atmosphere chamber 198, and the communicating path 199 are added to the atmosphere communicating portion 146 according to Embodiment 1, as illustrated in FIG. 19. That is to say, a flow path 200 according to Embodiment 2 has a configuration in which the communicating path 197, the atmosphere chamber 198, and the communicating path 199 are added to the flow path 150 according to Embodiment 1. Except this point, the flow path 200 according to Embodiment 2 has a configuration similar to the flow path 150 according to Embodiment 1. Therefore, components of the flow path 200 according to Embodiment 2 that are similar to those according to Embodiment 1 will be assigned the same signs as those in Embodiment 1, and detailed descriptions thereof will be omitted.

The communicating path 199 is provided on the downstream side of the atmosphere chamber 154. The atmosphere chamber 198 is provided on the downstream side of the communicating path 199. The communicating path 197 is provided on the downstream side of the atmosphere chamber 198. The atmosphere chamber 198 is in communication with the atmosphere chamber 154 via the communicating path 199. An opening of the communicating path 199 on the atmosphere chamber 154 side is denoted as a communicating port 201. The communicating port 201 corresponds to a connection port between the atmosphere chamber 154 and the communicating path 199. An opening of the communicating path 199 on the atmosphere chamber 198 side is denoted as a communicating port 202. The communicating port 202 corresponds to a connection port between the atmosphere chamber 198 and the communicating path 199.

The atmosphere chamber 198 is in communication with the communicating portion 135 via the communicating path 197. The communicating portion 135 is in communication with the atmosphere chamber 155. That is to say, the atmosphere chamber 198 is in communication with the atmosphere chamber 155 via the communicating path 197 and the communicating portion 135. An opening of the communicating path 197 on the atmosphere chamber 198 side is denoted as a communicating port 203. The communicating port 203 corresponds to a connection port between the atmosphere chamber 198 and the communicating path 197. An opening of the communicating path 197 on the communicating portion 135 side is the communicating port 169, similarly as in Embodiment 1. In Embodiment 2, the communicating port 169 corresponds to a connection port between the communicating path 197 and the communicating portion 135.

The atmosphere that has flowed into the atmosphere chamber 154 from the atmosphere chamber 153 flows into the atmosphere chamber 198 from the communicating port 201 through the communicating port 202 of the communicating path 197. The atmosphere that has flowed into the atmosphere chamber 198 flows into the communicating portion 135 from the communicating port 203 through the communicating port 169 of the communicating path 199. The atmosphere that has flowed into the communicating portion 135 flows into the atmosphere chamber 155 through the communicating port 170. A portion of the flow path 200 upstream of the atmosphere chamber 154 and a portion thereof downstream of the atmosphere chamber 155 are similar to the flow path 150 according to Embodiment 1. Therefore, a description of the flow of the atmosphere in a portion of the flow path 200 that is similar to the flow path 150 will be omitted. Embodiment 2 can also achieve effects similar to Embodiment 1.

Furthermore, in Embodiment 2, as compared with Embodiment 1, the communicating path 197, the atmosphere chamber 198, and the communicating path 199 are added. Therefore, even if ink enters the atmosphere communicating portion 146 from the liquid containing portion 69, the ink that has entered the atmosphere communicating portion 146 can be more readily prevented from leaking out of the tank 9B from the atmosphere opening port 147.

Note that, in the tank 9B, one of the front face 51 and the back face 54 corresponds to a first face, and the other one of the front face 51 and the back face 54 corresponds to a second face. The atmosphere chambers 151, the atmosphere chamber 152, the atmosphere chamber 154, the atmosphere chamber 198, the communicating path 158, and the communicating path 160 that are provided in the front face 51, correspond to one of a first atmosphere chamber and a second atmosphere chamber. The atmosphere chamber 153, the atmosphere chamber 155, the communicating path 156, the atmosphere chamber 157, the atmosphere chamber 159, the atmosphere chamber 161, the communicating path 162, the buffer chamber 163, and the communicating path 164 that are provided in the back face 54, correspond to the other one of the first atmosphere chamber and the second atmosphere chamber.

Embodiment 3

Figure 20:
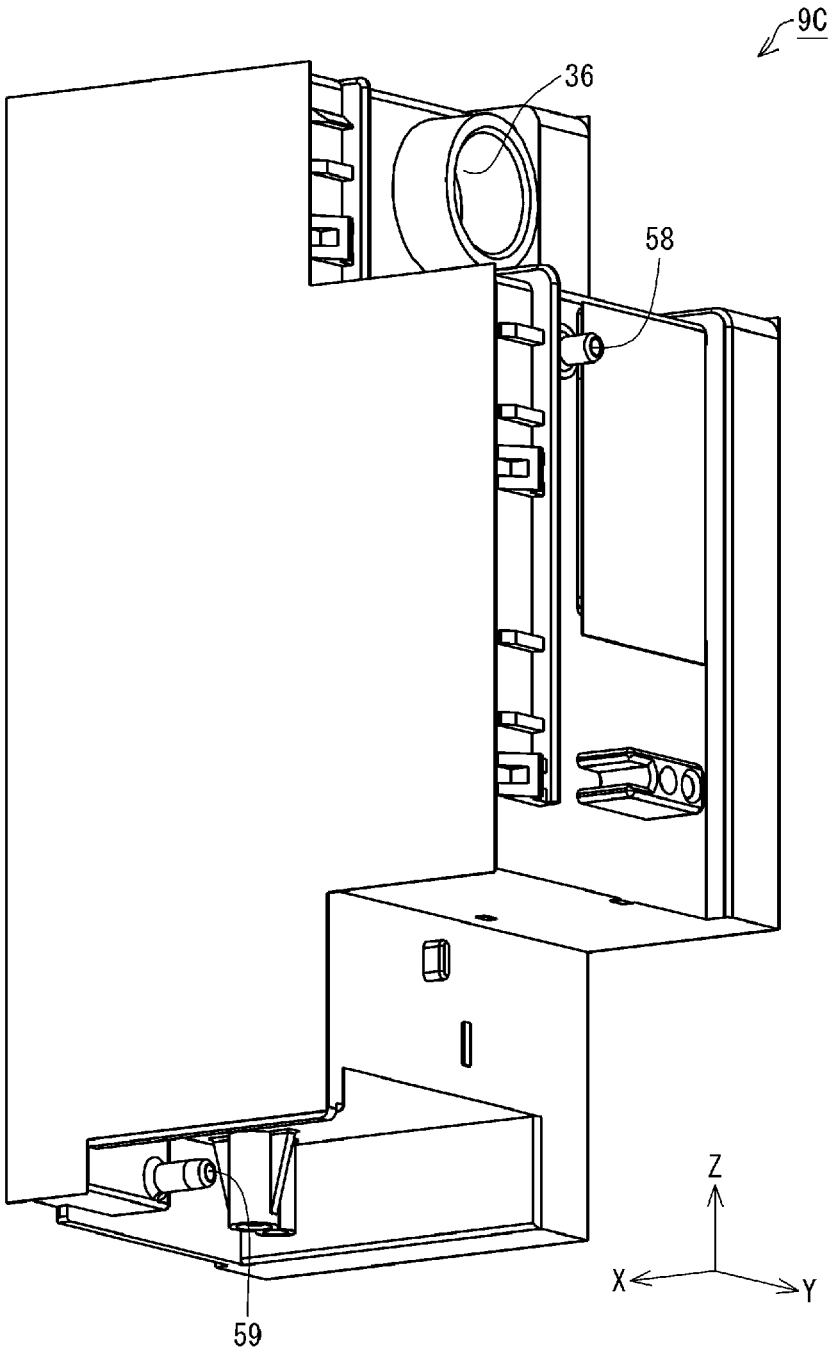
FIG. 20 is a perspective view illustrating a tank according to Embodiment 3.

As illustrated in FIG. 20, a tank 9C according to Embodiment 3 has the liquid inlet portion 36, the atmosphere opening portion 58, and the liquid supply portion 59. Note that the tank 9C according to Embodiment 3 has components having functions similar to the components of the tank 9A according to Embodiment 1. Therefore, components of the tank 9C according to Embodiment 3 that include functions similar to the components of the tank 9A according to Embodiment 1 will be assigned the same signs as the components of the tank 9A according to Embodiment 1, and detailed descriptions thereof will be omitted.

Figure 21:
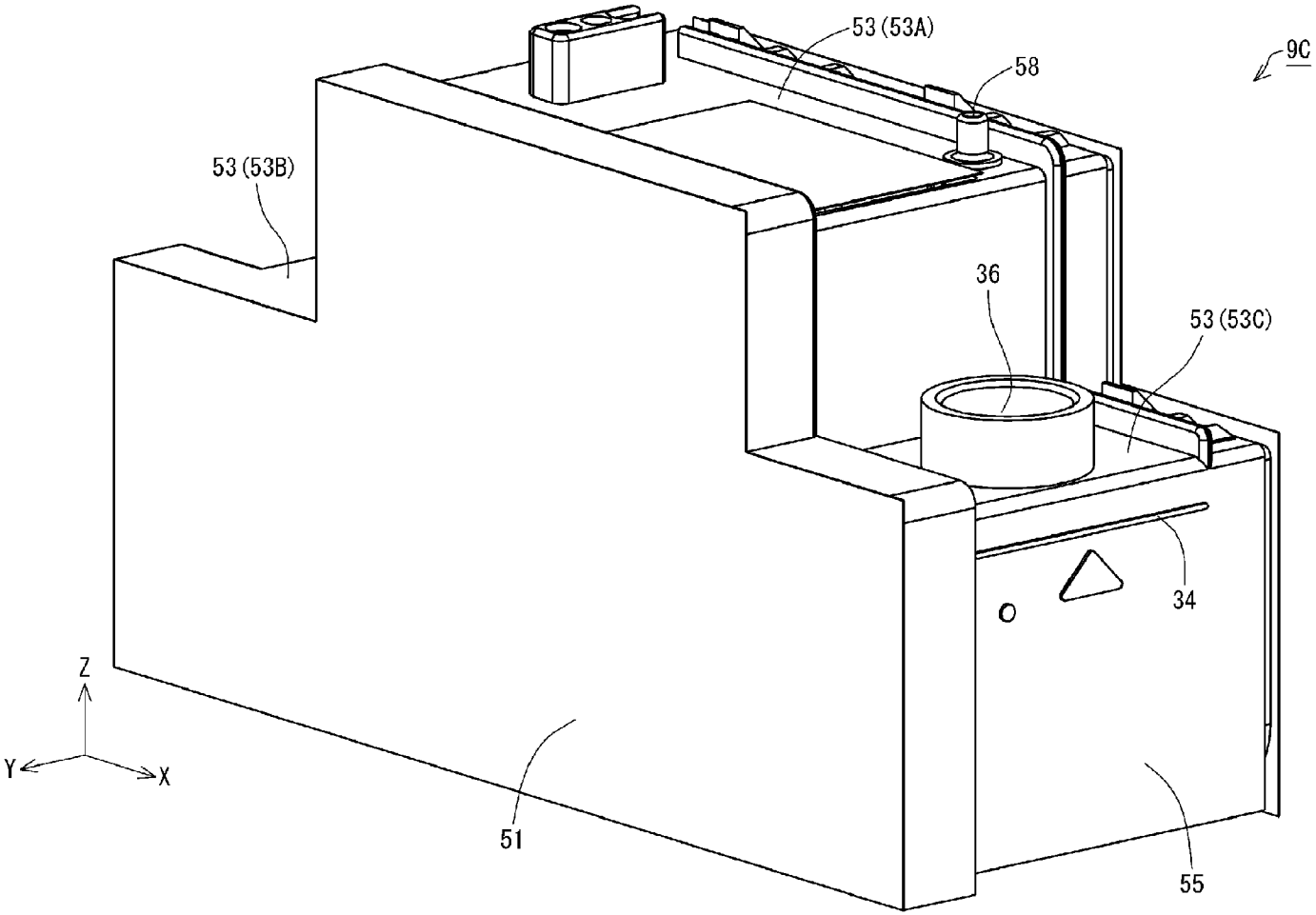
FIG. 21 is a perspective view illustrating the tank according to Embodiment 3.

In the tank 9C according to Embodiment 3, in the usage posture, the liquid inlet portion 36 is oriented in a direction that intersects the Z axis. When the ink is injected into the tank 9C from the liquid inlet portion 36, the operator changes the posture of the tank 9C such that the liquid inlet portion 36 is oriented in the Z-axis direction, as illustrated in FIG. 21. The posture of the tank 9C in which the liquid inlet portion 36 is oriented in the Z-axis direction will be called an injection posture of the tank 9C. That is to say, with the tank 9C according to Embodiment 3, when the ink is injected into the tank 9C from the liquid inlet portion 36, the operator changes the posture of the tank 9C from the usage posture illustrated in FIG. 20 to the injection posture illustrated in FIG. 21, and thereafter injects the ink from the liquid inlet portion 36.

In the following description of the tank 9C, the tank 9C is assumed to be in the injection posture unless stated otherwise. That is to say, unless stated otherwise, the description of the tank 9C will be given regarding the injection posture in which the liquid inlet portion 36 of the tank 9C is oriented vertically upward.

Figure 22:
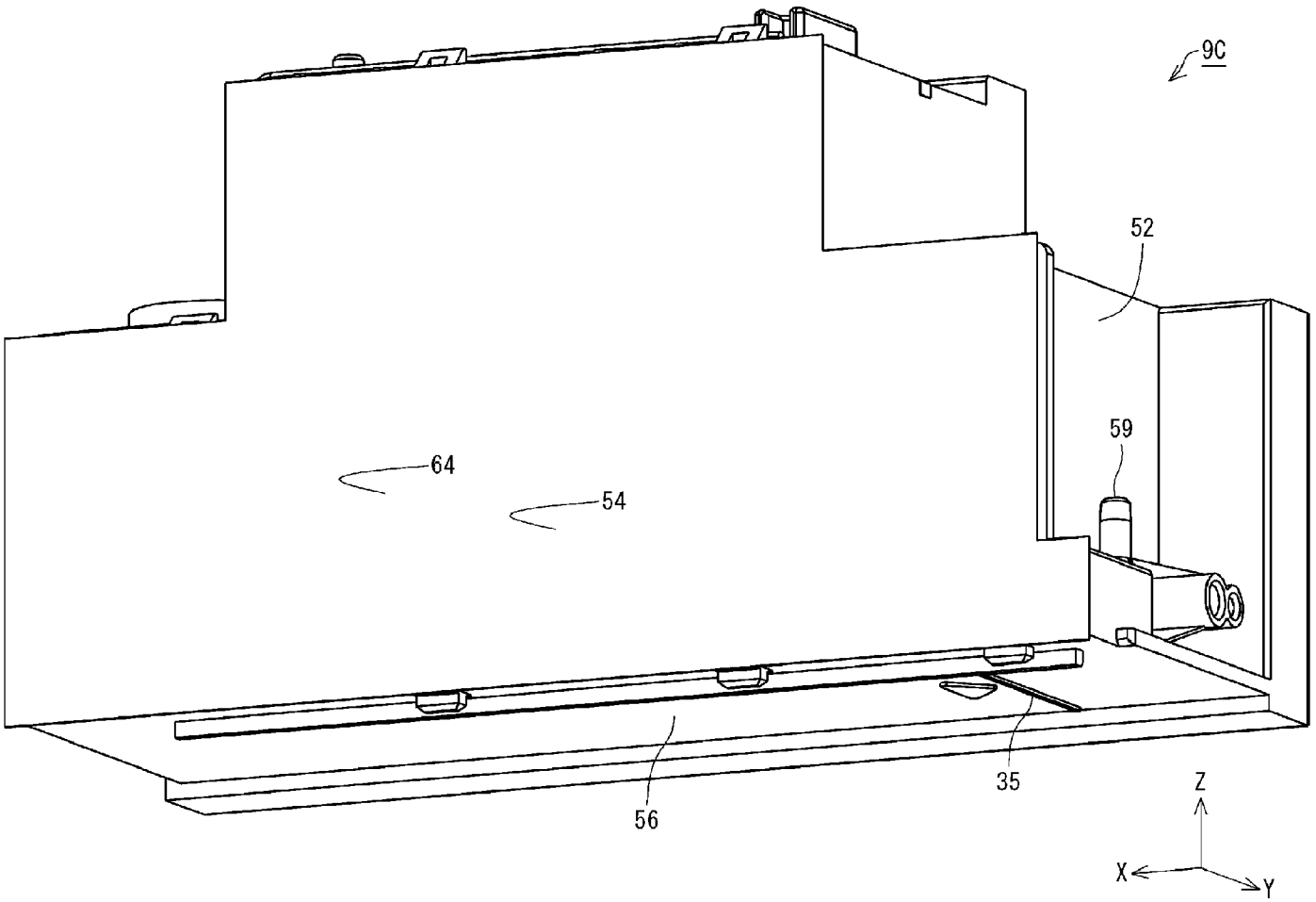
FIG. 22 is a perspective view illustrating the tank according to Embodiment 3.

As illustrated in FIG. 21, the tank 9C has the front face 51, the upper face 53, and the side face 55. Similarly as in Embodiment 1, the upper face 53 can be identified individually as the upper face 53A, the upper face 53B, and the upper face 53C. As illustrated in FIG. 22, the tank 9C has the side face 52, the back face 54, and the lower face 56. The front face 51, the side face 52, the upper face 53, the back face 54, the side face 55, and the lower face 56 are oriented in the respective directions similar to those in Embodiment 1.

As illustrated in FIG. 21, in the tank 9C, the atmosphere opening portion 58 is provided in the upper face 53A. In the tank 9C, the atmosphere opening portion 58 projects in the Z-axis direction from the upper face 53A, and is oriented in the Z-axis direction. Also, in the tank 9C, the liquid supply portion 59 is oriented in the Z-axis direction, as illustrated in FIG. 22.

Figure 23:
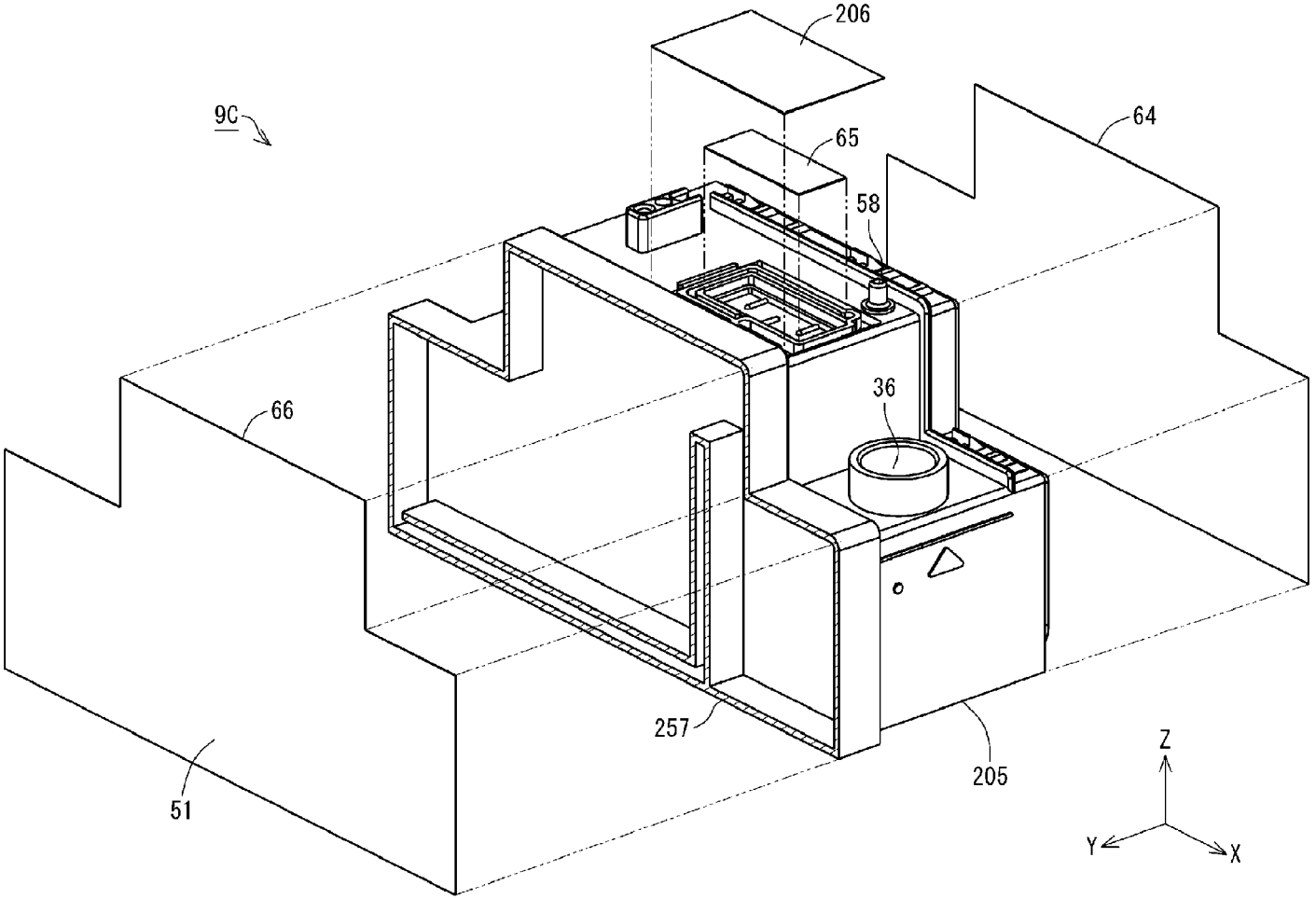
FIG. 23 is an exploded perspective view illustrating the tank according to Embodiment 3.

As illustrated in FIG. 23, the tank 9C has a case 205, the sheet member 64, the waterproof air-permeable film 65, the sheet member 66, and a sheet member 206. The case 205 is made of a material similar to the case 63 according to Embodiment 1. The sheet member 64, the waterproof air-permeable film 65, and the sheet member 66 are made of respective materials that are similar to those in Embodiment 1. The sheet member 206 is made of synthetic resin (e.g., nylon, polypropylene, etc.) formed in a film shape, and is flexible. In the tank 9C, a face of the sheet member 64 oriented in the -Y-axis direction corresponds to the back face 54 of the tank 9C, similarly as in Embodiment 1. Similarly, a face of the sheet member 66 oriented in the Y-axis direction corresponds to the front face 51 of the tank 9C.

Figure 24:
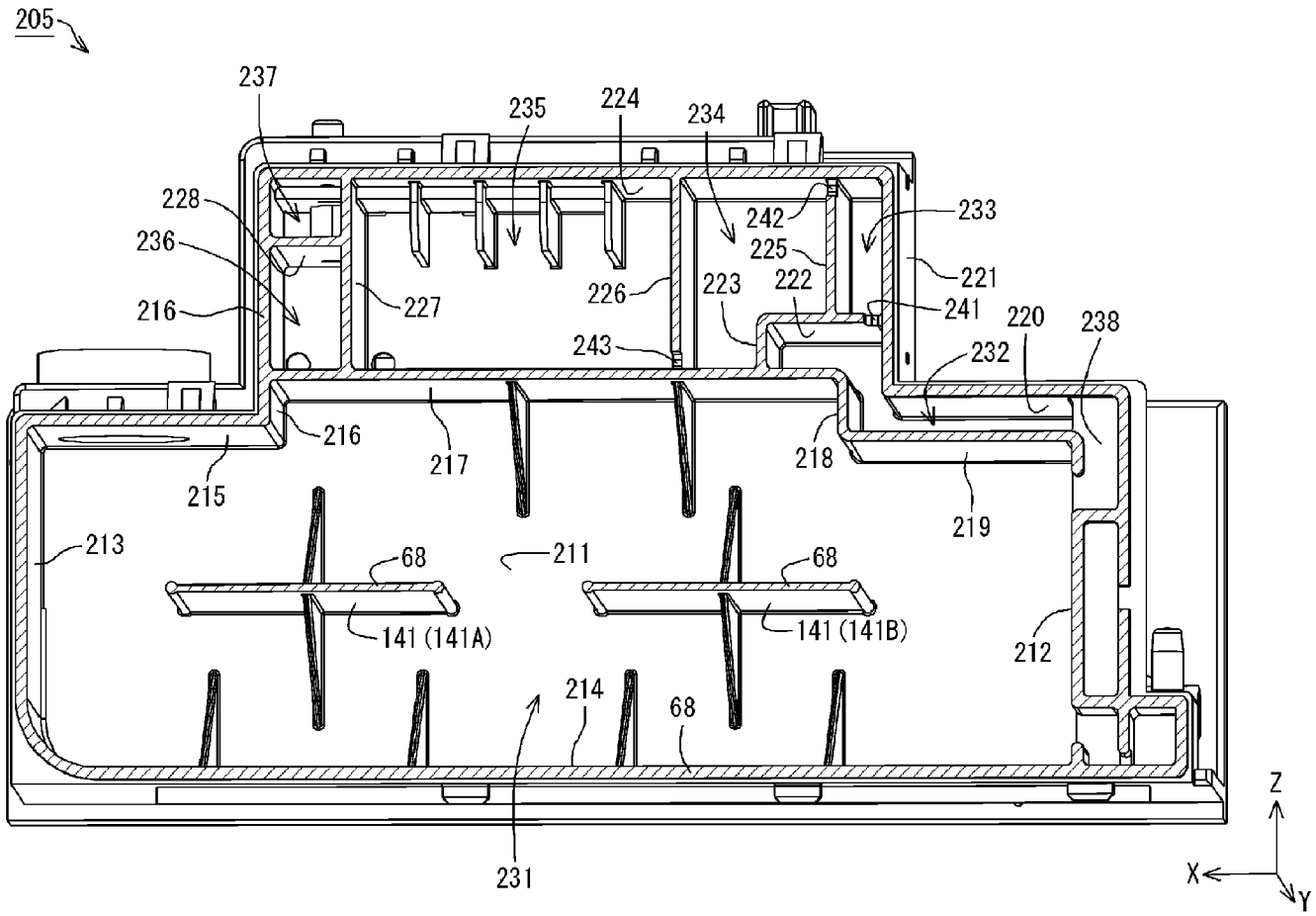
FIG. 24 is a perspective view illustrating the case according to Embodiment 3.

As illustrated in FIG. 24, the case 205 has a wall 211, a wall 212, a wall 213, a wall 214, a wall 215, a wall 216, a wall 217, a wall 218, a wall 219, a wall 220, a wall 221, a wall 222, a wall 223, a wall 224, a wall 225, a wall 226, a wall 227, and a wall 228. The walls 211 to 228 are not limited to flat walls, and may include recesses and projections, steps, or the like.

The wall 211 extends along an XZ plane. 17 walls, namely the walls 212 to 228 intersect the wall 211. 17 walls, namely the walls 212 to 228 project in the -Y-axis direction from the wall 211. When the wall 211 is viewed in a plan view in the Y-axis direction, eight walls, namely the walls 212 to 219 surround the wall 211. The wall 211 and eight walls that are the walls 212 to 219 constitute a recessed portion 231 that has the wall 211 as a bottom.

The wall 212 and the wall 213 are provided in positions opposing each other with a gap therebetween along the X axis, and extend along a YZ plane. The wall 213 is located further in the X-axis direction than the wall 212. The wall 214 is located in the -Z-axis direction relative to the wall 212 and the wall 213, and intersects the wall 212 and the wall 213. When the wall 211 is viewed in a plan view in the Y-axis direction, the walls 215 to 219 are located further in the Z-axis direction than the wall 214. The wall 215 is located further in the X-axis direction than the walls 216 to 219, and intersects the wall 213. The wall 219 is located further in the -X-axis direction than the walls 215 to 218, and intersects the wall 212. The wall 216 is located in the -X-axis direction relative to the wall 215, and extends along a YZ plane. The wall 217 is located in the -X-axis direction relative to the wall 216, and extends along an XY plane. The wall 218 is located in the -X-axis direction relative to the wall 217, and extends along a YZ plane. The wall 219 is located in the -X-axis direction relative to the wall 218, and extends along an XY plane.

In the case 205, a recessed portion 232, a recessed portion 233, a recessed portion 234, a recessed portion 235, a recessed portion 236, a recessed portion 237, and a groove portion 238 are formed. The recessed portion 232 is located in the Z-axis direction relative to the wall 219. The recessed portion 232 is partitioned by the wall 211, the wall 217, the wall 218, the wall 219, the wall 212, the wall 220, the wall 221, the wall 222, and the wall 223.

The wall 220 extends along an XY plane, and is located further in the Z-axis direction than the wall 219. The wall 220 intersects the wall 212. The wall 221 extends along a YZ plane, and is located further in the -X-axis direction than the wall 218 and is located further in the Z-axis direction than the wall 219. The wall 221 intersects the wall 220. The wall 222 extends along an XY plane, and is located further in the Z-axis direction relative to the wall 217. The wall 222 intersects the wall 221. The wall 223 extends along a YZ plane, and is located further in the X-axis direction than the wall 221. The wall 223 intersects the wall 222 and the wall 217. When the wall 211 is viewed in a plan view in the Y-axis direction, the wall 217, the wall 218, the wall 219, the wall 212, the wall 220, the wall 221, the wall 222, and the wall 223 surround a part of the wall 211. With this configuration, the recessed portion 232 that has the wall 211 as a bottom is configured.

The recessed portion 233 is located further in the Z-axis direction than the recessed portion 232. The recessed portion 233 is partitioned by the wall 211, the wall 221, the wall 222, the wall 224, and the wall 225. The wall 224 extends along an XY plane, and is located further in the Z-axis direction relative to the wall 222. The wall 224 intersects the wall 221. The wall 225 extends along a YZ plane, and is located further in the X-axis direction than the wall 221 and is located further in the -X-axis direction than the wall 223. The wall 225 intersects the wall 222 and the wall 224. When the wall 211 is viewed in a plan view in the Y-axis direction, the wall 221, the wall 222, the wall 224, and the wall 225 surround a part of the wall 211. With this configuration, the recessed portion 233 that has the wall 211 as a bottom is configured.

The recessed portion 234 is located in the Z-axis direction relative to the recessed portion 231 and in the X-axis direction relative to the recessed portion 233. The recessed portion 234 is partitioned by the wall 211, the wall 217, the wall 223, the wall 222, the wall 225, the wall 224, and the wall 226. The wall 226 extends along a YZ plane, and is located further in the X-axis direction than the wall 223. The wall 226 intersects the wall 224 and the wall 217. When the wall 211 is viewed in a plan view in the Y-axis direction, the wall 217, the wall 223, the wall 222, the wall 225, the wall 224, and the wall 226 surround a part of the wall 211. With this configuration, the recessed portion 234 that has the wall 211 as a bottom is configured.

The recessed portion 235 is located in the Z-axis direction relative to the recessed portion 231 and in the X-axis direction relative to the recessed portion 234. The recessed portion 235 is partitioned by the wall 211, the wall 217, the wall 226, the wall 224, and the wall 227. The wall 227 extends along a YZ plane, and is located further in the X-axis direction than the wall 226 and is located further in the -X-axis direction than the wall 216. The wall 227 intersects the wall 224 and the wall 217. When the wall 211 is viewed in a plan view in the Y-axis direction, the wall 217, the wall 226, the wall 224, and the wall 227 surround a part of the wall 211. With this configuration, the recessed portion 235 that has the wall 211 as a bottom is configured.

The recessed portion 236 is located in the Z-axis direction relative to the recessed portion 231 and in the X-axis direction relative to the recessed portion 235. The recessed portion 236 is partitioned by the wall 211, the wall 216, the wall 217, the wall 227, and the wall 228. The wall 228 extends along an XY plane, and is located further in the Z-axis direction than the wall 217 and further in the -Z-axis direction than the wall 224. The wall 228 intersects the wall 216 and the wall 227. When the wall 211 is viewed in a plan view in the Y-axis direction, the wall 216, the wall 217, the wall 227, and the wall 228 surround a part of the wall 211. With this configuration, the recessed portion 236 that has the wall 211 as a bottom is configured.

The recessed portion 237 is located in the Z-axis direction relative to the recessed portion 236 and in the X-axis direction relative to the recessed portion 235. The recessed portion 237 is partitioned by the wall 211, the wall 216, the wall 228, the wall 227, and the wall 224. When the wall 211 is viewed in a plan view in the Y-axis direction, the wall 216, the wall 228, the wall 227, and the wall 224 surround a part of the wall 211. With this configuration, the recessed portion 237 that has the wall 211 as a bottom is configured.

When the wall 211 is viewed in a plan view in the Y-axis direction, the groove portion 238 is located at a portion where the wall 212 intersects the wall 220. The groove portion 238 is provided in a region spanned across the wall 219 along the Z axis, and is in communication with the recessed portion 231 and the recessed portion 232. That is to say, the recessed portion 231 and the recessed portion 232 are connected to each other via the groove portion 238.

A cutout portion 241 is formed in the wall 222 that partitions the recessed portion 232 and the recessed portion 233. The recessed portion 232 is connected to the recessed portion 233 via the cutout portion 241. Also, a cutout portion 242 is formed in the wall 225 that partitions the recessed portion 233 and the recessed portion 234. The recessed portion 233 is connected to the recessed portion 234 via the cutout portion 242. A cutout portion 243 is formed in the wall 226 that partitions the recessed portion 234 and the recessed portion 235. The recessed portion 234 is connected to the recessed portion 235 via the cutout portion 243.

The recessed portions 231 to 237, the groove portion 238, and the cutout portions 241 to 243 are formed in a direction of being recessed from the -Y-axis direction to the Y-axis direction. The recessed portions 231 to 237, the groove portion 238, and the cutout portions 241 to 243 are surrounded by the joint portion 68 when the wall 211 is viewed in a plan view in the Y-axis direction. Note that, in the tank 9C, a face of the sheet member 64 (FIG. 22) that is oriented in the -Y-axis direction corresponds to the back face 54 (FIG. 22) of the tank 9C, as mentioned above. Therefore, in the tank 9C, the recessed portions 231 to 237, the groove portion 238, and the cutout portions 241 to 243 are provided in the back face 54.

Note that the sheet member 64 (FIG. 22) has a size and a shape that allow the sheet member 64 to cover the joint portion 68 (FIG. 24) that surrounds the recessed portions 231 to 237, the groove portion 238, and the cutout portions 241 to 243, when the tank 9C is viewed in a plan view in the Y-axis direction. Therefore, upon the sheet member 64 being joined to the joint portion 68 of the case 205, the recessed portions 231 to 237, the groove portion 238, and the cutout portions 241 to 243 are blocked by the sheet member 64. Thus, the recessed portions 231 to 237 are made as chambers that are partitioned from one another.

Note that, in Embodiment 3 as well, the support portions 141 are provided within the recessed portion 231 of the case 205, similarly as in Embodiment 1. In Embodiment 3 as well, the joint portion 68 is provided at an end of each support portion 141 in the -Y-axis direction, similarly as in Embodiment 1. In Embodiment 3, the support portions 141 extend along an XY plane. Embodiment 3 is different from Embodiment 1 in this point.

A face of the wall 212 of the case 205 illustrated in FIG. 24 in the -X-axis direction, i.e., a face of the wall 212 on the side opposite to the recessed portion 231 side corresponds to the side face 52 of the tank 9C illustrated in FIG. 22. A face of the wall 213 illustrated in FIG. 24 in the X-axis direction, i.e., a face of the wall 213 on the side opposite to the recessed portion 231 side corresponds to the side face 55 illustrated in FIG. 21. A face of the wall 214 illustrated in FIG. 24 in the -Z-axis direction, i.e., a face of the wall 214 on the side opposite to the recessed portion 231 side corresponds to the lower face 56 illustrated in FIG. 22. A face of the wall 215 illustrated in FIG. 24 in the Z-axis direction, i.e., a face of the wall 215 on the side opposite to the recessed portion 231 side corresponds to the upper face 53C illustrated in FIG. 21. A face of the wall 224 illustrated in FIG. 24 in the Z-axis direction, i.e., a face of the wall 224 on the side opposite to the recessed portion 235 side corresponds to the upper face 53A illustrated in FIG. 21. A face of the wall 220 illustrated in FIG. 24 in the Z-axis direction, i.e., a face of the wall 220 on the side opposite to the recessed portion 231 side corresponds to the upper face 53B illustrated in FIG. 21.

Figure 25:
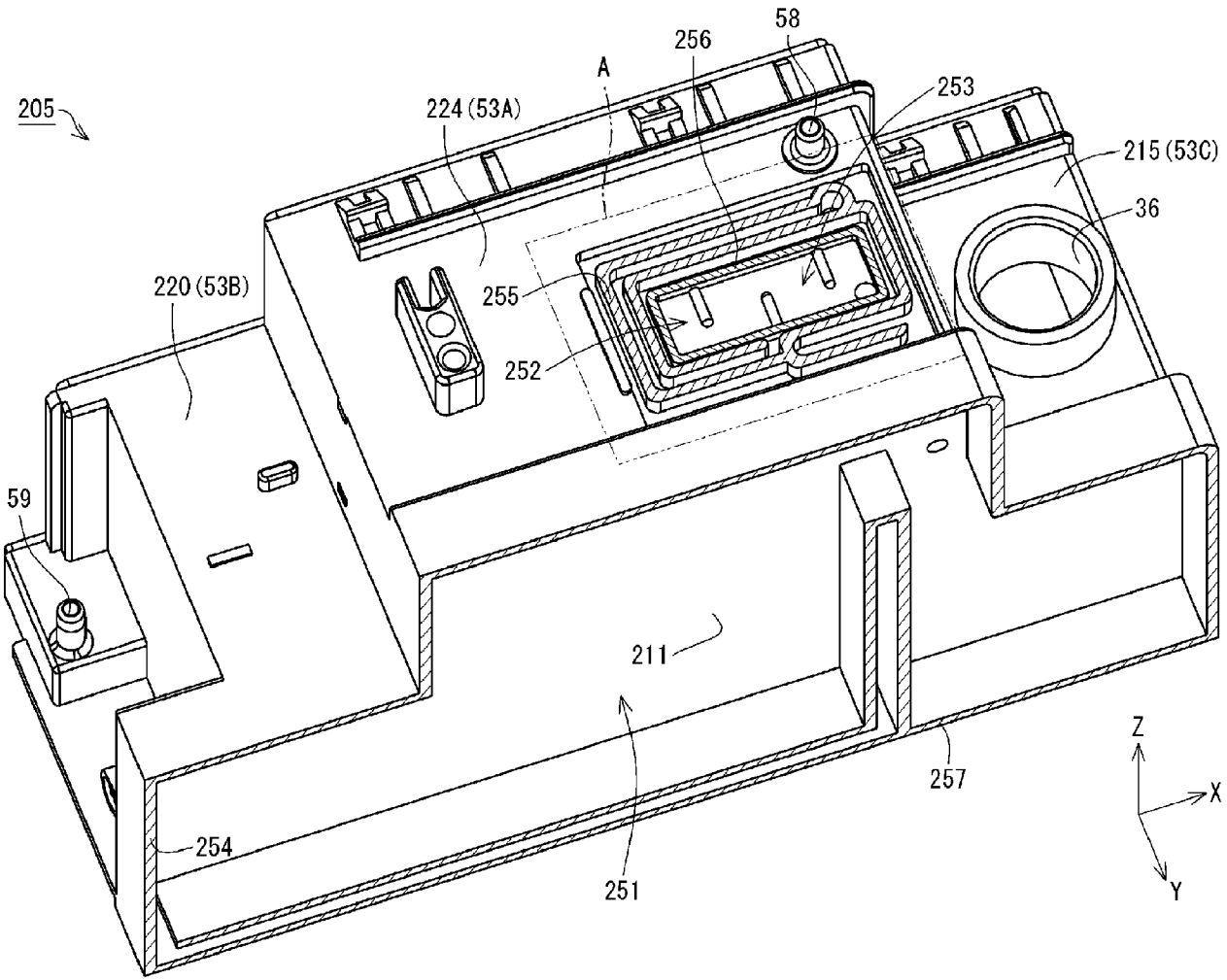
FIG. 25 is a perspective view illustrating the case according to Embodiment 3.

As illustrated in FIG. 25, a recessed portion 251, a recessed portion 252, and a recessed portion 253 are formed in the case 205. Furthermore, the case 205 has a partition wall 254, a partition wall 255, and a partition wall 256. The recessed portion 251 is located on the side opposite to the recessed portion 231 (FIG. 24) side with the wall 211 therebetween. That is to say, the recessed portion 251 is located in the Y-axis direction relative to the recessed portion 231 (FIG. 24) with the wall 211 therebetween. Note that the wall 211 of the recessed portion 231 and the wall 211 of the recessed portion 251 are the same wall as each other. That is to say, in this embodiment, the recessed portion 231 and the recessed portion 251 share the wall 211.

The recessed portion 251 is partitioned by the wall 211 and the partition wall 254. The partition wall 254 is provided on a face of the wall 211 that is oriented in the Y-axis direction. The partition wall 254 projects in the Y-axis direction from the wall 211. When the wall 211 is viewed in a plan view in the -Y-axis direction, a region surrounded by the partition wall 254 is the region of the recessed portion 251. The wall 211 and the partition wall 254 that surrounds the wall 211 constitute the recessed portion 251 that has the wall 211 as a bottom. The recessed portion 251 is formed in the direction of being recessed in the -Y-axis direction.

An end of the partition wall 254 in the Y-axis direction is set as a joint portion 257. In FIG. 25, the joint portion 257 is hatched for the purpose of clearly illustrating the configuration of the joint portion 257. The sheet member 66 (FIG. 23) is joined to the joint portion 257. In this embodiment, the case 205 is joined to the sheet member 66 by means of adhesion. The sheet member 66 has a size and a shape that allow the sheet member 66 to cover the recessed portion 251 and the joint portion 257 when the wall 211 illustrated in FIG. 25 is viewed in a plan view in the -Y-axis direction. Therefore, upon the sheet member 66 being joined to the case 205, the recessed portion 251 is blocked by the sheet member 66. Thus, the recessed portion 251 is made as a chamber.

Figure 26:
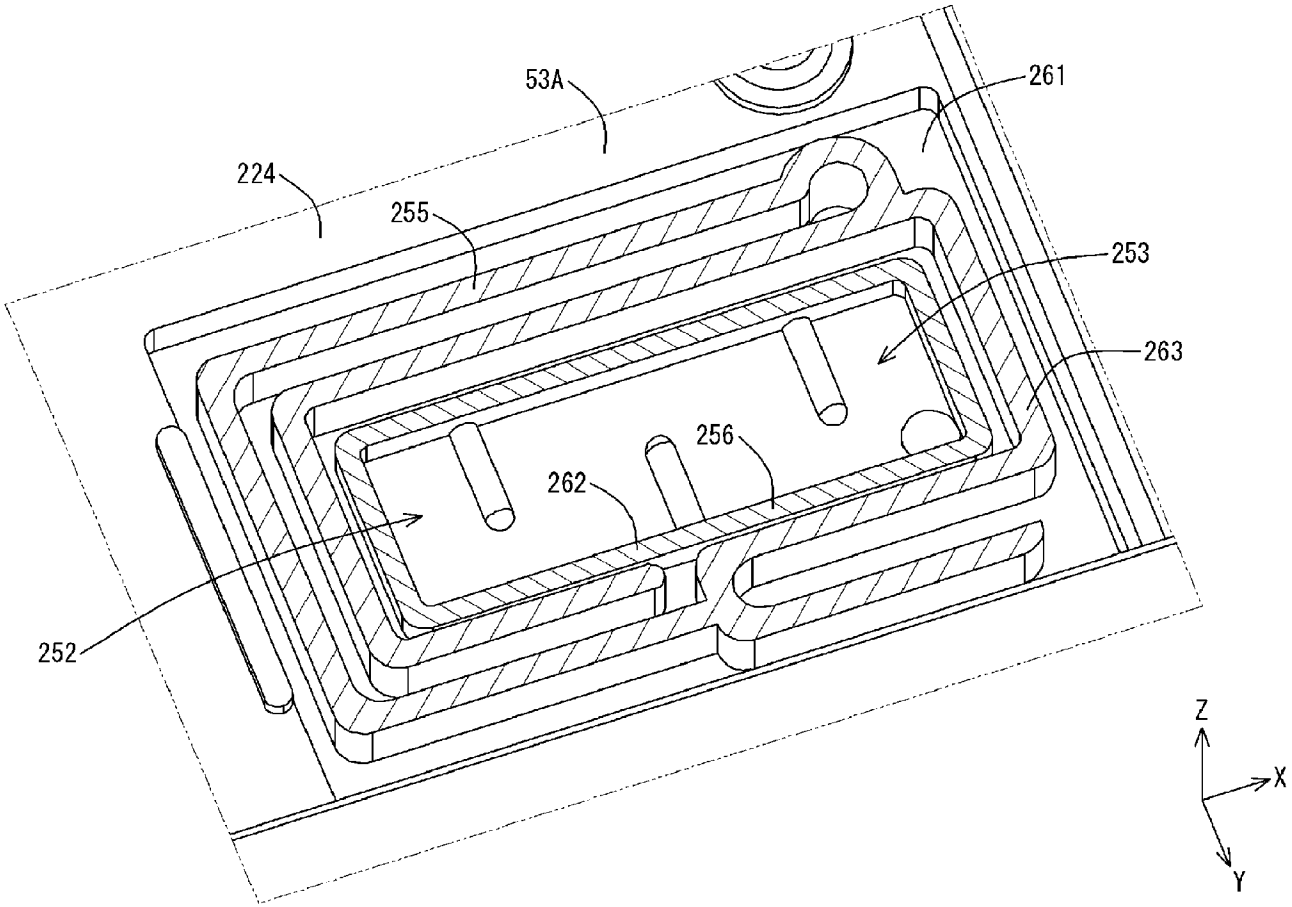
FIG. 26 is an enlarged view of an area A in FIG. 25.

The recessed portion 252 and the recessed portion 253 are formed on the upper face 53A of the wall 224. The recessed portion 252 and the recessed portion 253 are formed in a direction of being recessed in the -Z-axis direction from the wall 224. As illustrated in FIG. 26, which is an enlarged view of an area A in FIG. 25, a face 261 is formed in the wall 224. The face 261 is located further in the -Z-axis direction than the upper face 53A of the wall 224. The recessed portion 252 is partitioned by the face 261 of the wall 224 and the partition wall 255. The partition wall 255 is provided in the face 261, and projects in the Z-axis direction from the face 261. When the wall 224 is viewed in a plan view in the -Z-axis direction, a region surrounded by the partition wall 255 is the region of the recessed portion 252. The face 261 and the partition wall 255 that surrounds the face 261 constitute the recessed portion 252 that has the face 261 as a bottom. Note that the recessed portion 252 is formed in a direction of being recessed in the -Z-axis direction.

When the wall 224 is viewed in a plan view in the -Z-axis direction, the recessed portion 253 is located in a region surrounded by the partition wall 255. That is to say, the recessed portion 253 is provided within the recessed portion 252. The recessed portion 253 is partitioned by the face 261 of the wall 224 and the partition wall 256. The partition wall 256 is provided in the face 261, and projects in the Z-axis direction from the face 261. The amount of projection of the partition wall 256 from the face 261 is smaller than the amount of projection of the partition wall 255 from the face 261. When the wall 224 is viewed in a plan view in the -Z-axis direction, a region surrounded by the partition wall 256 is the region of the recessed portion 253. The face 261 and the partition wall 256 that surrounds the face 261 constitute the recessed portion 253 that has the face 261 as a bottom. Note that the recessed portion 253 is formed in a direction of being recessed in the -Z-axis direction.

An end in the Z-axis direction of the partition wall 256 that partitions the recessed portion 253 is set as the joint portion 262. In FIG. 26, the joint portion 262 is hatched for the purpose of clearly illustrating the configuration of the joint portion 262. The waterproof air-permeable film 65 (FIG. 23) is joined to the joint portion 262. The waterproof air-permeable film 65 has a size and a shape that allow the waterproof air-permeable film 65 to cover the recessed portion 253 and the joint portion 262 when the wall 224 is viewed in a plan view in the -Z-axis direction. Therefore, upon the joint portion 262 being joined to the waterproof air-permeable film 65, the recessed portion 253 is blocked by the waterproof air-permeable film 65. Thus, the recessed portion 253 is made as a chamber that is partitioned from the recessed portion 252 by the waterproof air-permeable film 65.

An end in the Z-axis direction of the partition wall 255 that partitions the recessed portion 252 is set as the joint portion 263. In FIG. 26, the joint portion 263 is hatched for the purpose of clearly illustrating the configuration of the joint portion 263. The sheet member 206 (FIG. 23) is joined to the joint portion 263. The sheet member 206 has a size and a shape that allow the sheet member 206 to cover the recessed portion 252 and the joint portion 263 when the wall 224 is viewed in a plan view in the -Z-axis direction. Therefore, upon the joint portion 263 being joined to the sheet member 206, the recessed portion 252 is blocked by the sheet member 206. Thus, the recessed portion 253 is made as a chamber. Note that since the amount of projection of the partition wall 256 from the face 261 is smaller than the amount of projection of the partition wall 255 from the face 261, a gap is provided in the Z-axis direction between the waterproof air-permeable film 65 and the sheet member 206.

Figure 27:
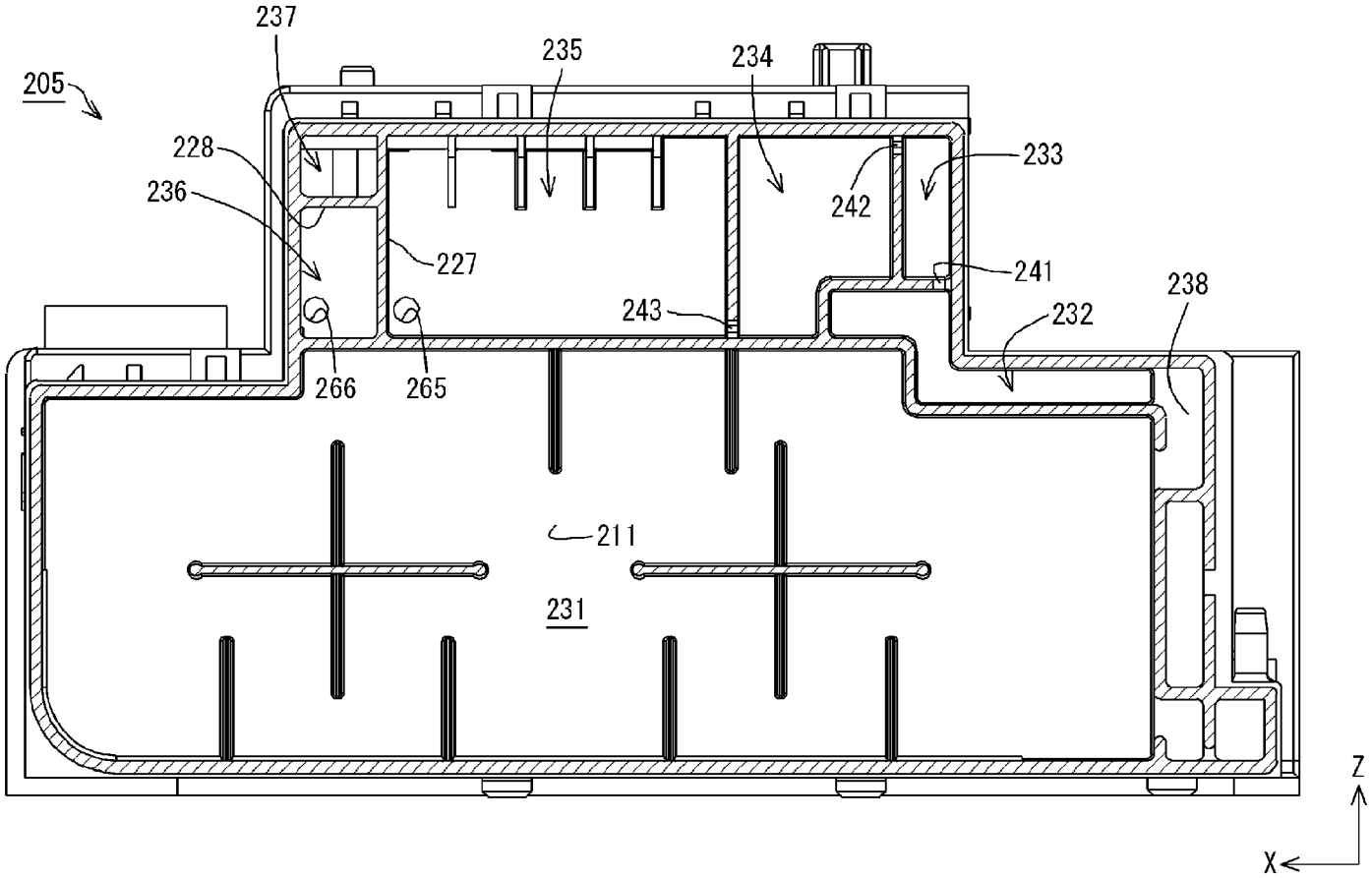
FIG. 27 is a diagram of the case according to Embodiment 3 as viewed from the back face side of the tank.
Figure 28:
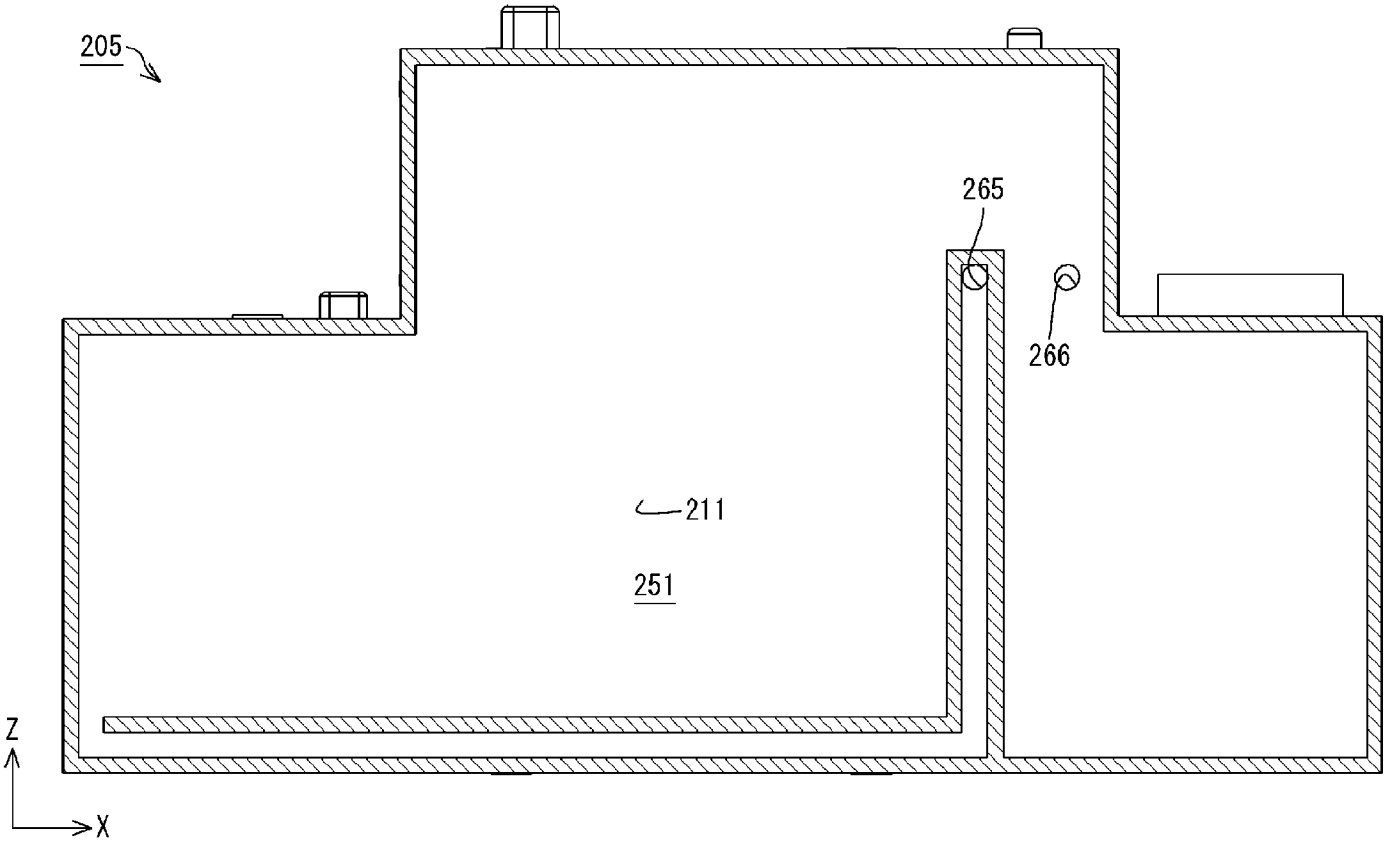
FIG. 28 is a diagram of the case according to Embodiment 3 as viewed from the front face side of the tank.

In the case 205, a communicating portion 265 is provided in the wall 211 in the recessed portion 235, as illustrated in FIG. 27. A communicating portion 266 is provided in the wall 211 in the recessed portion 236. In this embodiment, the communicating portion 265 and the communicating portion 266 are provided as through holes formed in the wall 211. As illustrated in FIG. 28, the communicating portion 265 and the communicating portion 266 are in communication with the inside of the recessed portion 251. Therefore, the recessed portion 251 is in communication with the communicating portion 265 and the communicating portion 266. Accordingly, as illustrated in FIG. 27, the recessed portion 235 and the recessed portion 236 are partitioned from each other by the wall 227, but are connected to each other through the communicating portion 265, the recessed portion 251 (FIG. 28), and the communicating portion 266. That is to say, the recessed portion 235 and the recessed portion 236 are in communication with each other via the recessed portion 251.

Figure 29:
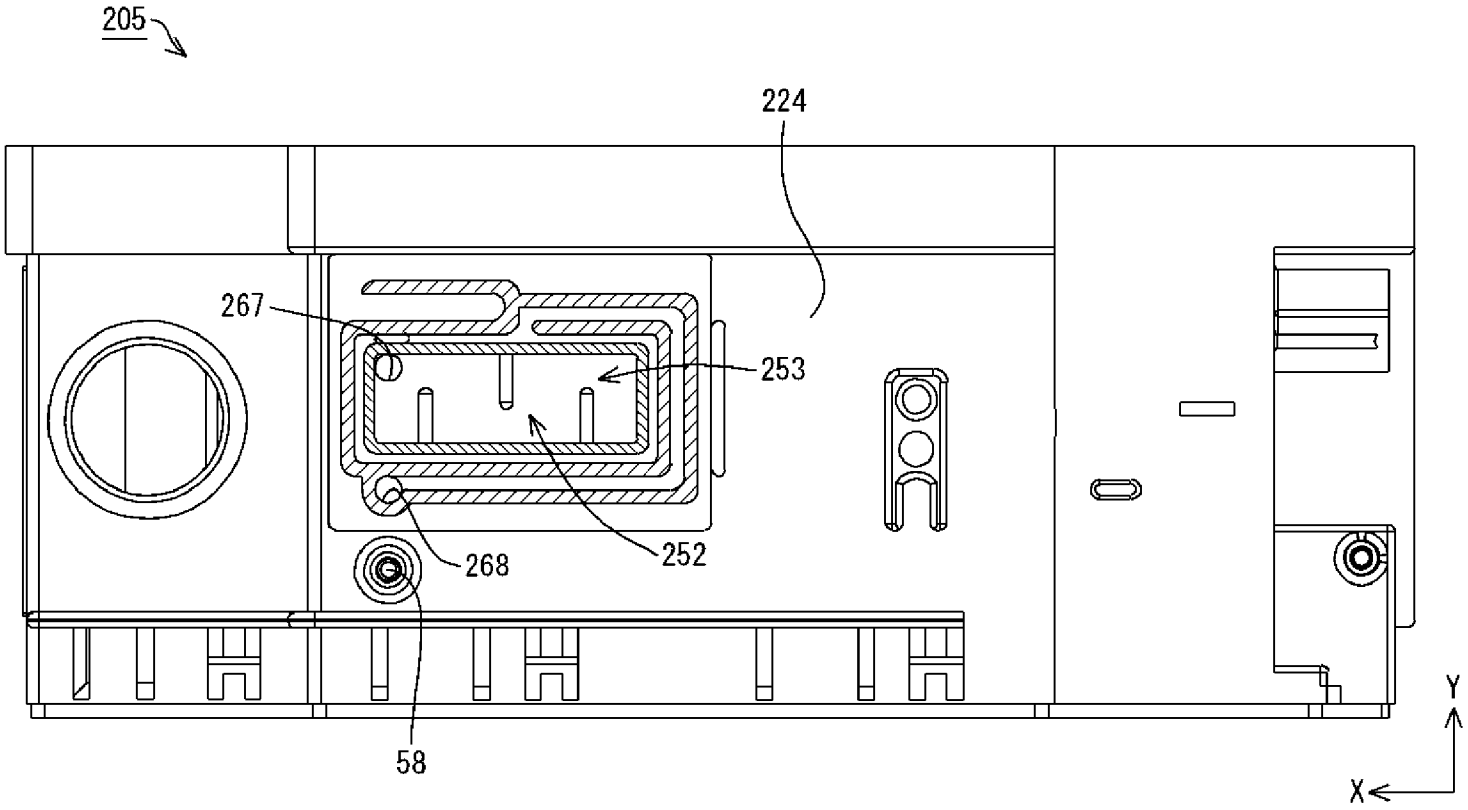
FIG. 29 is a diagram of the case according to Embodiment 3 as viewed from the upper face side of the tank.

In the case 205, a communicating portion 267 is provided in the wall 224 in the recessed portion 253, as illustrated in FIG. 29. A communicating portion 268 is provided in the wall 224 in the recessed portion 252. In this embodiment, the communicating portion 267 and the communicating portion 268 are provided as through holes formed in the wall 224. Furthermore, the communicating portion 267 also passes through from the wall 224 to the wall 228 (FIG. 27). The communicating portion 267 is in communication with the inside of the recessed portion 236. The communicating portion 268 is in communication with the recessed portion 237. In the case 205, the atmosphere opening portion 58 (FIG. 29) also passes through the wall 224 and is in communication with the recessed portion 237 (FIG. 27).

With the above configuration, the communicating portion 267 illustrated in FIG. 29 is in communication with the recessed portion 253 and the recessed portion 236 (FIG. 27), and therefore, the recessed portion 253 and the recessed portion 236 are in communication with each other through the communicating portion 267. Also, since the communicating portion 268 illustrated in FIG. 29 and the atmosphere opening portion 58 are connected to the recessed portion 237, the recessed portion 253 and the atmosphere opening portion 58 are connected to each other through the recessed portion 237 (FIG. 27). That is to say, the recessed portion 253 and the atmosphere opening portion 58 are in communication with each other via the recessed portion 237.

Figure 30:
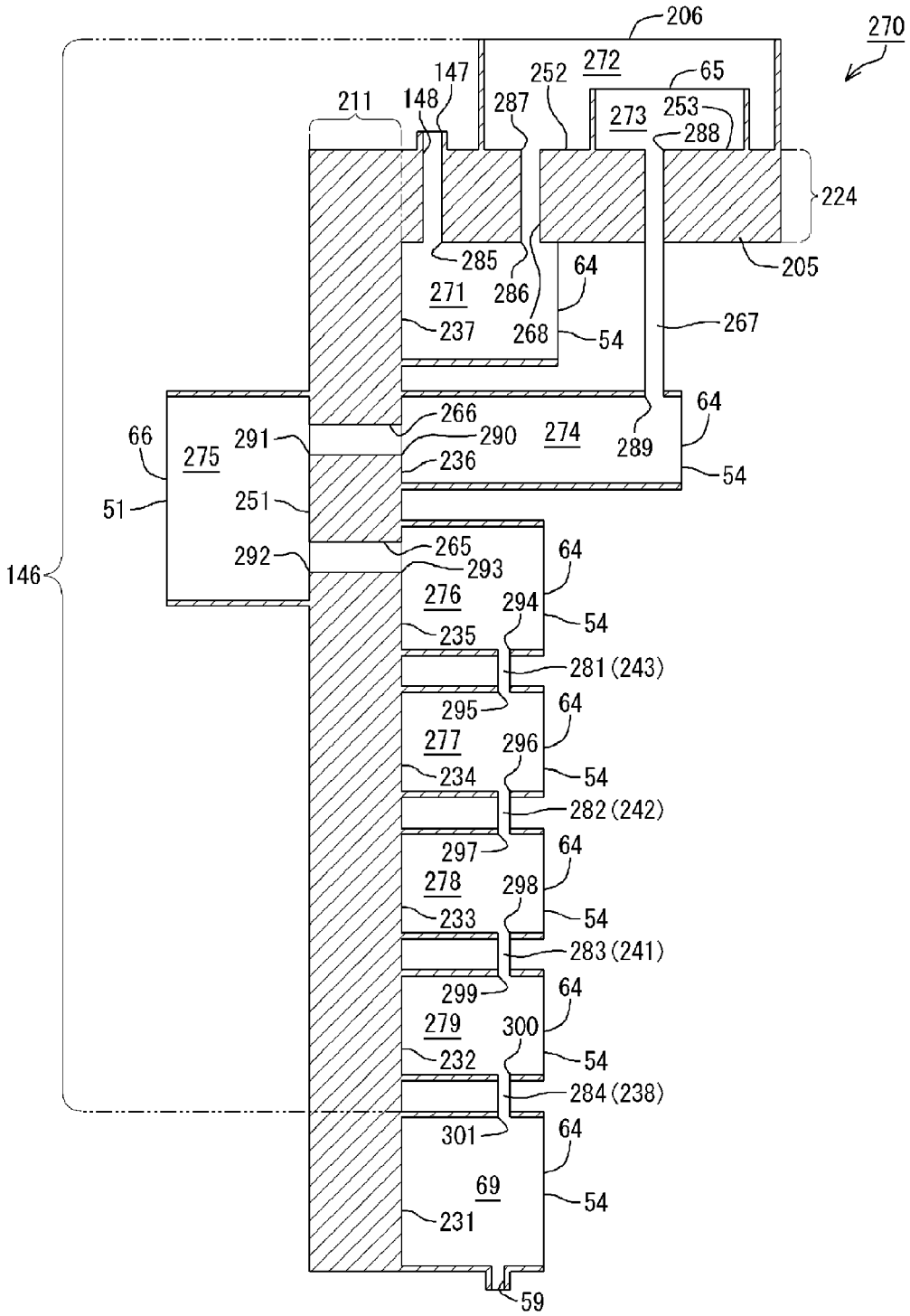
FIG. 30 is a diagram schematically illustrating a flow path of the tank according to Embodiment 3.

A flow path 270 extending from the atmosphere opening port 147 to the liquid supply portion 59 will now be described with reference to a schematic diagram. Here, the flow path 270 extending from the atmosphere opening port 147 to the liquid supply portion 59 will be schematically described for the purpose of facilitating understanding. Note that the direction extending from the atmosphere opening port 147 to the liquid supply portion 59 will be considered to be the direction in which a fluid flows. This direction will serve as a basis of "upstream" and "downstream". The flow path 270 extending from the atmosphere opening port 147 to the liquid supply portion 59 includes the atmosphere communicating portion 146, the liquid containing portion 69, and the liquid supply portion 59, as illustrated in FIG. 30.

The atmosphere communicating portion 146 includes an atmosphere chamber 271, an atmosphere chamber 272, an atmosphere chamber 273, an atmosphere chamber 274, an atmosphere chamber 275, an atmosphere chamber 276, an atmosphere chamber 277, an atmosphere chamber 278, and an atmosphere chamber 279. The atmosphere communicating portion 146 includes a communicating path 281, a communicating path 282, a communicating path 283, and a communicating path 284.

The atmosphere chamber 271 is provided on the downstream side of the introduction path 148. The atmosphere chamber 271 is a region surrounded by the recessed portion 237 of the case 205 and the sheet member 64. Note that an opening of the introduction path 148 on the atmosphere chamber 271 side is denoted as a communicating port 285. The communicating port 285 corresponds to a connection port between the atmosphere chamber 271 and the introduction path 148.

The atmosphere chamber 272 is provided on the downstream side of the atmosphere chamber 271. The atmosphere chamber 272 is a region surrounded by the recessed portion 252 and the sheet member 206. The atmosphere chamber 271 and the atmosphere chamber 272 are in communication with each other via the communicating portion 268 that passes through the wall 224 of the case 205. Note that an opening of the communicating portion 268 on the atmosphere chamber 271 side is denoted as a communicating port 286. The communicating port 286 corresponds to a connection port between the atmosphere chamber 271 and the introduction path 268. An opening of the communicating portion 268 on the atmosphere chamber 272 side is denoted as a communicating port 287. The communicating port 287 corresponds to a connection port between the atmosphere chamber 272 and the communicating portion 268.

The atmosphere chamber 273 is a region surrounded by the recessed portion 253 and the waterproof air-permeable film 65. The atmosphere chamber 273 is located in the atmosphere chamber 272. The atmosphere can move between the atmosphere chamber 272 and the atmosphere chamber 273 via the waterproof air-permeable film 65. The atmosphere chamber 274 is provided on the downstream side of the atmosphere chamber 273. The atmosphere chamber 274 is a region surrounded by the recessed portion 236 of the case 205 and the sheet member 64. The atmosphere chamber 273 and the atmosphere chamber 274 are in communication with each other via the communicating portion 267 that passes through the wall 224 of the case 205. Note that an opening of the communicating portion 267 on the atmosphere chamber 273 side is denoted as a communicating port 288. The communicating port 288 corresponds to a connection port between the atmosphere chamber 273 and the communicating portion 267. An opening of the communicating portion 267 on the atmosphere chamber 274 side is denoted as a communicating port 289. The communicating port 289 corresponds to a connection port between the atmosphere chamber 274 and the communicating portion 267.

The atmosphere chamber 275 is provided on the downstream side of the atmosphere chamber 274. The atmosphere chamber 275 is a region surrounded by the recessed portion 251 of the case 205 and the sheet member 66. The atmosphere chamber 274 and the atmosphere chamber 275 are in communication with each other via the communicating portion 266 that passes through the wall 211 of the case 205. Note that an opening of the communicating portion 266 on the atmosphere chamber 274 side is denoted as a communicating port 290. The communicating port 290 corresponds to a connection port between the atmosphere chamber 274 and the communicating portion 266. Note that an opening of the communicating portion 266 on the atmosphere chamber 275 side is denoted as a communicating port 291. The communicating port 291 corresponds to a connection port between the atmosphere chamber 275 and the communicating portion 266.

The atmosphere chamber 276 is provided on the downstream side of the atmosphere chamber 275. The atmosphere chamber 276 is a region surrounded by the recessed portion 235 of the case 205 and the sheet member 64. The atmosphere chamber 275 and the atmosphere chamber 276 are in communication with each other via the communicating portion 265 that passes through the wall 211 of the case 205. Note that an opening of the communicating portion 265 on the atmosphere chamber 275 side is denoted as a communicating port 292. The communicating port 292 corresponds to a connection port between the atmosphere chamber 275 and the communicating portion 265. An opening of the communicating portion 265 on the atmosphere chamber 276 side is denoted as a communicating port 293. The communicating port 293 corresponds to a connection port between the atmosphere chamber 276 and the communicating portion 265.

The communicating path 281 is provided on the downstream side of the atmosphere chamber 276. The communicating path 281 is a region surrounded by the cutout portion 243 of the case 205 and the sheet member 64. The atmosphere chamber 276 and the communicating path 281 are connected to each other via a communicating port 294. That is to say, the communicating port 294 corresponds to a connection port between the atmosphere chamber 276 and the communicating path 281.

The atmosphere chamber 277 is provided on the downstream side of the communication path 281. The atmosphere chamber 277 is a region surrounded by the recessed portion 234 of the case 205 and the sheet member 64. The communicating path 281 and the atmosphere chamber 277 are connected to each other via a communicating port 295. That is to say, the communicating port 295 corresponds to a connection port between the communicating path 281 and the atmosphere chamber 277.

The communicating path 282 is provided on the downstream side of the atmosphere chamber 277. The communication path 282 is a region surrounded by the cutout portion 242 of the case 205 and the sheet member 64. The atmosphere chamber 277 and the communicating path 282 are connected to each other via a communicating port 296. That is to say, the communicating port 296 corresponds to a connection port between the atmosphere chamber 277 and the communicating path 282.

The atmosphere chamber 278 is provided on the downstream side of the communication path 282. The atmosphere chamber 278 is a region surrounded by the recessed portion 233 of the case 205 and the sheet member 64. The communicating path 282 and the atmosphere chamber 278 are connected to each other via a communicating port 297. That is to say, the communicating port 297 corresponds to a connection port between the communicating path 282 and the atmosphere chamber 278.

The communicating path 283 is provided on the downstream side of the atmosphere chamber 278. The communicating path 283 is a region surrounded by the cutout portion 241 of the case 205 and the sheet member 64. The atmosphere chamber 278 and the communicating path 283 are connected to each other via a communicating port 298. That is to say, the communicating port 298 corresponds to a connection port between the atmosphere chamber 278 and the communicating path 283.

The atmosphere chamber 279 is provided on the downstream side of the communication path 283. The atmosphere chamber 279 is a region surrounded by the recessed portion 232 of the case 205 and the sheet member 64. The communication path 283 and the atmosphere chamber 279 are connected to each other via a communicating port 299. That is to say, the communicating port 299 corresponds to a connection port between the communicating path 283 and the atmosphere chamber 279.

The communicating path 284 is provided on the downstream side of the atmosphere chamber 279. The communicating path 284 is a region surrounded by the groove portion 238 of the case 205 and the sheet member 64. The atmosphere chamber 279 and the communicating path 284 are connected to each other via a communicating port 300. That is to say, the communicating port 300 corresponds to a connection port between the atmosphere chamber 279 and the communicating path 284.

The liquid containing portion 69 is provided on the downstream side of the communicating path 284. The liquid containing portion 69 is a region surrounded by the recessed portion 231 of the case 205 and the sheet member 64. The communicating path 284 and the liquid containing portion 69 are connected to each other via a connection port 301. The connection port 301 is a connection port between the communicating path 284 and the liquid containing portion 69, and is also a connection port between the atmosphere communicating portion 146 and the liquid containing portion 69. The liquid supply portion 59 is provided on the downstream side of the liquid containing portion 69. In this embodiment, the flow path 270 extending from the atmosphere opening port 147 to the liquid supply portion 59 has the above configuration.

Upon ink in the liquid containing portion 69 being supplied to the recording portion 31 (FIG. 2) via the liquid supply portion 59, the amount of the ink in the liquid containing portion 69 decreases. If the amount of the ink in the liquid containing portion 69 decreases, the air pressure in the liquid containing portion 69 is likely to become lower than the atmospheric pressure. In this embodiment, the atmosphere communicating portion 146 extending from the atmosphere opening port 147 to the communicating path 284 is in communication with the liquid containing portion 69. For this reason, if the amount of the ink in the liquid containing portion 69 decreases and the air pressure in the liquid containing portion 69 becomes lower than the atmospheric pressure, the atmosphere may be introduced into the liquid containing portion 69 via the atmosphere communicating portion 146. As a result, the air pressure in the liquid containing portion 69 can be readily maintained at the atmospheric pressure.

At this time, the atmosphere introduced into the liquid containing portion 69 flows into the atmosphere chamber 271 from the atmosphere opening port 147 via the introduction path 148. The atmosphere that has flowed into the atmosphere chamber 271 flows into the atmosphere chamber 272 from the communicating port 286 through the communicating port 287 of the communicating portion 268. The atmosphere that has flowed into the atmosphere chamber 272 flows into the atmosphere chamber 273 through the waterproof air-permeable film 65. The atmosphere that has flowed into the atmosphere chamber 273 flows into the atmosphere chamber 274 from the communicating port 288 through the communicating port 289 of the communicating portion 267. The atmosphere that has flowed into the atmosphere chamber 274 flows into the atmosphere chamber 275 from the communicating port 290 through the communicating port 291 of the communicating portion 266. The atmosphere that has flowed into the atmosphere chamber 275 flows into the atmosphere chamber 276 from the communicating port 292 through the communicating port 293 of the communicating portion 265.

The atmosphere that has flowed into the atmosphere chamber 276 flows into the atmosphere chamber 277 from the communicating port 294 through the communicating port 295 of the communicating path 281. The atmosphere that has flowed into the atmosphere chamber 277 flows into the atmosphere chamber 278 from the communicating port 296 through the communicating port 297 of the communicating path 282. The atmosphere that has flowed into the atmosphere chamber 278 flows into the atmosphere chamber 279 from the communicating port 298 through the communicating port 299 of the communicating path 283. The atmosphere that has flowed into the atmosphere chamber 279 flows into the liquid containing portion 69 from the communicating port 300 through the connection port 301 of the communicating path 284. Embodiment 3 can also achieve the effects similar to Embodiment 1.

In the tank 9C, one of the front face 51 and the back face 54 corresponds to a first face, and the other one of the front face 51 and the back face 54 corresponds to a second face. The atmosphere chamber 275 provided in the front face 51 corresponds to one of a first atmosphere chamber and a second atmosphere chamber. The atmosphere chamber 271, the atmosphere chamber 274, the atmosphere chamber 276, the communicating path 281, the atmosphere chamber 277, the communicating path 282, the atmosphere chamber 278, the communicating path 283, the atmosphere chamber 279, and the communicating path 284 that are provided in the back face 54, correspond to the other one of the first atmosphere chamber and the second atmosphere chamber. The atmosphere chamber 272 provided in the upper face 53A corresponds to a third atmosphere chamber.

Figure 31:
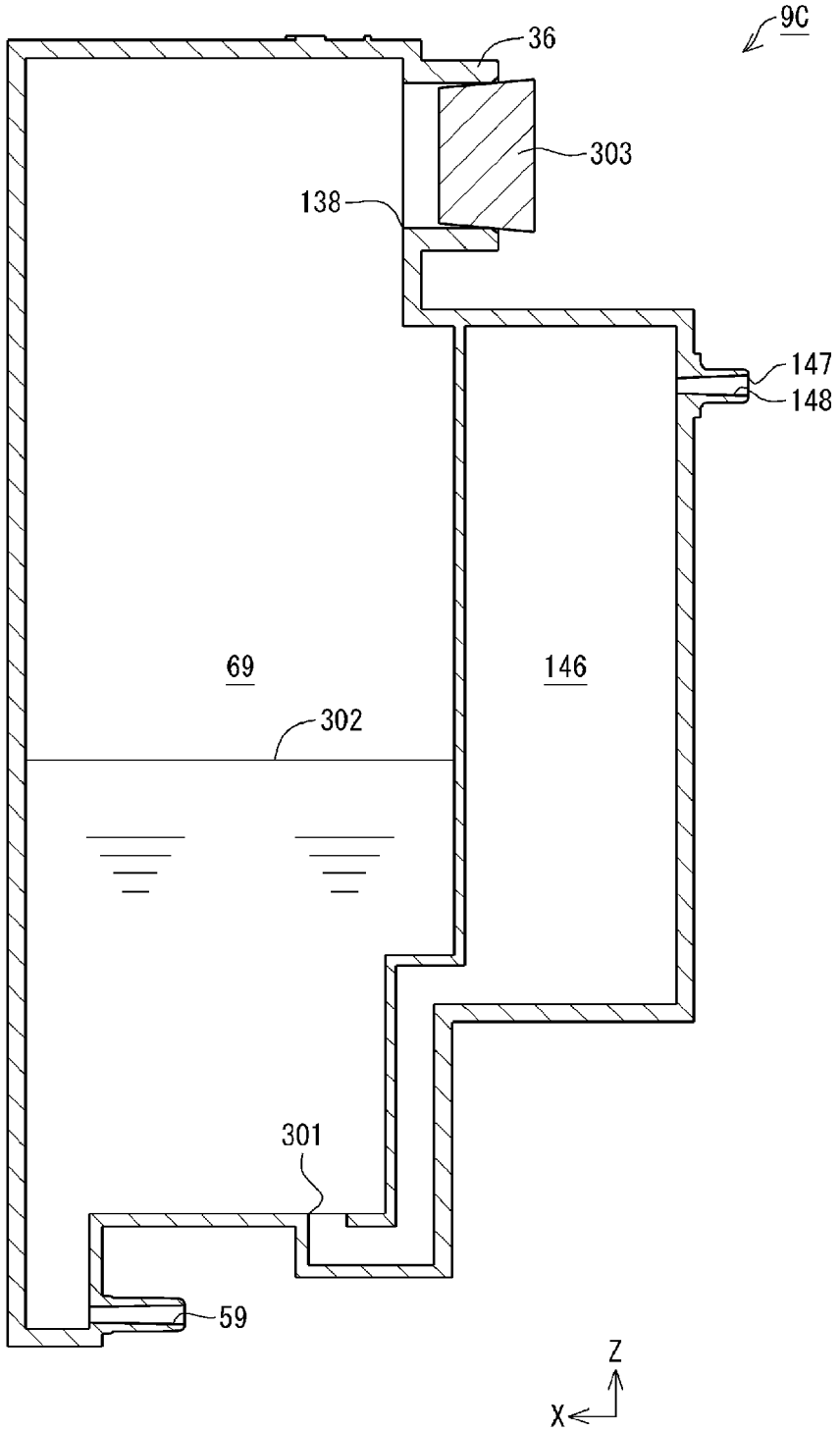
FIG. 31 is a cross-sectional view schematically illustrating the tank according to Embodiment 3 in a usage posture.

Note that, in the usage posture of the tank 9C, the liquid inlet port 138 is oriented in a direction that intersects the Z axis, as illustrated in FIG. 31. In FIG. 31, various components are simplified for the purpose of schematically illustrating the configuration. In the usage state, the liquid supply portion 59 is located vertically below the liquid inlet port 138. In the usage posture of the tank 9C, the connection port 301 between the atmosphere communicating portion 146 and the liquid containing portion 69 is located vertically below the liquid inlet port 138. In the usage state of the tank 9C, the connection port 301 is located vertically above the liquid supply portion 59. With this configuration, in the tank 9C, the connection port 301 is immersed in ink 302 contained in the liquid containing portion 69. When the liquid ejection system 1 is used for printing, the liquid inlet portion 36 of the tank 9C is sealed by the cap 303.

With the above configuration, in the usage posture of the tank 9C, a change in a water load due to a change in the liquid level of the ink 302 in the liquid containing portion 69 can be reduced, compared with a configuration in which the connection port 301 is located vertically above the liquid surface of the ink 302 contained in the liquid containing portion 69. That is to say, with the tank 9C, it is possible to reduce a change in the pressure of the ink 302 supplied to the recording portion 31 due to a change in the liquid level of the ink 302 in the liquid containing portion 69. Thus, it is possible to readily suppress a significant change in the pressure of the ink 302 supplied to the recording head of the recording portion 31 caused by an increase and a decrease in the amount of the ink 302 in the liquid containing portion 69 in the tank 9C. As a result, a change in performance of ejection of the ink 302 in the recording portion 31 can be readily suppressed, and therefore, print quality can be readily maintained at a favorable level.

In the above embodiments, the liquid ejection apparatus may be a liquid ejection apparatus that consumes liquid other than ink by ejecting, discharging, or applying the liquid. Note that the status of liquid discharged as a very small amount of droplets from the liquid ejection apparatus includes a granular shape, a tear-drop shape, and a shape having a thread-like trailing end. Furthermore, the liquid mentioned here may be any kind of material that can be consumed by the liquid ejection apparatus. For example, the liquid need only be a material whose substance is in the liquid phase, and includes fluids such as inorganic solvent, organic solvent, solution, liquid resin, and liquid metal (metal melt) in the form of a liquid body having a high or low viscosity, sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiments, liquid crystal, or the like. Here, "ink" encompasses general water-based ink and oil-based ink, as well as various types of liquid compositions such as gel ink and hot melt-ink. Moreover, sublimation transfer ink may be used as the ink. The sublimation transfer ink is ink that includes a sublimating color material, such as subliming dye. As a printing method, such sublimation transfer ink is ejected to a transfer medium by the liquid ejection apparatus, this transfer medium is brought into contact with a material to be printed, and is heated, thereby sublimating the color material and transferring this color material to the material to be printed. The material to be printed is a T-shirt, a smartphone, or the like. Thus, with the ink that includes a sublimating color material, various materials to be printed (print mediums) can be printed. Specific examples of the liquid ejection apparatus include a liquid ejection apparatus that ejects liquid including a material, such as an electrode material or a color material that is used for manufacturing a liquid crystal display, an EL (electro-luminescence) display, a surface emission display, or a color filter, for example, in the form of being dispersed or dissolved. The liquid ejection apparatus may also be a liquid ejection apparatus that ejects biological organic matter used in manufacturing of a biochip, a liquid ejection apparatus that is used as a precision pipette and ejects a liquid serving as a sample, a textile printing apparatus, a microdispenser, or the like. Furthermore, the liquid ejection apparatus may be a liquid ejection apparatus that ejects lubricating oil in a pinpoint manner to a precision machine such as a watch or a camera, or a liquid ejection apparatus that ejects, onto a substrate, transparent resin liquid such as UV-cured resin for forming, for example, a micro-hemispherical lens (optical lens) that is used in an optical communication element or the like. The liquid ejection apparatus may also be a liquid ejection apparatus that ejects acid or alkaline etchant, for example, for etching substrates or the like.

Note that the invention is not limited to the above embodiments and examples, and can be achieved as various configurations without departing from the gist of the invention. For example, the technical features in the embodiments and examples that correspond to the technical features in the modes described in the summary of the invention may be replaced or combined as appropriate in order to solve a part of, or the entire foregoing problem, or to achieve some or all of the above-described effects. The technical features that do not described as essential in the specification may be deleted as appropriate.

What is claimed is:

1. A liquid container capable of containing a liquid, comprising:

a liquid containing portion configured to contain the liquid;

a liquid inlet port through which the liquid is injectable into the liquid containing portion;

an atmosphere opening port communicating with the liquid containing portion and through which atmosphere is introducible into the liquid containing portion;

a first sheet member having a first face that faces outward in a first direction; and a second sheet member having a second face that faces outward in a second direction that is different from the first direction;

an atmosphere communicating portion leading to the liquid containing portion from the atmosphere opening port, the atmosphere communicating portion comprising a plurality of atmosphere chambers including:

a first atmosphere chamber, at least one side of which is defined by the first sheet member, and a second atmosphere chamber, at least one side of which is defined by the second sheet member; and a wall, at least a portion of which is located between the first atmosphere chamber and the second atmosphere chamber, the wall comprising at least one communicating portion;

wherein the first atmosphere chamber and the second atmosphere chamber are communicably connected to one another via the at least one communicating portion of the wall.

2. The liquid container according to claim 1, wherein the second direction is opposite the first direction.

3. The liquid container according to claim 1, further comprising:

a third sheet member having a third face that faces outward in a direction intersecting the first and second directions, wherein the plurality of atmosphere chambers further include a third atmosphere chamber, at least one side of which is defined by the third sheet member.

4. The liquid container according to claim 1, wherein a waterproof air-permeable member is arranged in an atmosphere chamber that is closest to the atmosphere opening port in a flow path of the atmosphere communicating portion among the plurality of atmosphere chambers.

5. The liquid container according to claim 1, wherein, in a posture of the liquid container when in use, a connection port between the atmosphere communicating portion and the liquid containing portion is located at the same position in a vertical direction as the liquid inlet port, or is located above the liquid inlet port.

6. The liquid container according to claim 1, wherein, in a posture of the liquid container when in use, a connection port between the atmosphere communicating portion and the liquid containing portion is located below the liquid inlet port.

7. The liquid container according to claim 1, wherein the liquid is ink that contains a sublimating color material.

8. A liquid ejection system comprising:

a liquid container according to claim 1;

a liquid ejection head to which the liquid is supplied from the liquid container; and an exterior portion that houses the liquid container and the liquid ejection head, wherein the liquid container comprises a visual check portion that enables a position of a liquid surface of the liquid contained in the liquid containing portion to be visually checked.

9. A liquid ejection system comprising:

a liquid container according to claim 2;

a liquid ejection head to which the liquid is supplied from the liquid container; and an exterior portion that houses the liquid container and the liquid ejection head, wherein the liquid container comprises a visual check portion that enables a position of a liquid surface of the liquid contained in the liquid containing portion to be visually checked.

10. A liquid ejection system comprising:

a liquid container according to claim 3;

a liquid ejection head to which the liquid is supplied from the liquid container; and an exterior portion that houses the liquid container and the liquid ejection head, wherein the liquid container comprises a visual check portion that enables a position of a liquid surface of the liquid contained in the liquid containing portion to be visually checked.

11. A liquid ejection system comprising:

a liquid container according to claim 4;

a liquid ejection head to which the liquid is supplied from the liquid container; and an exterior portion that houses the liquid container and the liquid ejection head, wherein the liquid container comprises a visual check portion that enables a position of a liquid surface of the liquid contained in the liquid containing portion to be visually checked.

12. A liquid ejection system comprising:

a liquid container according to claim 5;

a liquid ejection head to which the liquid is supplied from the liquid container; and an exterior portion that houses the liquid container and the liquid ejection head, wherein the liquid container comprises a visual check portion that enables a position of a liquid surface of the liquid contained in the liquid containing portion to be visually checked.

13. A liquid ejection system comprising:

a liquid container according to claim 6;

a liquid ejection head to which the liquid is supplied from the liquid container; and an exterior portion that houses the liquid container and the liquid ejection head, wherein the liquid container comprises a visual check portion that enables a position of a liquid surface of the liquid contained in the liquid containing portion to be visually checked.

14. A liquid ejection system comprising:

a liquid container according to claim 7;

a liquid ejection head to which the liquid is supplied from the liquid container; and an exterior portion that houses the liquid container and the liquid ejection head, wherein the liquid container comprises a visual check portion that enables a position of a liquid surface of the liquid contained in the liquid containing portion to be visually checked.

15. The liquid ejection system according to claim 8, wherein the visual check portion includes an upper limit index portion indicating a guide of an upper limit of an amount of liquid in the liquid containing portion.

16. The liquid container according to claim 8, wherein the exterior portion is includes a window portion that enables the visual check portion to be visually checked.

* * * * *